US012760746B2

(12) United States Patent
Bao et al.

(10) Patent No.: US 12,760,746 B2
(45) Date of Patent: Oct. 13, 2026

(54) FLUID ASSEMBLY, DRIVE ASSEMBLY, FLUID CONTROL APPARATUS AND MANUFACTURING METHOD THEREFOR

(71) Applicant: ZHEJIANG SANHUA AUTOMOTIVE COMPONENTS CO., LTD., Hangzhou (CN)

(72) Inventors: Junfeng Bao, Hangzhou (CN); Jun Zhang, Hangzhou (CN); Jundi Hu, Hangzhou (CN); Lixin Wang, Hangzhou (CN); Zhengwei Wang, Hangzhou (CN)

(73) Assignee: ZHEJIANG SANHUA AUTOMOTIVE COMPONENTS CO., LTD., Hangzhou (CN)

( * ) Notice: Subject to any disclaimer, the term of this patent is extended or adjusted under 35 U.S.C. 154(b) by 34 days.

(21) Appl. No.: 18/860,723

(22) PCT Filed: Apr. 27, 2023

(86) PCT No.: PCT/CN2023/091082
§ 371 (c)(1),
(2) Date: Oct. 28, 2024

(87) PCT Pub. No.: WO2023/208095
PCT Pub. Date: Nov. 2, 2023

(65) Prior Publication Data

US 2025/0347294 A1 Nov. 13, 2025

(30) Foreign Application Priority Data

Apr. 29, 2022 (CN) ..... 202210472212.4

(51) Int. Cl.
*F04D 29/42* (2006.01)
*F04D 13/06* (2006.01)
(Continued)

(52) U.S. Cl.
CPC ..... *F04D 29/426* (2013.01); *F04D 13/06* (2013.01); *F04D 13/14* (2013.01); *F04D 15/0005* (2013.01)

(58) Field of Classification Search
CPC ..... F04D 29/426; F04D 13/06; F04D 13/04; F04D 15/0005; F04D 15/0072; F04D 5/08; Y10T 137/85986; F16K 11/085
See application file for complete search history.

(56) References Cited

U.S. PATENT DOCUMENTS 10,683,940 B1 6/2020 Quade et al.
11,333,151 B2 * 5/2022 Blad ..... F04D 1/006
(Continued)

FOREIGN PATENT DOCUMENTS

CN 106640673 A 5/2017
CN 211779163 U 10/2020
(Continued)

OTHER PUBLICATIONS

Translation of CN114151577A retrieved from espacenet.com 2026 (Year: 2026).*
(Continued)

*Primary Examiner* — Jessica Cahill
(74) *Attorney, Agent, or Firm* — Yue (Robert) Xu; Apex Attorneys at Law, LLP

(57) ABSTRACT

A fluid assembly, a drive assembly, a fluid control apparatus and a manufacturing method therefor are provided. The fluid assembly includes a main housing, a pump assembly and a valve assembly. The main housing is provided with first chambers and a second chamber. The first chambers and the second chamber are arranged at an interval. At least part of one pump assembly is arranged in one first chamber in a sealed manner. Each pump assembly includes a rotor assembly. The valve assembly includes a valve core. At least part
(Continued)

of the valve core is arranged in the second chamber in a sealed manner. Thus, the occupied space of the fluid control apparatus can be reduced.

11 Claims, 23 Drawing Sheets

(51) Int. Cl.
*F04D 13/14* (2006.01)
*F04D 15/00* (2006.01)

(56) References Cited

U.S. PATENT DOCUMENTS

2013/0294928 A1* 11/2013 Rosinski ..... H02K 11/00 417/5
2015/0252808 A1 9/2015 Rosinski et al.
2015/0308435 A1 10/2015 Rosinski et al.
2017/0082117 A1* 3/2017 Zhou ..... F04D 13/06
2017/0126089 A1 5/2017 Bao et al.
2020/0031198 A1 1/2020 Chen et al.
2020/0158248 A1 5/2020 Kanzaki et al.
2023/0018407 A1 1/2023 Eslava Orradre et al.
2023/0167826 A1* 6/2023 Jensen ..... F04D 13/06 415/152.1

FOREIGN PATENT DOCUMENTS

CN 112682541 A 4/2021
CN 110073164 B 7/2021
CN 113464441 A 10/2021
CN 113464442 A 10/2021
CN 114151577 A 3/2022
DE 102020130486 A1 6/2021
EP 3904689 A4 * 11/2021

OTHER PUBLICATIONS

International Search Report for PCT/CN203/091082 mailed Jul. 16, 2023, ISA/CN.
The Chinese 1st Office Action issued on Aug. 28, 2025 for CN202210757425.1.
The European search report issued on Mar. 24, 2026 for EP23795527.3.

* cited by examiner

FLUID ASSEMBLY, DRIVE ASSEMBLY, FLUID CONTROL APPARATUS AND MANUFACTURING METHOD THEREFOR

The present application is a national phase application of PCT international patent application PCT/CN2023/091082, filed on Apr. 27, 2023, which claims the priority of the Chinese Patent Application No. 202210472212.4, titled "FLUID CONTROL APPARATUS AND MANUFACTURING METHOD THEREFOR", filed on Apr. 29, 2022 with the China National Intellectual Property Administration, both of which are incorporated herein by reference in their entirety.

FIELD

The present application relates to the technical field of fluid control, and in particular to a fluid assembly, a drive assembly, a fluid control apparatus and a method for manufacturing the fluid control apparatus.

BACKGROUND

A thermal management system generally includes several fluid elements, which are usually connected by pipelines, resulting in a large system footprint. Therefore, it is desired to solve the technical problem of how to design these elements in an integrated way, reduce pipeline connections, or reduce the system footprint in the thermal management system.

SUMMARY

An object of the present application is to provide a fluid assembly, a drive assembly, a fluid control apparatus and a method for manufacturing the fluid control apparatus, which may reduce a footprint of the fluid control apparatus.

In an aspect, a fluid assembly is provided according to an embodiment of the present application. The fluid assembly includes a main housing, a pump assembly and a valve assembly. The main housing has a first chamber and a second chamber, which are spaced from each other.

In the fluid assembly, at least part of the pump assembly is arranged in the first chamber in a sealed manner, and the valve assembly includes a valve core, at least part of which is arranged in the second chamber in the sealed manner.

In another aspect, a drive assembly is provided according to an embodiment of the present application. The drive assembly is configured to cooperate and be connected with the fluid assembly described above.

The drive assembly includes a first housing, a stator assembly and a motor. The stator assembly and the motor are connected with the first housing in a position-limiting manner. The pump assembly includes a rotor assembly, and the rotor assembly includes a magnetic assembly. At least part of the magnetic assembly is located in a magnetic field range of the stator assembly in an operating state, and the motor is in transmission connection with the valve core.

In yet another aspect, a fluid control apparatus is provided according to an embodiment of the present application. The fluid control apparatus includes the fluid assembly and the drive assembly as described above.

The fluid assembly cooperates and is connected with the drive assembly.

In still another aspect, a method for manufacturing the fluid control apparatus is provided according to an embodiment of the present application. The method includes the following steps:

forming at least part of the fluid assembly, including:

providing a main housing, wherein the main housing has a first chamber and a second chamber, which are spaced from each other;

arranging at least part of a pump assembly in the first chamber in the sealed manner, wherein the pump assembly includes a rotor assembly;

arranging at least part of a valve core of a valve assembly in the second chamber in the sealed manner;

providing a drive assembly, wherein the drive assembly includes a first housing, a stator assembly and a motor, and both of the stator assembly and the motor are connected with the first housing in a position-limiting manner;

connecting the fluid assembly to the drive assembly, so that at least part of the magnetic assembly of the rotor assembly is located in the magnetic field range of the stator assembly in the operating state, and the motor is in transmission connection with the valve core shaft of the valve assembly.

The fluid assembly, the drive assembly, the fluid control apparatus and the method for manufacturing the fluid control apparatus are provided in embodiments of the present application. The fluid control apparatus includes the pump assembly and the valve assembly, and the main housing has the first chamber in which at least part of the pump assembly is arranged in the sealed manner, and the second chamber in which at least part of the valve core of the valve assembly is arranged in the sealed manner, the first chamber and the second chamber being spaced from each other. As such, it is easy to mount and integrate the pump assembly and the valve assembly in the same main housing, to reduce the space occupied by the fluid control apparatus and to improve an integration level of the of the fluid control apparatus.

DETAILED DESCRIPTION OF THE EMBODIMENTS

Hereinafter, features and exemplary embodiments of various aspects of the present application will be described in detail. In order to make the purpose, technical solutions and advantages of the present application clearer, the present application will be further described in detail below with reference to the accompanying drawings by means of specific embodiments. Moreover, relational terms such as "first" and "second" in this specification are only used to distinguish one element from another having the same name and do not necessarily require or imply any such actual relationship or order between those elements.

The fluid control apparatus provided according to an embodiment of the present application can be applied to a thermal management system, for example, to a vehicle thermal management system. The fluid control apparatus is configured to control the fluid to realize a circulation of the fluid in the thermal management system.

As shown in FIGS. 1 to 8, a fluid control apparatus 1 is provided according to an embodiment of the present application. The fluid control apparatus 1 includes a drive assembly 100 and a fluid assembly 200 which are in sealed connection. In specific implementation, the whole drive assembly 100 may be assembled with the whole fluid assembly 200, with a sealing member being provided between the drive assembly 100 and the fluid assembly 200 to realize a sealed connection therebetween.

Figure 1:
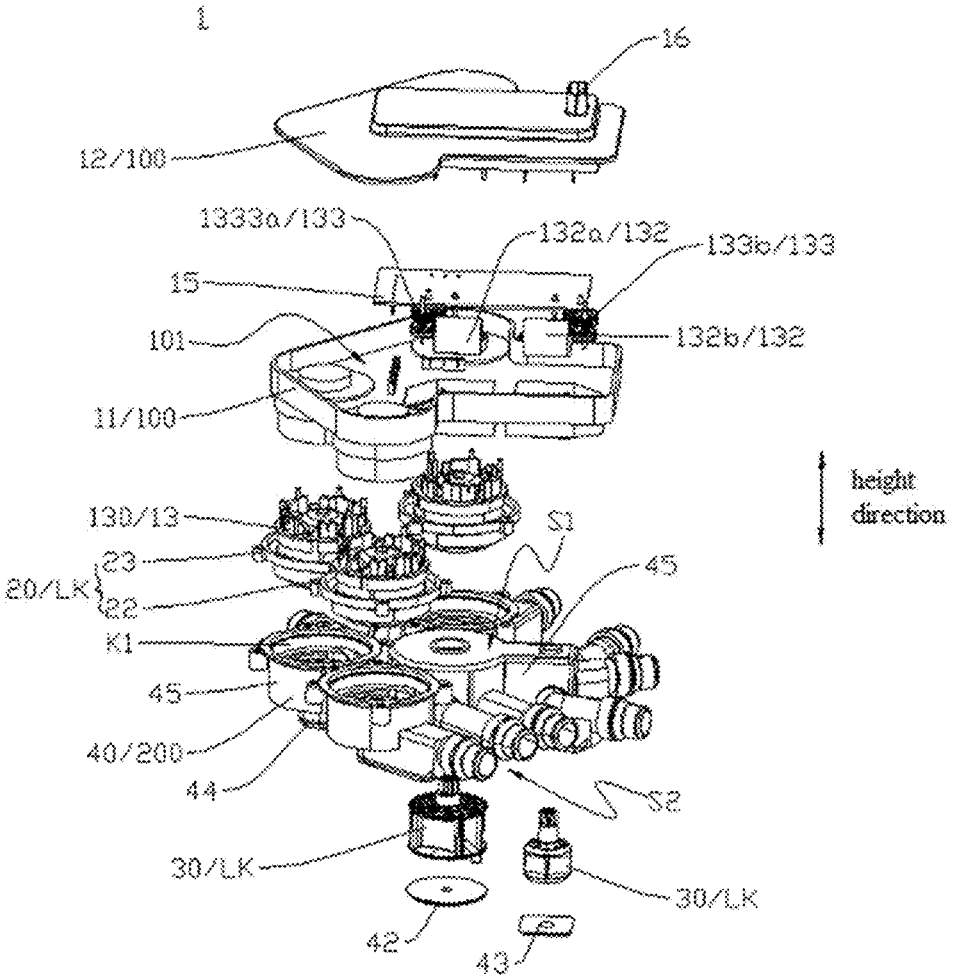
FIG. 1 is a schematic exploded structural view of a fluid control apparatus provided according to a first embodiment of the present application.
Figure 2:
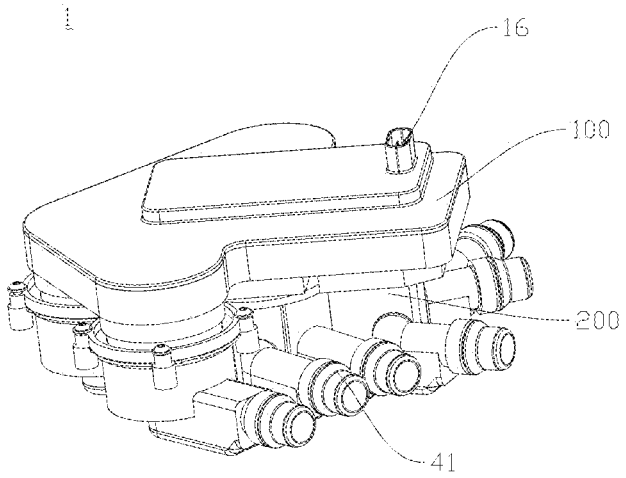
FIG. 2 is a schematic perspective structural view of the fluid control apparatus shown in FIG. 1.
Figure 3:
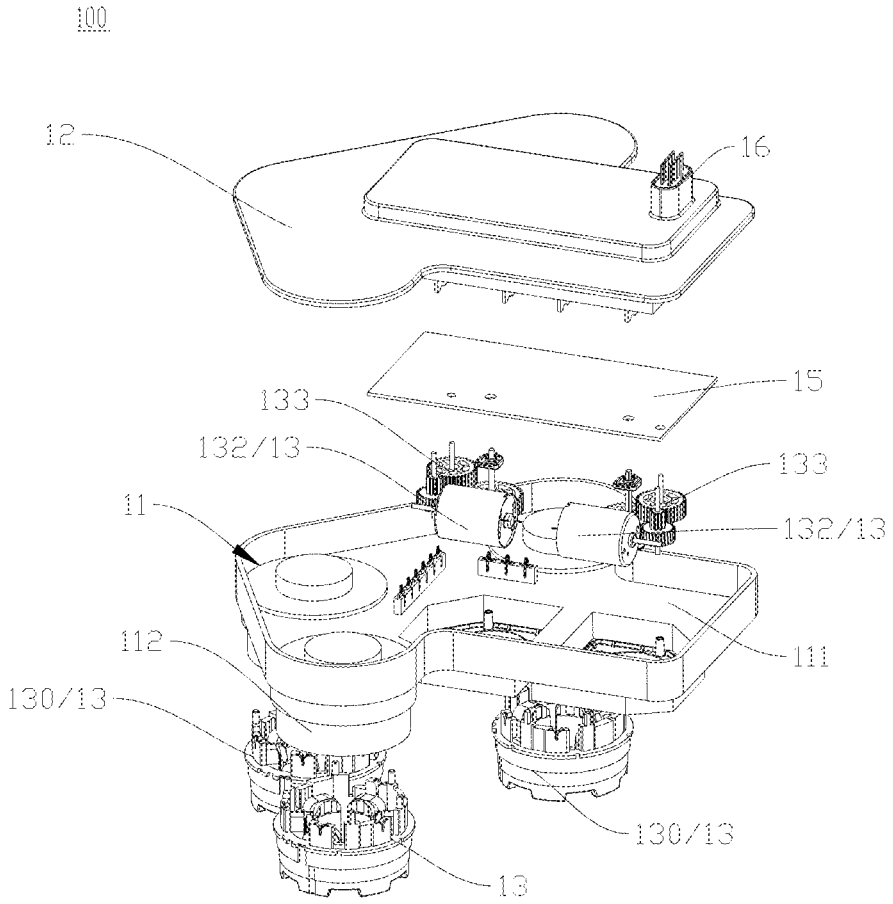
FIG. 3 is a schematic exploded structural view of a drive assembly provided according to an embodiment of the present application.
Figure 4:
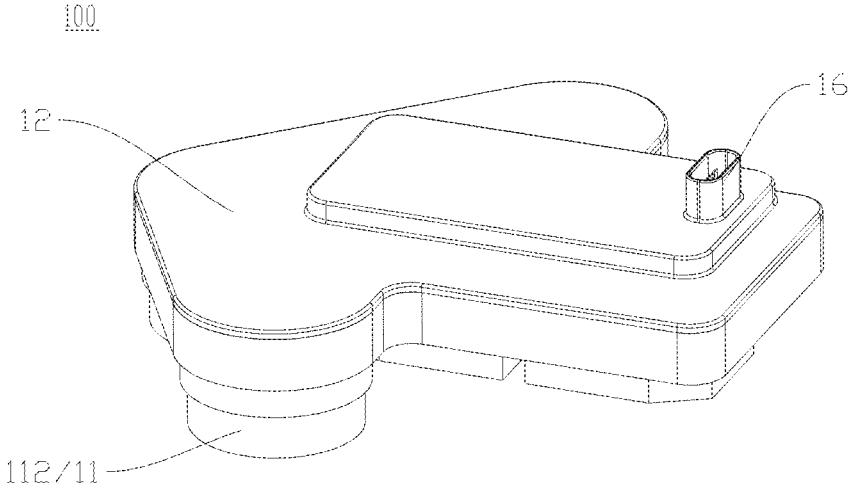
FIG. 4 is a schematic perspective structural view of the drive assembly shown in FIG. 3.
Figure 5:
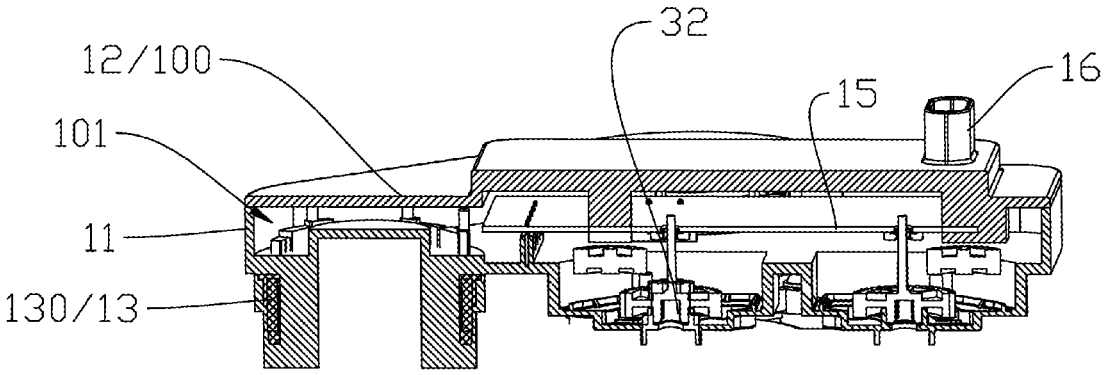
FIG. 5 is a schematic sectional structural view of the drive assembly shown in FIG. 4.
Figure 6:
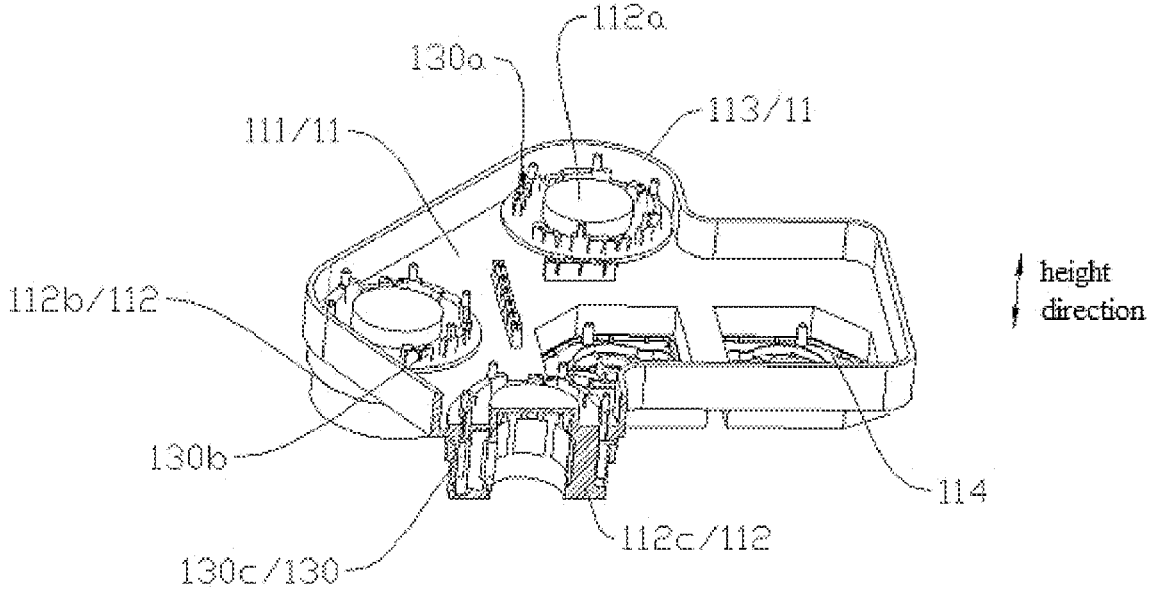
FIG. 6 is a partial schematic sectional structural view of an assembled structure of a first housing and a drive component provided according to an embodiment of the present application.

The drive assembly 100 includes at least two drive components 13, which may include a stator assembly 130, or a motor 132, or a combination of the motor 132 and a gear assembly 133. The fluid assembly 200 includes at least two fluid subassemblies LK, which may include a moving member. The fluid subassembly LK may include one or both of a valve assembly 30 and a pump assembly 20. The moving member in the valve assembly 30 includes a valve core, and the moving member in the pump assembly 20 includes a rotor assembly. When the drive component 13 is energized, the drive component 13 enables the moving member in the fluid subassembly LK to move. For example, when the stator assembly 130 is energized, the stator assembly 130 generates a magnetic field and the rotor assembly rotates under an action of the magnetic field; or when the motor 132 is powered, an output shaft of the motor 132 rotates, thus driving the valve core in the valve assembly 30 to rotate. Optionally, the number of the drive components 13 and the number of the fluid subassemblies LK may be the same or in one-to-one correspondence. After being energized, one of the drive components 13 enables the moving member in the corresponding fluid subassembly LK to move, which allows the fluid to flow in the fluid control apparatus 1. It can be understood that the number of the drive components 13 may also be different from that of the fluid subassemblies LK. For example, the number of the drive components 13 may be less than the number of fluid subassemblies LK, by enabling one drive component 13 to drive at least two fluid subassemblies LK, for example, through a clutch mechanism. As shown in FIG. 1, in this embodiment, the number of the fluid subassemblies LK is five, and correspondingly, the number of the drive components 13 is five. The five drive components respectively correspond to the five fluid subassemblies LK. In other embodiments, the number of the fluid subassemblies LK and the number of the drive components 13 may be determined based on requirements of users, e.g., may be two, three, four or six or more.

Further, a drive assembly 100 is further provided according to an embodiment of the present application. As shown in FIGS. 3 to 9, the drive assembly 100 further includes a first housing 11 and a second housing 12. The drive assembly 100 has a first accommodating cavity 101, and the first housing 11 and the second housing 12 form at least part of a wall portion of the first accommodating cavity 101. In this embodiment, the second housing 12 includes a top cover portion, which is arranged to be opposite to a bottom wall portion 111 in a height direction of the drive assembly 100. The first housing 11 is engaged with the second housing 12 to form the first accommodating cavity 101, and at least part of the at least two drive components 13 is located in the first accommodating cavity 101. As such, the at least two drive components 13 are integrated into one drive assembly 100, which can not only reduce the number of lead wires, but also reduce the space occupied by the drive assembly 100, compared with a separate arrangement of the multiple drive assemblies for controlling the fluid assembly. Optionally, all of the drive components 13 may be connected with the first housing 11 in a position-limiting manner, or a part of the drive components 13 may be connected with the first housing 11 in a position-limiting manner, which is not limited in the present application.

As shown in FIGS. 3 to 9, in the drive assembly 100, the first housing 11 includes the bottom wall portion 111, a position-limiting portion 112 and a circumferential side wall 113. The circumferential side wall 113 is connected to the bottom wall portion 111, and the bottom wall portion 111 is connected to the position-limiting portion 112. For example, the circumferential side wall 113, the bottom wall portion 111 and the position-limiting portion 112 may be fixed into an integrated structure by injection molding, or be fixedly connected by welding, or be connected in the position-limiting manner by a fastener. At least part of the position-limiting portion 112 protrudes from the bottom wall portion 111 along the height direction of the drive assembly 100, and part of the wall portion of the first accommodating cavity 101 is formed by the bottom wall portion 111 and the circumferential side wall 113. At least one of the drive components 13 includes the stator assembly 130. The drive component including the stator assembly 130 is defined as a first drive component, and at least part of the first drive component is connected in the position-limiting portion 112 in the position-limiting manner. As shown in FIGS. 3 to 8, at least part of the stator assembly 130 included in the first drive component is located in the position-limiting portion 112. Alternatively, the first drive component may further include a pump housing, and at least part of the stator assembly 130 is located in a chamber of the pump housing. For example, the stator assembly 130, as an insert, may be fixed to the pump housing by injection molding or assembled into the chamber of the pump housing. In this case, at least part of the pump housing, or at least part of the whole pump housing and stator assembly 130 is located in the position-limiting portion 112. Herein, the expression "at least part of the stator assembly 130 is connected with the position-limiting portion 112 in the position-limiting manner" means that: at least part of the first drive component is integrated with the position-limiting portion 112 by an injection molding process, such that at least part of the first drive component is located in the position-limiting portion 112; or the first drive component is separately arranged from the first housing 11, and at least part of the first drive component may also be located in a chamber formed in the position-limiting portion 112. It is easy to integrate at least two stator assemblies 130 in one drive assembly 100 by connecting at least part of the first drive component in the position-limiting portion 112 in the position-limiting manner. Compared with an arrangement in which multiple driving devices are provided, the fluid control apparatus provided according to an embodiment of the present application enables to reduce the space occupied by the drive assembly 100 and improve the integration level of the drive assembly 100.

With further reference to FIGS. 1 to 9, in this embodiment, the number of the drive components 13 included in the drive assembly 100 is five, and there is a gap between orthographic projections of the five drive components 13 in the height direction of the drive assembly 100. Among the five drive components 13, three of them include three stator assemblies 130 respectively, and all of the three stator assemblies 130 may be connected with the corresponding position-limiting portions 112 in the position-limiting manner and located in the corresponding position-limiting portions 112 respectively. Alternatively, in some other embodiments, one of the drive components 13 of the drive assembly 100 includes a stator assembly 130, and the other drive components may be motors or other drive components, thus realizing the integration of different types of the drive components 13.

Figure 7:
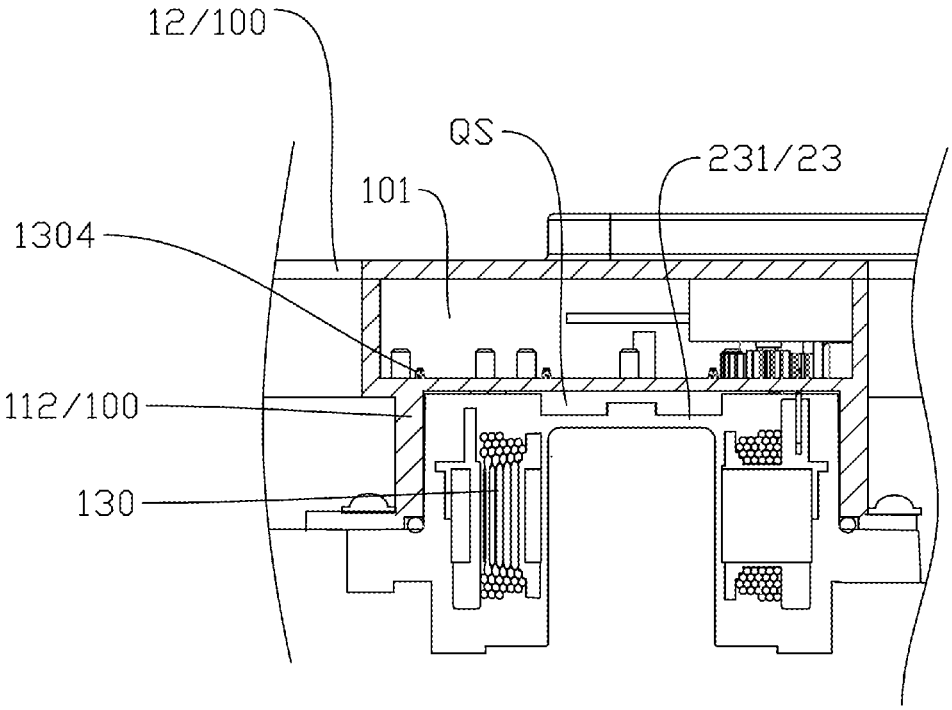
FIG. 7 is a schematic sectional structural view of a drive assembly provided according to another embodiment of the present application.

In order to facilitate the position-limiting of the stator assembly 130, in some embodiments, at least part of the position-limiting portion 112 extends from the bottom wall portion 111 in a direction away from the first accommodating cavity 101. In this case, at least part of the position-limiting portion 112 extends from the bottom wall portion 111 in a direction close to the fluid subassembly LK, that is, at least part of the position-limiting portion 112 protrudes from the bottom wall portion 111 in a direction away from the second housing 12. Optionally, the stator assembly 130 may be fixed to the position-limiting portion 112 by injection molding. The expression "fixed . . . by injection molding" in this specification means formation of an integrated structure by injection molding. Specifically, the stator assembly 130 may be injection-molded as an insert and integrally with the first housing 11, so that the stator assembly 130 and the position-limiting portion 112 are injection-molded into the integrated structure. In this case, electric connection wires may be led out from the stator assembly 130 during injection molding, and the stator assembly 130 may be electrically connected to a control member through the electric connection wires. Alternatively, as shown in FIG. 7, the position-limiting portion 112 includes a mounting cavity QS in which at least part of the stator assembly 130 is located, and the stator assembly 130 may be connected to the first housing 11 in the position-limiting manner, for example, by the fastener. Through the above arrangement, it facilitates the position-limiting arrangement of the stator assembly 130 and the position-limiting portion 112. When the at least two drive components 13 include stator assemblies 130, all of the stator assemblies 130 and the position-limiting portion 112 may be injection-molded into an integrated structure; or all of the stator assemblies 130 may be assembled into the mounting cavity QS formed by the position-limiting portion 112; or part of the stator assemblies 130 and the position-limiting portion 112 may be injection-molded into an integrated structure, and another part of the stator assemblies 130 and the position-limiting portion 112 may be injection-molded into an integrated structure.

Figure 8:
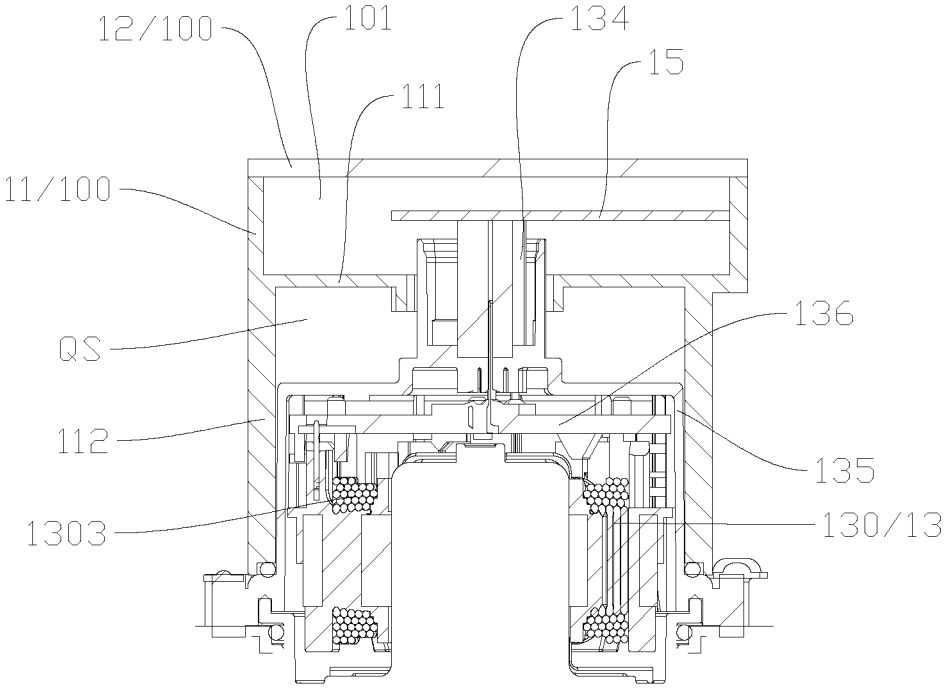
FIG. 8 is a schematic sectional structural view of a drive assembly provided according to a yet another embodiment of the present application.
Figure 9:
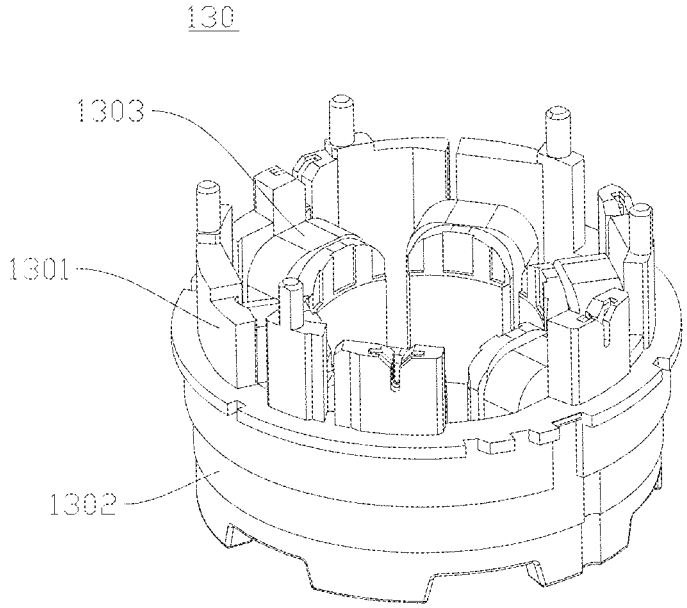
FIG. 9 is a schematic perspective structural view of a stator assembly shown in FIG. 4.
Figure 10:
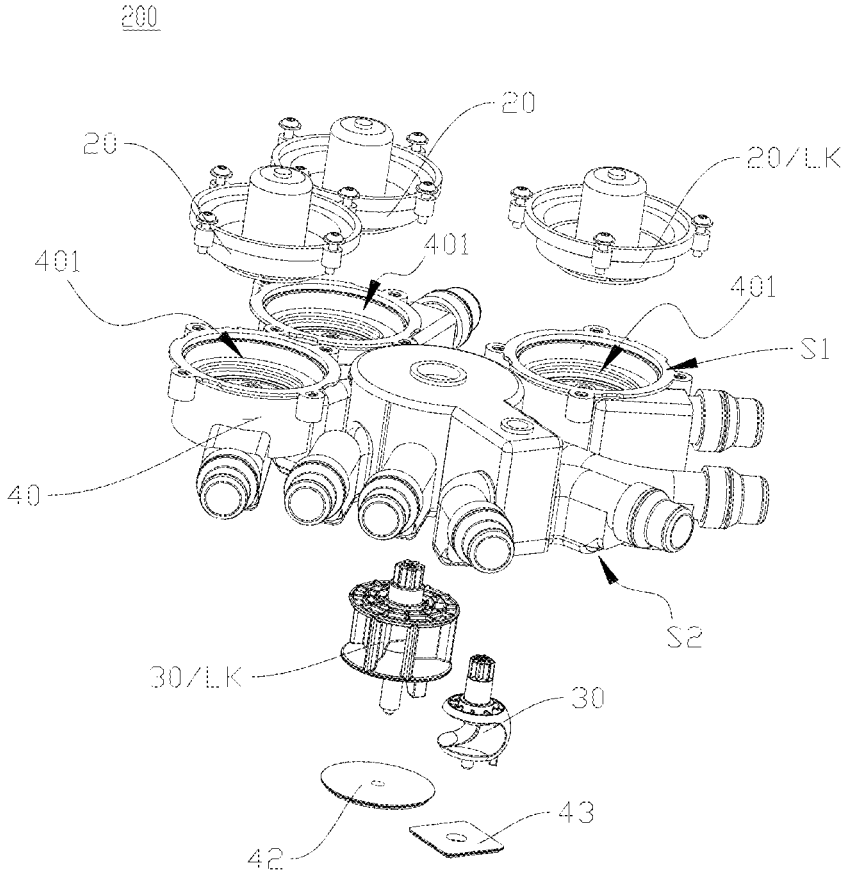
FIG. 10 is a schematic exploded structural view of a fluid assembly provided according to an embodiment of the present application.
Figure 11:
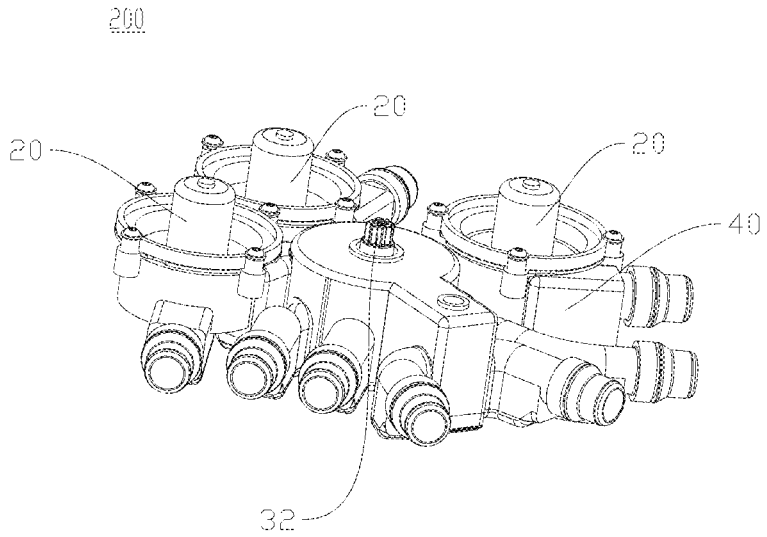
FIG. 11 is a schematic perspective structural view of the fluid assembly shown in FIG. 10.

As shown in FIGS. 8 and 9, in order to realize a function of the drive assembly, the drive assembly provided according to the embodiment of the present application further includes a control member 15. The control member 15 may be a circuit board. The drive component including the stator assembly 130 is defined as the first drive component. In other embodiments, the first drive component further includes a pump housing 135, a transition terminal 134 connected to the pump housing 135, and a connecting plate 136. The stator assembly 130 is separately arranged from the first housing 11. The stator assembly 130 may be injection-molded with the pump housing 135 into an integrated structure, or fitted in a chamber defined by the pump housing 135, so that both the stator assembly 130 and the pump housing 135 are assembled into the mounting cavity QS formed by the position-limiting portion 112. At least part of the stator assembly 130 and the connecting plate 136 are located in the chamber of the pump housing 135, and the pump housing 135 is connected with the first housing 11 in a sealed manner. For example, in FIG. 8, the pump housing 135 may be connected with the first housing 11 in the sealed manner through a sealing ring, or the pump housing 135 and the position-limiting portion 112 of the first housing 11 are injection-molded into an integrated structure. The stator assembly 130 includes a coil winding 1303, which is electrically connected to a pin in the transition terminal 134 through a conductive member in the connecting plate 136. Part of the transition terminal 134 passes through the bottom wall portion 111 and is located in the first accommodating cavity 101, and the transition terminal 134 is electrically connected to the control member 15. It should be noted that the drive component herein includes the stator assembly 130 or the motor 132, and the drive component may further include a lead wire structure or a terminal structure, which enables the control member 15 to be electrically connected to the stator assembly 130 or the motor 132.

In order to realize the electrical connection between the stator assembly 130 and the control member 15, a metal conductive structure may be provided in the first housing 11, and the metal conductive structure may be injection-molded with the first housing 11 into an integrated structure, so that the metal conductive structure is pre-embedded in the first housing 11. Insulation displacement connectors (IDC) may be used for an output terminal 1304 of the stator assembly 130 which may be electrically connected to the control member 15 through a pin of IDC.

In this embodiment, the drive assembly 100 according to the embodiment of the present application includes three stator assemblies 130. Correspondingly, the stator assembly 130 includes an insulating frame 1301, a stator core 1302 and a coil winding 1303. Part of the stator core 1302 is embedded in the insulating frame 1301, and the coil winding 1303 is wound around the insulating frame 1301. When the coil winding 1303 is energized, a magnetic field may be generated. The rotor assembly 22 in the pump assembly 20 is configured to be located in the magnetic field of the corresponding stator assembly 130, thus enabling the stator assembly to drive the rotor assembly 22 to rotate. Through the above arrangement, the stator assembly 130 may be integrated into the drive assembly 100.

Figure 23:
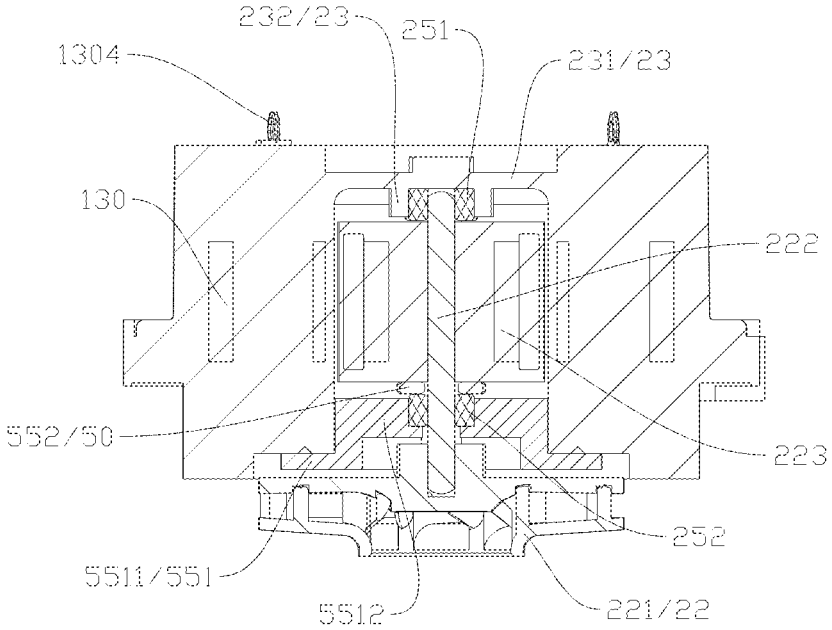
FIG. 23 is a partial schematic sectional structural view of a fourth assembled structure of a drive assembly and a fluid assembly of the present application.
Figure 24:
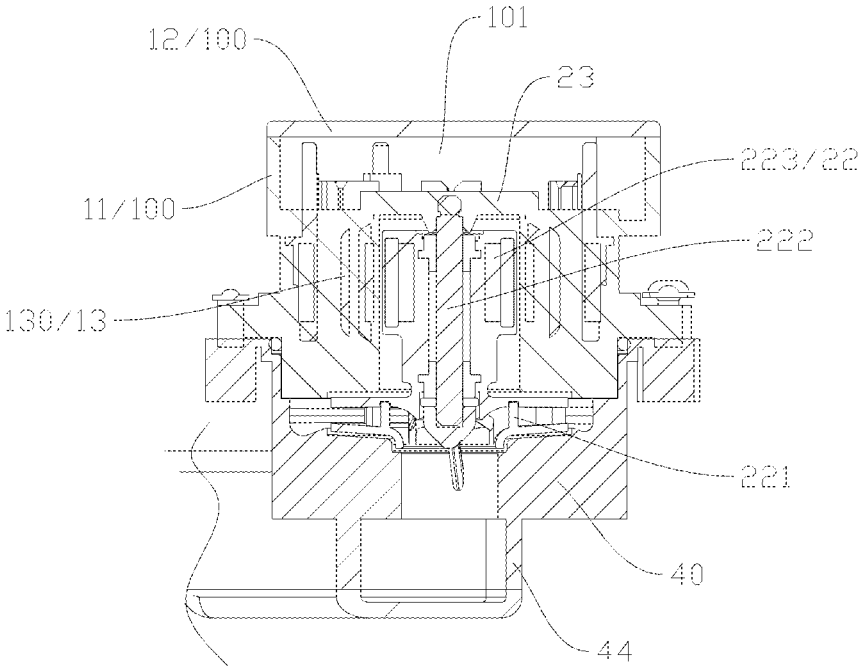
FIG. 24 is a partial schematic sectional structural view of a fifth assembled structure of a drive assembly and a fluid assembly of the present application.

In some embodiments, as shown in FIG. 24, the fluid control apparatus may further include an isolation sleeve 23, part of which is located at an inner circumferential side of the stator assembly 130. Optionally, the isolation sleeve 23 may be injection-molded with the first housing 11 into an integrated structure. For example, the isolation sleeve 23 may be injection-molded with the position-limiting portion 112 into an integrated structure. In this case, the stator assembly 130 may be injection-molded with the position-limiting portion 112 into an integrated structure, or the stator assembly 130 may be located in the mounting cavity QS of the position-limiting portion 112. Optionally, as shown in FIGS. 19 to 24, the isolation sleeve 23 and the stator assembly 130 are injection-molded into an integrated structure, or at least part of the stator assembly 130 is located in a cavity formed by the isolation sleeve 23. The isolation sleeve 23 and the stator assembly 130, as a whole, are separately formed from the first housing 11 and are connected to the first housing 11 in the sealed manner. A sealing ring is arranged between the first housing 11 and the integrated structure formed by the isolation sleeve 23 and the stator assembly 130, and a sealing arrangement between the integrated structure and the first housing 11 is realized by clamping the sealing ring. Through the above arrangement, the position-limiting arrangement and sealing connection between the first housing 11 and the isolation sleeve 23 may be realized.

In specific implementation, when the stator assembly 130 and the position-limiting portion 112 are injection-molded into an integrated structure, the isolation sleeve 23 may be injection-molded with the first housing 11 into an integrated structure; or the isolation sleeve 23 and the first housing 11 may be separately formed and connected with each other in the sealed manner. When the stator assembly 130 is assembled into the mounting cavity QS of the position-limiting portion 112, the isolation sleeve 23 and the first housing 11 may be injection-molded into an integrated structure; or the isolation sleeve 23 and the first housing 11 may be separately formed and connected with each other in the sealed manner; or the isolation sleeve 23 and the stator assembly 130 may be injection-molded into an integrated structure, and the isolation sleeve 23 and the stator assembly 130, as a whole, are separately formed from the first housing 11 and are connected to the first housing 11 in the sealed manner. When the number of the stator assemblies 130 is at least two, different stator assemblies 130 may be connected to the first housing 11 in same or different position-limiting manners, and also the isolation sleeves 23 corresponding to the different stator assemblies 130 may be connected to the first housing 11 in same or different manners.

With regard to the fluid assembly 200, reference is further made to FIGS. 10 to 15. In some embodiments, the fluid assembly 200 further includes a main housing 40 with a chamber in which at least part of the corresponding fluid subassembly LK is located. For example, the fluid subassembly LK includes at least two pump assemblies 20, and the pump assemblies 20 include rotor assemblies 22. Part of one rotor assembly 22 may be engaged with the corresponding stator assembly 130, so that the stator assembly 130, when it is energized, may drive the rotor assembly 22 to rotate. Alternatively, the stator assembly 130 and the rotor assembly 22 may also be in a disk-shaped structure. One of the pump assemblies is defined as a first pump assembly 20*a*, and another pump assembly is defined as a second pump assembly 20*b*. The first pump assembly 20*a* includes a first rotor assembly 22*a*, and the second pump assembly 20*b* includes a second rotor assembly 22*b*. The first rotor assembly 22*a* may be located in the magnetic field range of the first stator assembly 130*a*, and the second rotor assembly 22*b* may be located in the magnetic field range of the second stator assembly 130*b*. In specific implementation, the number of the pump assemblies may be determined based on the needs of the users, for example, it may be two, three, four or more. In this embodiment, the three fluid subassemblies LK includes three pump assemblies 20, which are the first pump assembly 20*a*, the second pump assembly 20*b* and the third pump assembly 20*c* respectively, and there are gaps between the three pump assemblies. Through the above arrangement, it is easy to realize the integration of the at least two pump assemblies 20 and reduce the pipeline connection between the pump assemblies 20.

Alternatively, in order to facilitate the realization of various operating modes of the fluid control apparatus, in some embodiments, at least one of the fluid subassemblies LK includes a pump assembly 20, and at least one of the fluid subassemblies LK includes a valve assembly 30, which includes a valve core 31 and a valve core shaft 32. The valve core 31 and the valve core shaft 32 may be injection-molded into an integrated structure, or connected with each other through interference fit or a connecting key. The valve core 31 is in transmission connection with the output shaft of the motor 132 via the valve core shaft 32, and the valve core 31 can be rotated and translated by the motor 132. In this embodiment, the valve core 31 may be driven to rotate, thus facilitating the realization of various operating modes of the fluid control apparatus 1. Herein, the transmission connection between two components means that the driving force may be transmitted between the two components, including a direct transmission connection and an indirect transmission connection between the two components. Specifically, the valve core shaft 32 of the valve assembly 30 may be in the direct transmission connection with the motor 132, or the drive assembly 100 may further include a gear assembly 133 through which the motor 132 may be in transmission connection with the valve core shaft 32 of the valve core 31. In specific implementation, the number of the valve assemblies 30 may be determined based on the needs of the users. For example, in FIG. 1, two of the fluid subassemblies LK in this embodiment include valve assemblies 30, and correspondingly, the drive assembly 100 includes two motors 132, so that the motors 132 may drive the corresponding valve assemblies 30.

Further, as shown in FIGS. 3 to 16, in some embodiments, the pump assembly 20 includes the rotor assembly 22, and the isolation sleeve 23 of the fluid control apparatus is arranged outside an outer circumferential side of the rotor assembly 22. The stator assembly 130 and the corresponding rotor assembly 22 may be isolated from each other by arranging the isolation sleeve 23, and the working fluid can be prevented from entering a space where the stator assembly 130 is located.

In order to realize the circulation of fluid in the fluid control apparatus 1, in some embodiments, at least part of the main housing 40 is located at a side of the first housing 11 away from the first accommodating cavity 101. As shown in FIG. 1, at least part of the main housing 40 is located at a side of the first housing 11 away from the second housing 12. The main housing 40 further includes connecting pipes 41, which may be arranged in a circumferential direction of the main housing 40 or integrated on at least one mounting surface. As shown in FIGS. 11 to 17, in order to realize the circulation of fluid in the pump assembly 20, the main housing 40 has a first chamber 401, a first orifice 404 and a second orifice 405. The first and second orifices 404, 405 communicate with the first chamber 401, and at least part of the pump assembly 20 is located in the first chamber 401. Rotation of the rotor assembly 22 can drive the fluid to pass through the first orifice 404 and the second orifice 405. Optionally, the rotor assembly 22 includes an impeller assembly 221 and a magnetic assembly 223, and the pump assembly 20 further includes a positioning shaft 222. The impeller assembly 221 is arranged outside the outer circumferential side of the positioning shaft 222. At least part of the impeller assembly 221 may be located in the first chamber 401. At least part of the first orifice 404, and the impeller assembly 221 extend along the height direction of the pump assembly 20. The second orifice 405 is arranged to correspond to the position of the impeller assembly 221. Optionally, at least part of the wall portion of the first orifice 404 may be arranged coaxially with a rotating shaft of the impeller assembly 221, and an opening of the second orifice 405 is located at an edge of the impeller assembly 221 in the circumferential direction, so that the fluid can enter the impeller assembly 221 through the first orifice 404 and be discharged through the second orifice 405 under a centrifugal force of the impeller assembly 221. In this case, the first orifice 404 may be an inlet orifice of the pump assembly 20, and the second orifice 405 may be an outlet orifice of the pump assembly 20.

When at least one fluid subassembly LK further includes the valve assembly 30, the main housing 40 further includes a second chamber 402, which is spaced apart from the first chamber 401. At least part of the pump assembly 20 is arranged in the first chamber 401 in a sealed manner, and at least part of the valve core 31 is located in the second chamber 402. Optionally, a sealing member may be arranged between at least part of the pump assembly 20 and the main housing 40. Alternatively, part of the structure of the pump assembly 20 may be welded with the main housing 40 to realize the sealing arrangement therebetween. Similarly, a sealing member may be arranged between the valve core 31 and the main housing 40, or multiple split components of the main housing 40 may be welded such as to arrange the valve core 31 in the second chamber 402 in the sealed manner. Through the above arrangement, at least one pump assembly 20 and at least one valve core 31 may be integrated into the same main housing 40, thus facilitating reduction of the space occupied by the fluid assembly 200 and thus reduction of the space occupied by the fluid control apparatus 1.

As shown in FIGS. 12 to 19, in order to realize the fluid circulation between the pump assembly 20 and the valve assembly 30, in some embodiments, the main housing 40 further has a communication channel 407 and multiple flow channels 406. The main housing 40 has a flow channel plate 44 and a cavity shell 45, which are injection-molded into an integrated structure. The first chamber 401, the second chamber 402 and the flow channel 406 are located in the cavity shell 45, and the communication channel 407 is located in the flow channel plate 44. At least part of the flow channel plate 44 is connected between the two fluid subassemblies LK. For example, the flow channel plate 44 may be connected between the pump assembly 20 and the valve assembly 30, or the flow channel plate 44 may be connected between the two valve assemblies 30. In the embodiment of the present application, by integrating the flow channel plate 44 with the cavity shells 45, it is convenient to reduce the pipeline connection between the cavity shells 45 and improve the integration level of the fluid control apparatus. Further, the multiple flow channels 406 are distributed at the outer circumferential side of the second chamber 402. One of the flow channels 406 communicates with one of the first orifice 404 and the second orifice 405 through the communication channel 407. The valve core 30 includes a communication cavity 31, which enables at least two flow channels 406 to communicate. The extending directions of the communication channel 407, the flow channel 406 and the first or second orifice 404, 405, which are communicated with each other, intersect with each other.

In some embodiments, with further reference to FIGS. 1 to 19, the pump assembly 20 includes a first pump assembly 20*a*, a second pump assembly 20*b* and a third pump assembly 20*c*. The valve assembly 30 includes a first valve assembly 30*a* and a second valve assembly 30*b*. The first valve assembly 30*a* includes a first valve core 31*a* and a first sealing member (not shown), and the second valve assembly 30*b* includes a second valve core 31*b* and a second sealing member (not shown). The first pump assembly 20*a*, the second pump assembly 20*b*, the third pump assembly 20*c* and the second valve assembly 30*b* are distributed at the outer circumferential side of the first valve assembly 30*a*. The flow channel 406 located at the outer circumferential side of the first valve assembly 30*a* is defined as the first flow channel 4061, which is located on the wall portion of the chamber where the first valve assembly 30*a* is located. The number of the first flow channels 4061 may be at least eight, for example, eight. The flow channel located at the outer circumferential side of the second valve assembly 30*b* is defined as the second flow channel 4062, which is located on the wall portion of the chamber where the second valve assembly 30*b* is located. The number of the second flow channels 4062 may be at least three, for example, three. One of the first flow channels 4061 communicates with one of the second flow channels 4062, and the first valve core 31*a* includes at least four communication cavities 311. Each communication cavity 311 of the first valve core 31*a* may allow two of the first flow channels 4061 to communicate. Each communication cavity of the second valve core 31*b* may communicate two or three of the second flow channels 4062. By rotating the first valve core 31*a*, communication and switching of at least two first flow channels 4061 may be realized. By rotating the second valve core 31*b*, communication, switching and flow adjustment between the second flow channels 4062 may be realized.

Based on this, the communication channel 407 of the main housing 40 may include a first communication channel 407*a*, a second communication channel 407*b* and a third communication channel 407*c*. The first chamber 401 includes a first sub-cavity A1, a second sub-cavity A2 and a third sub-cavity A3, and the second chamber 402 includes a fourth sub-cavity A4 and a fifth sub-cavity A5. At least part of the first pump assembly 20*a* is located in the first sub-cavity A1; at least part of the second pump assembly 20*b* is located in the second sub-cavity A2; and at least part of the third pump assembly 20*c* is located in the third sub-cavity A3. At least part of the first valve assembly 30*a* is located in the fourth sub-cavity A4, and at least part of the second valve assembly 30*b* is located in the fifth sub-cavity A5. The first to third sub-cavities A1, A2 and A3 all communicate with the fourth sub-cavity A4, and the fifth sub-cavity A5 communicates with the fourth sub-cavity A4. The first orifice 404 includes a first sub-orifice 404*a*, a second sub-orifice 404*b* and a third sub-orifice 404*c*, and the second orifice 405 includes a fourth sub-orifice 405*a*, a fifth sub-orifice 405*b* and a sixth sub-orifice 405*c*. Both the first sub-orifice 404*a* and the fourth sub-orifice 405*a* communicate with the first sub-cavity A1; both the second sub-orifice 404*b* and the fifth sub-orifice 405*b* communicate with the second sub-cavity A2; and both the third sub-orifice 404*c* and the sixth sub-orifice 405*c* communicate with the third sub-cavity A3. The first communication channel 407*a* communicates the first sub-cavity A1 with the fourth sub-cavity A4. The first communication channel 407*a* may communicate the first sub-orifice 404*a* with a first flow channel 4061 located at the outer circumferential side of the first valve core 31*a*, and the fourth sub-orifice 405*a* may communicate with the inner cavity of the connecting pipe 41. The second communication channel 407*b* communicates the second sub-cavity A2 with the fourth sub-cavity A4. The second communication channel 407*b* may communicate the second sub-orifice 404*b* with another first flow channel 4061 located at the outer circumferential side of the first valve core 31*a*, and the fifth sub-orifice 405*b* may communicate with the inner cavity of the connecting pipe 41. The third communication channel 407*c* communicates the third sub-cavity A3 with the fourth sub-cavity A4. The third communication channel 407*c* may communicate the sixth sub-orifice 405*c* with another first flow channel 4061 located on the outer circumferential side of the first valve core 31*a*, and the third sub-orifice 404*c* may communicate with the inner cavity of the connecting pipe 41.

Figure 15:
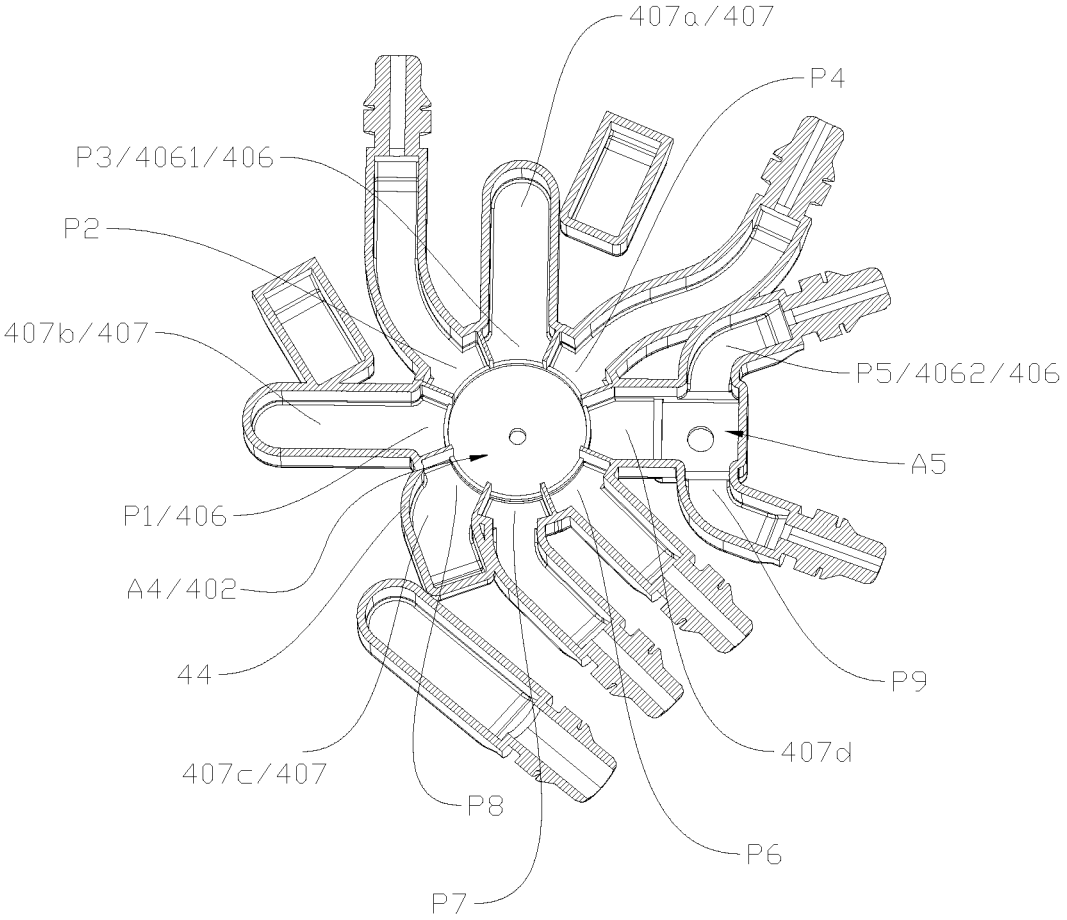
FIG. 15 is a schematic sectional structural view of the main housing shown in FIG. 14.
Figure 16:
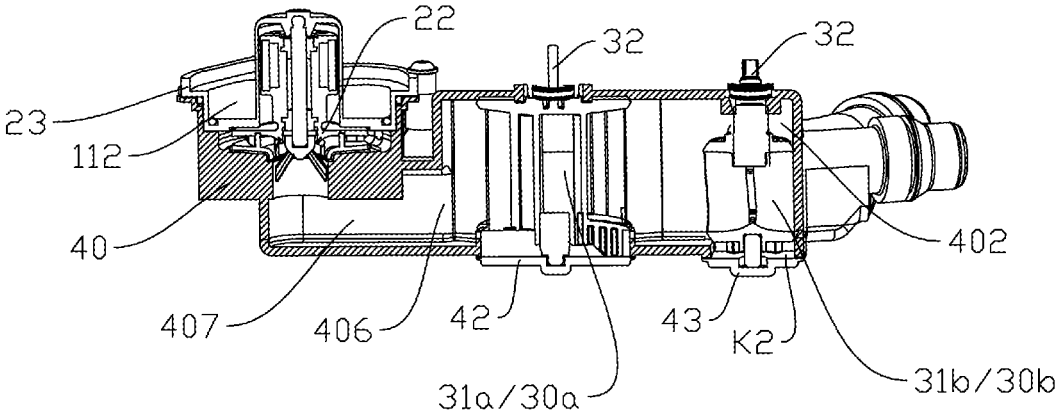
FIG. 16 is a schematic sectional structural view of the fluid assembly shown in FIG. 13.
Figure 17:
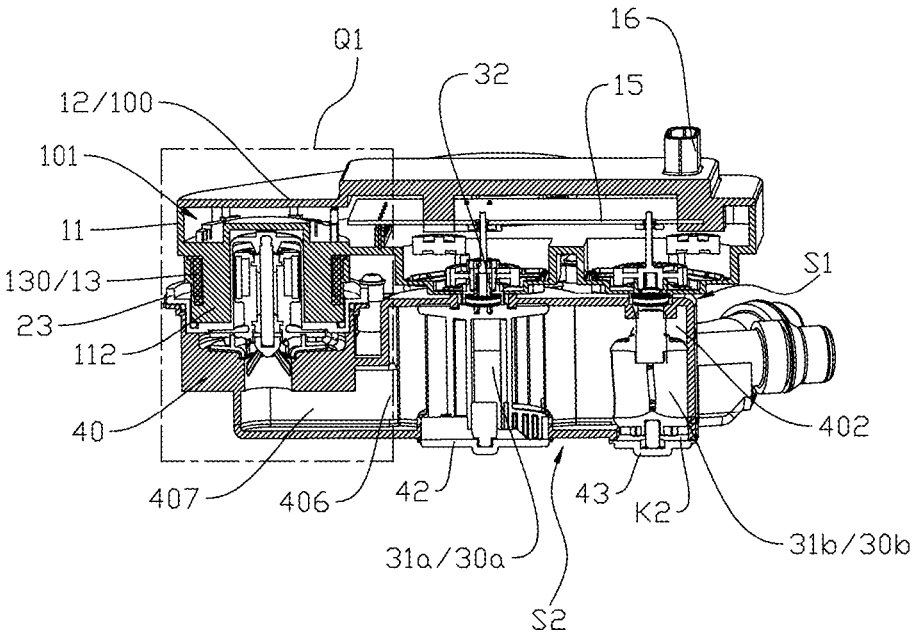
FIG. 17 is a partial schematic sectional structural view of a fluid control apparatus provided according to a first embodiment of the present application.
Figure 18:
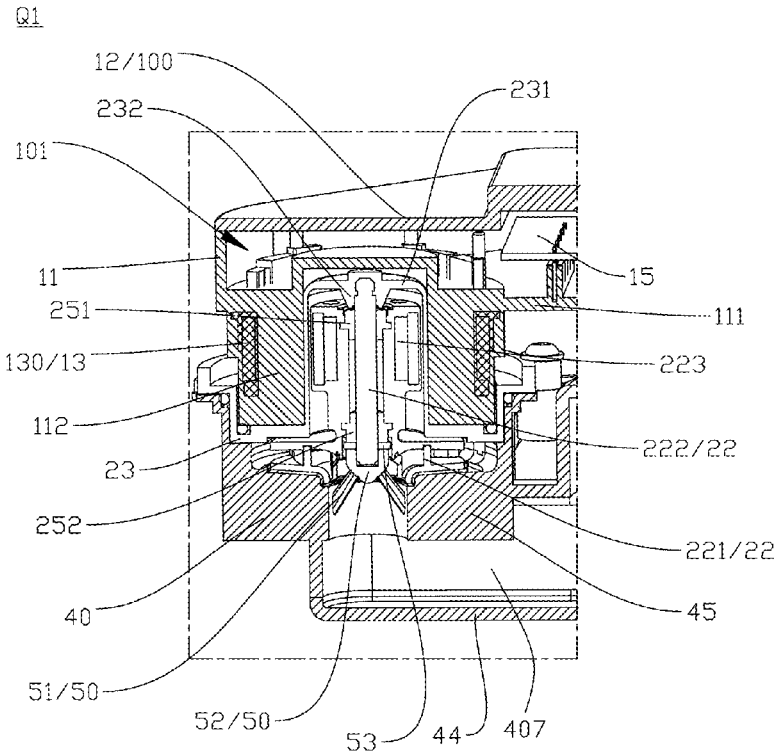
FIG. 18 is an enlarged schematic structural view of the part Q1 in FIG. 17.
Figure 19:
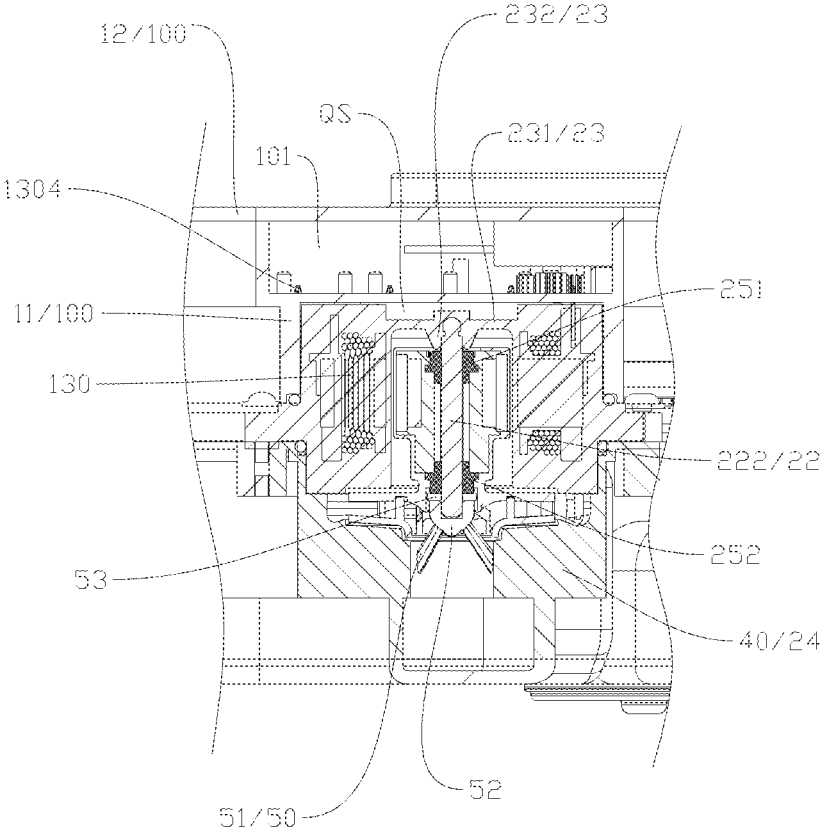
FIG. 19 is a partial schematic sectional structural view of a first assembled structure of a drive assembly and a fluid assembly of the present application.
Figure 20:
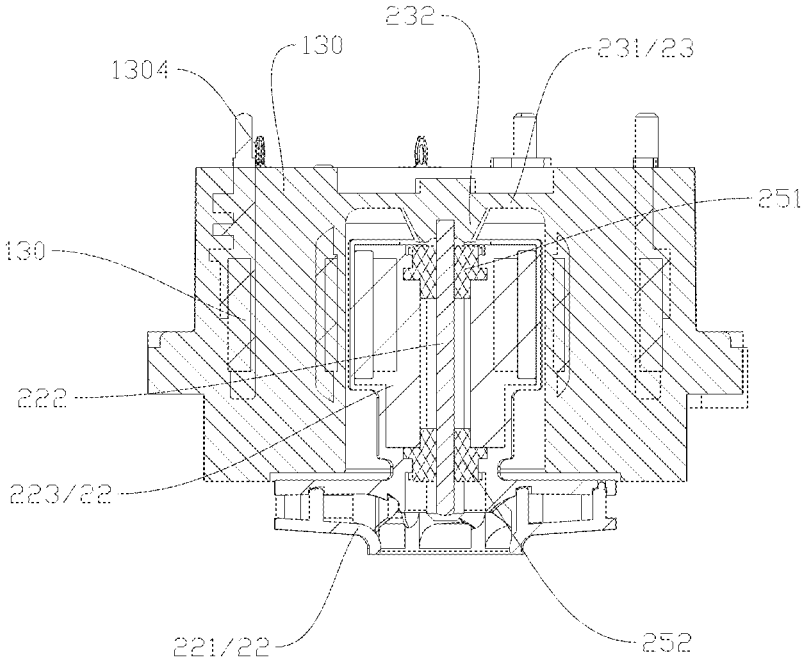
FIG. 20 is a partial enlarged schematic structural view of the assembled structure of the drive assembly and the fluid assembly shown in FIG. 19.
Figure 21:
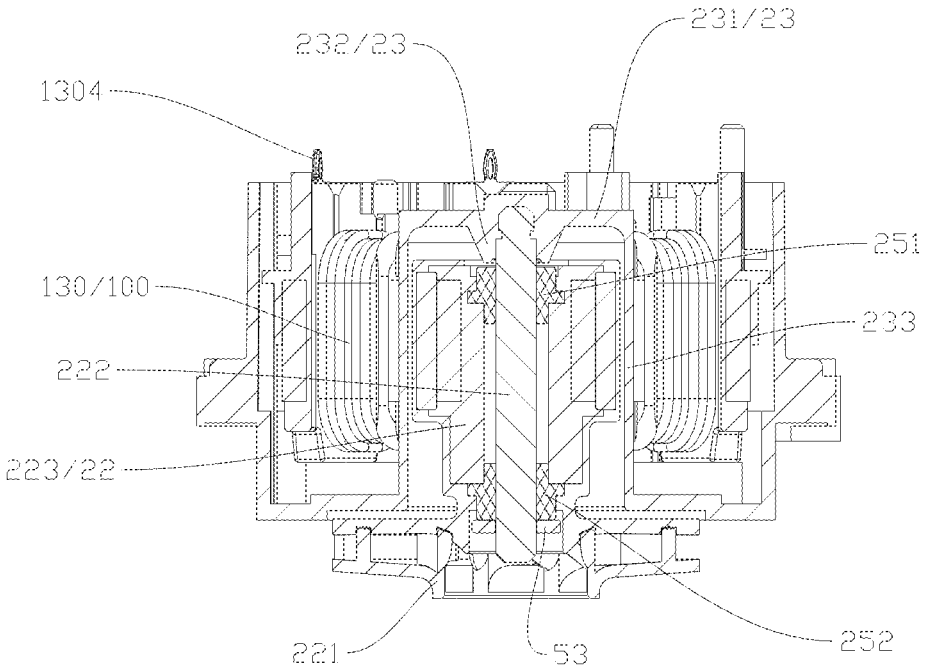
FIG. 21 is a partial schematic sectional structural view of a second assembled structure of a drive assembly and a fluid assembly of the present application.

Further, the main housing 40 further includes a fourth communication channel 407*d* which communicates the fifth sub-cavity A5 with the fourth sub-cavity A4. The first communication channel 407*a*, the second communication channel 407*b*, the third communication channel 407*c* and the fourth communication channel 407*d* are arranged at the outer circumferential surface of the wall portion of the fourth sub-cavity A4. As shown in FIG. 15, in some embodiments, at least part of the first communication channel 407*a*, at least part of the second communication channel 407*b*, at least part of the third communication channel 407*c* and at least part of the fourth communication channel 407*d* are arranged at intervals along the circumferential direction of the wall portion of the fourth sub-cavity A4. In some other embodiments, the communication channels described above may also be arranged in other forms, for example, at least part of the communication channels are arranged along the height direction of the fluid control apparatus. Through the above arrangement, the pump assembly 20 and the valve assembly 30 may work together to realize various operating modes of the fluid control apparatus. When the fluid control apparatus is applied to the thermal management system, the various operation states of the thermal management system may be realized, thus facilitating realization of the function such as cooling or temperature drop of different heat sources.

The fluid control apparatus provided according to the embodiment of the present application will be described below.

With reference to FIGS. 1 to 26 together, in some embodiments, at least two of the drive components 13 each include a stator assembly 130, and at least two of the fluid subassemblies LK each include a pump assembly 20. One of the pump assemblies is defined as a first pump assembly 20*a* and another one is defined as a second pump assembly 20*b*. One of the stator assemblies is defined as a first stator assembly 130*a* and another one is defined as a second stator assembly 130*b*. The position-limiting portion 112 includes a first position-limiting portion 112*a* and a second position-limiting portion 112*b*. At least part of the first stator assembly 130*a* is connected to the first position-limiting portion 112*a* in a position-limiting manner, and at least part of the second stator assembly 130*b* is connected to the second position-limiting portion 112*b* in a position-limiting manner. The first pump assembly 20*a* includes a first rotor assembly 22*a*, and the second pump assembly 20*b* includes a second rotor assembly 22*b*. The first rotor assembly 22*a* may be located in the magnetic field range of the first stator assembly 130*a*, and the second rotor assembly 22*b* may be located in the magnetic field range of the second stator assembly 130*a*. Optionally, part of the first rotor assembly 22*a* is located at an inner side of the first stator assembly 130*a*, and part of the second rotor assembly 22*b* is located at an inner side of the second stator assembly 130*b*. Through the above arrangement, at least two of the stator assemblies 130 may be integrated into a same drive assembly 100, which can improve the integration level of the drive assembly 100, compared with the arrangement where the two stator assemblies 130 are separately arranged in different drive assemblies.

As shown in FIGS. 1 to 9, in this embodiment, the three drive components 13 include three stator assemblies 130, which are respectively defined as a first stator assembly 130*a*, a second stator assembly 130*b* and a third stator assembly 130*c*. Correspondingly, the first housing 11 includes a first position-limiting portion 112*a*, a second position-limiting portion 112*b* and a third position-limiting portion 112*c*. The number of fluid subassemblies LK including the pump assemblies 20 may be two, three, four or more. In this embodiment, the fluid subassemblies LK include three pump assemblies 20, which are defined as a first pump assembly 20*a*, a second pump assembly 20*b* and a third pump assembly 20*c* respectively. Part of the third rotor assembly 22*c* is located at an inner side of the third stator assembly 130*c*. The third rotor assembly 22*c* can be located in the magnetic field range of the third stator assembly 130*c*. Optionally, the first stator assembly 130*a* may be injection-molded with the first position-limiting portion 112*a* into an integrated structure; the second stator assembly 130*b* may be injection-molded with the second position-limiting portion 112*b* into an integrated structure; the third stator assembly 130*c* may be injection-molded with the third position-limiting portion 112*c* into an integrated structure; and the position-limiting portion 112 is injection-molded with the bottom wall portion 111 into an integrated structure.

In some embodiments, at least one of the fluid subassemblies LK includes a pump assembly 20, and at least one of the fluid subassemblies LK includes a valve assembly 30. At least one of the drive components 13 includes a stator assembly 130, and at least another one of the drive components 13 includes a motor 132. The first housing 11 further includes a mounting portion 114 (shown in FIG. 6), which is spaced apart from the position-limiting portion 112. The motor 132 is connected to the mounting portion 114 in a position-limiting manner, and partially located in the first accommodating cavity 101. Through the above arrangement, it is easy to integrate at least one stator assembly 130 and at least one motor 132 into a same drive assembly 100. The valve assembly 30 includes a valve core 31 and a valve core shaft 32. The valve core 31 and the valve core shaft 32 may be injection-molded into an integrated structure, or connected with each other through interference fit or by a connecting key. The valve core 31 is in transmission connection with the output shaft of the motor 132 through the valve core shaft 32, and may be rotated or translated by the motor 132. In this embodiment, the valve core 31 may be driven to rotate, thus facilitating the realization of various operating modes of the fluid control apparatus 1. The valve core shaft 32 of the valve assembly 30 may be directly and drivingly connected with the motor 132. Alternatively, the drive assembly 100 may further include a gear assembly 133, and the motor 132 may be drivingly connected to the valve core shaft 32 of the valve core 31 via the gear assembly 133. Through the above arrangement, at least one stator assembly 130 and at least one motor 132 may be integrated into the same drive assembly 100, which is convenient to reduce the space occupied by the drive assembly 100. In specific implementation, the number of the valve assemblies 30 and the number of the motors 132 may be determined based on the needs of users. For example, in FIG. 1, two of the fluid subassemblies LK in this embodiment include valve assemblies 30, and correspondingly, the drive assembly 100 includes two motors 132, so that the motors 132 drive the corresponding valve assemblies 30.

With further reference to FIGS. 1 to 26, the drive assembly 100 may include five drive components 13. Three of the drive components 13 respectively include three stator assembly 130, which are defined as a first stator assembly 130*a*, a second stator assembly 130*b* and a third stator assembly 130*c*, respectively. The other two of the drive components 13 each include a transmission assembly consisting of the motor 132 and the gear assembly 133. One of the transmission assemblies includes a first motor 132*a* and a first gear assembly 133*a*, and the other of the transmission assemblies includes a second motor 132*b* and a second gear assembly 133*b*. Accordingly, the fluid assembly 200 includes five fluid subassemblies LK. Three of the fluid subassemblies LK respectively include three pump assemblies 20, which are defined as a first pump assembly 20*a*, a second pump assembly 20*b* and a third pump assembly 20*c*. The other two of the fluid subassemblies LK each include a valve assembly 30. One of the valve assemblies includes a first valve core 31*a* and the other one includes a second valve core 31*b*. The first stator assembly 130*a* may drive the rotor assembly in the first pump assembly 20*a* to rotate; the second stator assembly 130*b* may drive the rotor assembly in the second pump assembly 20*b* to rotate; and the third stator assembly 130*c* may drive the rotor assembly in the third pump assembly 20*c* to rotate. The first transmission assembly formed of the first motor 132*a* and the first gear assembly 133*a* may drive the first valve core 31*a* to rotate, and the second transmission assembly formed of the second motor 132*b* and the second gear assembly 133*b* may drive the second valve core 31*b* to rotate. Optionally, in the height direction of the fluid control apparatus 1, the sides of the first pump assembly 20*a*, the second pump assembly 20*b* and the third pump assembly 20*c* facing away from the main housing 40 are located at the same height, that is, the ends of the three pump assemblies adjacent to the drive assembly 100 may be located at the same height, which is easy to be assembled with the three stator assemblies in the drive assembly 100. Optionally, the sides of the three stator assemblies corresponding to the three pump assemblies facing away from the main housing 40 may also be located at the same height, which is easy to be assembled and electrically connected with the control member. Part of the valve assembly 30 and part of the pump assembly 20 are located at the same height. Through the above arrangement, it is conducive to reduce the height of the fluid control apparatus, and integrate the control members of the valve assembly 30 and the pump assembly 20 with the first housing, and it facilitates electrical connection with the same control member.

The operating modes of the fluid control apparatus shown in FIGS. 1 to 26 will be described below. Seven of the first flow channels 4061 are defined as a first flow sub-channel P1, a second flow sub-channel P2, a third flow sub-channel P3, a fourth flow sub-channel P4, a sixth flow sub-channel P6, a seventh flow sub-channel P7 and an eighth flow sub-channel P8, respectively. Two of the second flow channels 4062 are defined as a fifth flow sub-channel P5 and a ninth flow sub-channel P9. The communication cavity of the first valve core 31*a* is defined as the first communication cavity, and the communication cavity of the second valve core 31*b* is defined as a second communication cavity. The fluid control apparatus provided according to the embodiment of the present application has at least one of the following operating modes.

In a first operating mode, the first valve core 31*a* rotates to a first position, where the first flow sub-channel P1 is communicated with the second flow sub-channel P2 through one of the first communication cavities; the third flow sub-channel P3 is communicated with the fourth flow sub-channel P4 through another first communication cavity; the sixth flow sub-channel P6 is communicated with the seventh flow sub-channel P7 through yet another first communication cavity; and at least one of the fifth flow sub-channel P5 and the ninth flow sub-channel P9 is communicated with the eighth flow sub-channel P8 through still another first communication cavity, the fourth communication channel 407*d* and the second communication cavity.

In a second operating mode, the first valve core 31*a* rotates to a second position, where the third flow sub-channel P3 is communicated with the second flow sub-channel P2 through one of the first communication cavities; at least one of the fifth flow sub-channel P5 and the ninth flow sub-channel P9 is communicated with the fourth flow sub-channel P4 through another first communication cavity, the fourth communication channel 407*d* and the second communication cavity; the seventh flow sub-channel P7 is communicated with the eighth flow sub-channel P8 through yet another first communication cavity; and the sixth flow sub-channel P6 is communicated with the first flow sub-channel P1 through still another first communication cavity.

In a third operating mode, the first valve core 31*a* rotates to a third position, where the first flow sub-channel P1 is communicated with the eighth flow sub-channel P8 through one of the first communication cavities; the third flow sub-channel P3 is communicated with the fourth flow sub-channel P4 through another first communication cavity; at least one of the fifth flow sub-channel P5 and the ninth flow sub-channel P9 is communicated with the sixth flow sub-channel P6 through yet another first communication cavity, the fourth communication channel 407*d* and the second communication cavity; and the second flow sub-channel P2 is communicated with the seventh flow sub-channel P7 through still another first communication cavity.

In a fourth operating mode, the first valve core 31*a* rotates to a fourth position, where the first flow sub-channel P1 is communicated with the second flow sub-channel P2 through one of the first communication cavities; at least one of the fifth flow sub-channel P5 and the ninth flow sub-channel P9 is communicated with the fourth flow sub-channel P4 through another first communication cavity, the fourth communication channel 407*d* and the second communication cavity; the sixth flow sub-channel P6 is communicated with the seventh flow sub-channel P7 through yet another first communication cavity; and the third flow sub-channel P3 is communicated with the eighth flow sub-channel P8 through still another first communication cavity.

In a fifth operating mode, the first valve core 31*a* rotates to a fifth position, where the third flow sub-channel P3 is communicated with the second flow sub-channel P2 through one of the first communication cavities; the seventh flow sub-channel P7 is communicated with the eighth flow sub-channel P8 through another first communication cavity; at least one of the fifth flow sub-channel P5 and the ninth flow sub-channel P9 is communicated with the sixth flow sub-channel P6 through yet another first communication cavity, the fourth communication channel 407*d* and the second communication cavity; and the first flow sub-channel P1 is communicated with the fourth flow sub-channel P4 through still another first communication cavity.

In a sixth operating mode, the first valve core 31*a* rotates to a sixth position, where the first flow sub-channel P1 is communicated with the eighth flow sub-channel P8 through one of the first communication cavities; the third flow sub-channel P3 is communicated with the fourth flow sub-channel P4 through another first communication cavity; the sixth flow sub-channel P6 is communicated with the seventh flow sub-channel P7 through yet another first communication cavity; and at least one of the fifth flow sub-channel P5 and the ninth flow sub-channel P9 is communicated with the second flow sub-channel P2 through still another first communication cavity, the fourth communication channel 407*d* and the second communication cavity.

In a seventh operating mode, the first valve core 31*a* rotates to a seventh position, where the first flow sub-channel P1 is communicated with the second flow sub-channel P2 through one of the first communication cavities; the seventh flow sub-channel P7 is communicated with the eighth flow sub-channel P8 through another first communication cavity; at least one of the fifth flow sub-channel P5 and the ninth flow sub-channel P9 is communicated with the fourth flow sub-channel P4 through yet another first communication cavity, the fourth communication channel 407*d* and the second communication cavity; and the sixth flow sub-channel P6 is communicated with the third flow sub-channel P3 through still another first communication cavity.

In an eighth operating mode, the first valve core 31*a* rotates to an eighth position, where the first flow sub-channel P1 is communicated with the eighth flow sub-channel P8 through one of the first communication cavities; the second flow sub-channel P2 is communicated with the third flow sub-channel P3 through another first communication cavity; at least one of the fifth flow sub-channel P5 and the ninth flow sub-channel P9 is communicated with the sixth flow sub-channel P6 through yet another first communication cavity, the fourth communication channel 407*d* and the second communication cavity; and the fourth flow sub-channel P4 is communicated with the seventh flow sub-channel P7 through still another first communication cavity.

Optionally, by rotating the second valve core 31*b*, it is also possible to realize the different communication mode between flow channels or realize the proportional adjustment between the channels corresponding to the second valve core 31*b*. It can be understood that, when the fluid control apparatus has more flow channels or ports, the fluid control apparatus may further include three valve cores or more in order to switch the modes of communication between the more flow channels or ports, which is not limited in the present application.

Both the first chamber 401 and the second chamber 402 have openings located on a surface of the main housing 40. In order to facilitate the assembly of the pump assembly 20 and the valve assembly 30, a first mounting port K1 of the first chamber 401 and a second mounting port K2 of the second chamber 402 are respectively located at different sides of the main housing 40. As shown in FIG. 1, the openings of the first chamber 401 and the second chamber 402 are respectively located at two sides opposite to each other in the height direction of the main housing 40. In this case, the main housing 40 includes a cavity shell 45 and a bottom cover. The bottom cover may be connected with the cavity shell 45 in a sealed manner by welding or other processes. For example, the main housing 40 includes a first bottom cover 42 and a second bottom cover 43. Each of the flow channels and chambers may be located in the cavity shell 45, and both the first bottom cover 42 and the second bottom cover 43 may be connected with the cavity shell 45 in a seal manner, for example, by welding, bonding or sealing ring.

In some embodiments, the cavity shell 45 includes a cavity shell side wall and a cavity shell top wall. Part of the cavity shell side wall and the cavity shell top wall form at least part of the wall portion of the first chamber 401. The cavity shell side wall and the cavity shell top wall are in an integrated structure, and the cavity shell top wall and the first mounting port K1 are located at the same side of the main housing 40. Through the above arrangement, it is conducive to reduce the assembly error between the valve assembly 30 and the corresponding drive component 13, and to improve the strength of the cavity shell 45, and to make the corresponding drive components of the valve shell 30 and the pump assembly 20 located at the same side of the main housing 40.

In specific implementation, the main housing 40 includes a first end S1 and a second end S2, which are oppositely arranged in the height direction of the main housing 40. The first mounting port K1 of the first chamber 401 is located at the first end S1, and the second mounting port K2 of the second chamber 402 is located at the second end S2. The drive assembly 100 is located at a side of the first end S1 facing away from the second end S2. Through the above arrangement, the pump assembly 20 may be assembled with the main housing 40 at one side of the main housing 40, and the valve assembly 30 may be assembled with the main housing 40 at the other side of the main housing 40, so that it is easy to dispose the drive component for driving the pump assembly 20 and the drive component for driving the valve assembly 30 at the same side, and to realize the integration of multiple drive components. When the number of the valve assemblies 30 is at least two, all of the valve assemblies 30 may be mounted at the same side of the main housing 40, which is easy to unify the assembly reference, and then all of the pump assemblies 20 may be mounted at the other side of the main housing 40, which is conducive to reduce the assembly error and better realize the coaxiality of at least two valve assemblies 30 and the corresponding drive components 13. It can be understood that the first mounting port K1 of the first chamber 401 and the second mounting port K2 of the second chamber 402 may also be arranged on the same side of the main housing 40, so that both the pump assembly 20 and the valve assembly 30 are assembled at the same side of the main housing 40, which is not limited in the present application.

With further reference to FIGS. 16 to 26, in some embodiments, when each pump assembly 20 further includes an isolation sleeve 23, the isolation sleeve 23 may be connected with the first housing 11 in the sealed manner, for example, injection-molded with the first housing 11 into an integrated structure; or the isolation sleeve 23 may be separately arranged from the first housing 11, but injection-molded with the main housing 40 into an integrated structure. Alternatively, when the isolation sleeve 23 is injection-molded with the first housing 11 into an integrated structure or separately arranged from the first housing 11 and from the main housing 40, one side of the isolation sleeve 23 in a thickness direction may be connected to the main housing 40 in the sealed manner by a sealing ring. The sealing ring may be an O-ring or an X-ring. Through the above arrangement, the isolation sleeve 23 and the main housing 40 may be connected with each other in a position-limiting and sealed manner. In this case, the stator assembly 130 may be injection-molded with the first housing 11 into an integrated structure, or the stator assembly 130 and the first housing 11 may be separately arranged and assembled with each other.

In specific implementation, in order to realize the sealed connection between the isolation sleeve 23 and the first housing 11 as well as between the isolation sleeve 23 and the main housing 40, the fluid control apparatus 1 may optionally include sealing rings. When the isolation sleeve 23 and the first housing 11 are separately formed, one of the sealing rings may be sandwiched between one side of the isolation sleeve 23 in the thickness direction and the first housing 11. When the isolation sleeve 23 is separately formed from the main housing 40, one of the sealing rings may be sandwiched between the other side of the isolation sleeve 23 in the thickness direction and the main housing 40. Therefore, the sealing performance of the fluid control apparatus 1 may be realized, so as to reduce the leakage of fluid and reduce or prevent the fluid from entering the stator assembly, thereby protecting the stator assembly.

Figure 12:
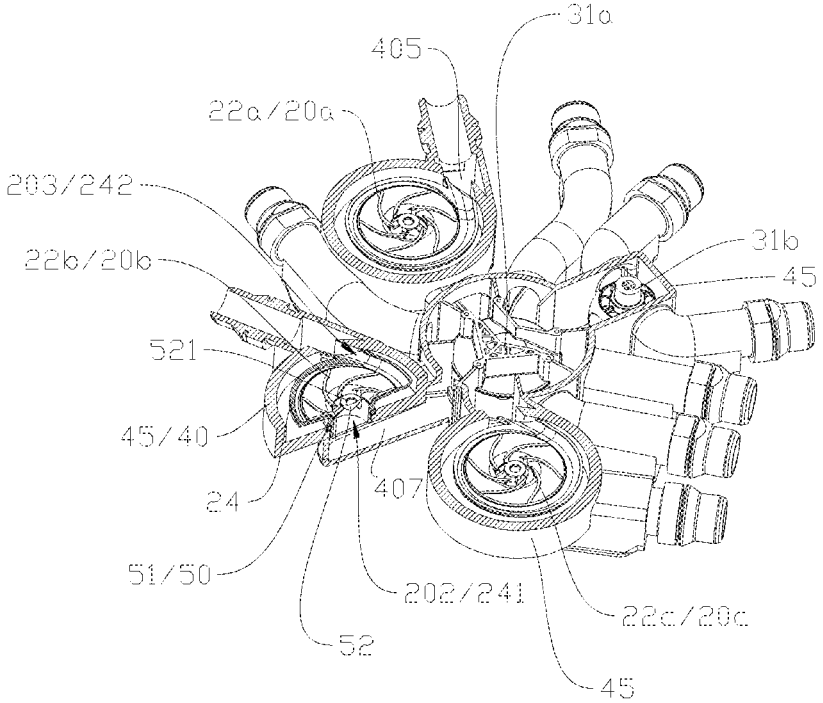
FIG. 12 is a schematic sectional structural view of a first fluid assembly shown in FIG. 11 at one of positions.
Figure 26:
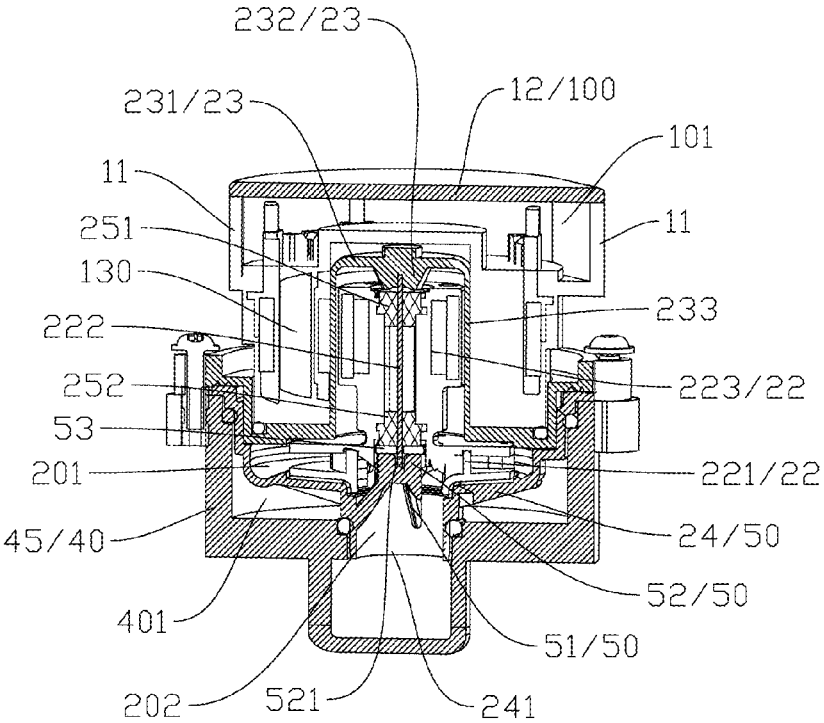
FIG. 26 is a partial schematic sectional structural view of a seventh assembled structure of a drive assembly and a fluid assembly of the present application.

With further reference to FIGS. 12 and 26, in some embodiments, the pump assembly 20 further includes a pump cover 24, which is connected with the isolation sleeve 23 in a sealed manner. The pump cover 24 may be welded with the isolation sleeve 23, and the rotor assembly 22 is located in a space formed between the pump cover 24 and the isolation sleeve 23. The pump cover 24 has a first port 241 and a second port 242, and the rotor assembly 22 may drive fluid to circulate between the first port 241 and the second port 242. At least part of the pump cover 24 is located in the first chamber 401, and the pump cover 24 is hermetically connected with the main housing 40. The first port 241 is communicated with the first orifice 404, and the second port 242 is communicated with the second orifice 405. In specific implementation, the pump assembly 20 has a pump cavity 201, a first channel 202 and a second channel 203, and the pump cover 24 forms at least part of the wall portion of the pump cavity 201. The first channel 202 and the second channel 203 may also be located in the pump cover 24. The first port 241 is located in the first channel and the second port 242 is located in the second channel. At least part of the first channel 202 is located in the first orifice 404, and at least part of the second channel 203 is located in the second orifice 405.

In order to realize the sealed connection between the pump cover 24 and the main housing 40, in some embodiments, a sealing ring may be sandwiched between the pump cover 24 and the main housing 40 as shown in FIG. 26, or the pump cover 24 and the main housing 40 may be injection-molded into an integrated structure. Herein, the integrated structure formed by two structural members may be formed by injection molding process or made by other processes, which is not limited in the present application.

With further reference to FIGS. 1 to 8, in order to control the drive component 1 in the drive assembly 100, in some embodiments, the fluid control apparatus 1 further includes a control member 15 and a connecting terminal 16. The control member includes several electronic components. The electronic components may include resistors, capacitors, inductors or integrated circuits. The control member 15 is located in the first accommodating cavity 101. At least part of the connecting terminal 16 is located outside the first accommodating cavity 101. For example, as shown in FIGS. 1 to 5, the connecting terminal 16 is located at a side of the second housing 12 facing away from the first accommodating cavity 101, and the connecting terminal 16 is integrally injection-molded with the second housing 12. The connecting terminal 16 is electrically connected with the control member 15, and at least two drive components 13 are electrically connected with the control member 15. Through the above arrangement, it is possible to control at least two drive components 13 by using a single control member 15, thus saving space and reducing the cost of the drive assembly 100. And, it is possible to communicate with external electrical equipment by using a single connecting terminal 16, which simplify the operation of the fluid control apparatus 1. In order to facilitate the single control member 15 to control the multiple drive components, in some embodiments, the first stator assembly 130*a*, the second stator assembly 130*b*, the third stator assembly 130*c*, the first motor 132*a* and the second motor 132*b* are all at least partially located in the first accommodating cavity 101, and are all electrically connected to the control member 15. The connecting terminal 16 may be electrically connected with an external wire harness structure, so that the control member 15 may control the motor to rotate, thereby enabling the valve core in the valve assembly to rotate. Further, the control member 15 may also control the on-off of the power supply of the stator assembly. When the control member 15 controls the stator assembly to be energized, the stator assembly generates a magnetic field, so that the rotor assembly rotates under the action of the magnetic field, and the fluid flows in the first channel and the second channel under the centrifugal force of the impeller assembly, thereby driving the fluid to flow in the valve assembly. The valve assembly may change the flowing direction of the fluid and/or regulate the flow rate of the fluid.

Figure 25:
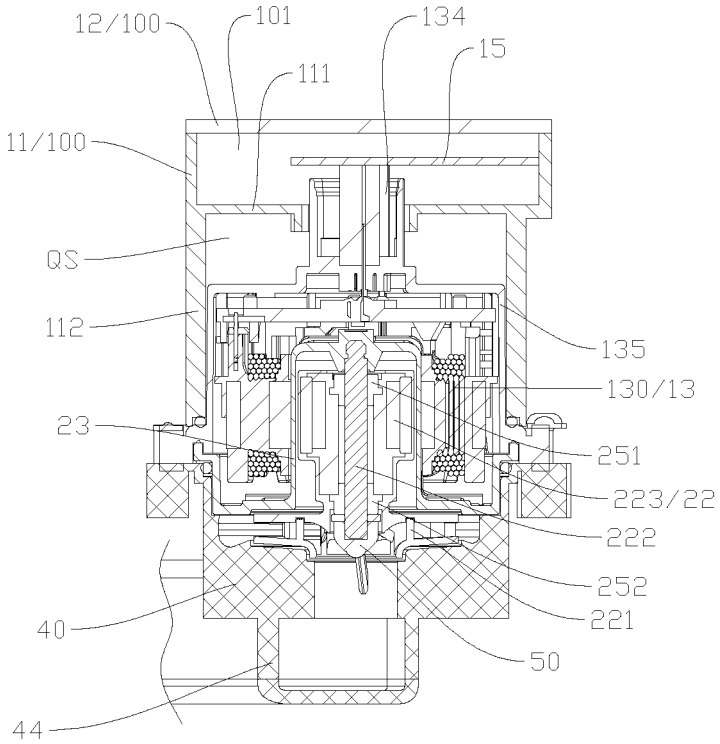
FIG. 25 is a partial schematic sectional structural view of a sixth assembled structure of a drive assembly and a fluid assembly of the present application.

As shown in FIG. 25, the drive component including the stator assembly 130 is defined as the first drive component, which further includes a pump housing 135, a transition terminal 134 connected with the pump housing 135, and a connecting plate 136. The stator assembly 130 is separately arranged from the first housing 11, and at least part of the stator assembly 130 and the connecting plate are located in the chamber of the pump housing 135. The pump housing 135 is connected with the first housing 11 in a sealed manner. For example, the pump housing 135 may be connected with the first housing 11 in a sealed manner by a sealing ring in FIG. 25, or the pump housing 135 and the position-limiting portion 112 of the first housing 11 may be injection-molded into an integrated structure. The stator assembly 130 includes a coil winding 1303, which is electrically connected to a pin in the transition terminal 134 through a conductive member in the connecting plate 136. Part of the transition terminal 134 passes through the bottom wall portion 111 and is located in the first accommodating cavity 101, and the transition terminal 134 is electrically connected to the control member 15. It should be noted that the drive component herein includes a stator assembly 130 or a motor 132, and may further include a lead wire structure or a terminal structure for electrically connecting the stator assembly 130 or the motor 132 to the control member 15.

With further reference to FIGS. 1 to 26, in some embodiments, the fluid control apparatus 1 further includes a position-limiting assembly 50. The position-limiting assembly 50 may be located in the fluid assembly 200. The pump assembly 20 includes a rotor assembly 22, a positioning shaft 222 and an isolation sleeve 23. At least part of the rotor assembly 22 is arranged in or on the stator assembly 130. The isolation sleeve 23 is arranged outside part of the rotor assembly 22, and at least part of the isolation sleeve 23 is located between the stator assembly 130 and the rotor assembly 22. The positioning shaft 222 is disposed inside the rotor assembly 22. A first side of the positioning shaft 222 in the axial direction and the isolation sleeve 23 are arranged in a position-limited manner, and the position-limiting assembly 50 is arranged adjacent to a second side of the positioning shaft 222 in the axial direction. The position-limiting assembly 50 and the rotor assembly 22 are arranged in a position-limited manner, for example, the position-limiting assembly 50 abuts against the rotor assembly 22. In this embodiment, the axial direction of the positioning shaft 222 is parallel to or coincident with the height direction of the fluid control apparatus. Through the above arrangement, both sides of the positioning shaft 222 in the axial direction may be limited, thus decreasing the axial movement of the positioning shaft 222, further decreasing the axial movement of the rotor assembly 22 and reducing the noise of the pump assembly 20.

In some embodiments, the rotor assembly 22 includes a magnetic assembly 223 and an impeller assembly 221. At least part of the impeller assembly 221 and the magnetic assembly 223 are arranged along the axial direction of the rotor assembly 22. At least part of the magnetic assembly 223 is arranged at an inner surface side of the stator assembly 130, so that at least part of the magnetic assembly 222 may be located within the magnetic field range of the stator assembly 130. The isolation sleeve 23 includes an end wall portion 231, a connecting portion 232 and a circumferential wall portion 233. An extending direction of the end wall portion 231 intersects with the axial direction of the rotor assembly 22, and the end wall portion 231 is arranged close to the first housing 11. The circumferential wall portion 233 protrudes from the end wall portion 231, and at least part of the circumferential wall portion 233 is located between the rotor assembly 22 and the stator assembly 130 in the radial direction of the rotor assembly 22. In the axial direction of the rotor assembly 22, at least part of the connecting portion 232 protrudes from the end wall portion 231 towards the rotor assembly 22. One side of the positioning shaft 222 and the connecting portion 232 are arranged in a position-limited manner, and the magnetic assembly 223 is located between the connecting portion 232 and the position-limiting assembly 50.

As shown in FIG. 26, in some embodiments, when the pump assembly 20 further includes a pump cover 24, at least part of the pump cover 24 is located at the outer circumferential side of the impeller assembly 221; at least part of the pump cover 24 is located in the first chamber 401; and at least part of the position-limiting assembly 50 is located on the pump cover 24. The position-limiting assembly 50 has a groove 521, and an end of the second side of the positioning shaft 222 is located in the groove 521 and abuts against the bottom portion of the groove 521. Through the above arrangement, the isolation sleeve 23 cooperates with the pump cover 24 to realize the axial limit of the rotor assembly 22. Optionally, the pump cover 24 may be injection-molded with the main housing 40 into an integrated structure, or the pump cover 24 may be separately formed from the main housing 40 and connected with the main housing 40 in a limited manner, with a sealing ring being arranged between the pump cover 24 and the main housing 40 to seal them.

As shown in FIGS. 18 to 25, when the pump cover 24 and the main housing 40 are injection-molded into an integrated structure, at least part of the impeller assembly 221 is located in the first chamber 401. The main housing 40 includes a first orifice 404 and a second orifice 405 communicating with the first chamber 401. The rotation of the impeller assembly 221 may drive the fluid to circulate between the first orifice 404 and the second orifice 405. The position-limiting assembly 50 includes a supporting portion 52 and at least two connecting ribs 51. The connecting ribs 51 are connected with the peripheral wall of the first orifice 404, distributed on the outer circumferential side of the supporting portion 52, and connected with the supporting portion 52. The groove 521 is located in the supporting portion 52, and one end of the positioning shaft 222 is inserted in the groove 521. Through the above arrangement, fluid communication in the first orifice 404 can be realized, and the axial limit of the positioning shaft 222 can also be realized.

Alternatively, as shown in FIG. 26, when the pump cover 24 is separately formed from the main housing 40, the pump assembly 20 has a pump cavity 201, a first channel 202 and a second channel 203, and the pump cover 24 forms at least part of the wall portion of the pump cavity 201. Both the first channel 202 and the second channel 203 communicate with the pump cavity 201. When the position-limiting assembly 50 includes the supporting portion 52 and at least two connecting ribs 51, the connecting rib 51 is connected with the peripheral wall of the first channel 202 of the pump cover 24. The connecting rib 51 is distributed at the outer circumferential side of the supporting portion 52, and the supporting portion 52 is connected with the connecting rib 51. The groove 521 is located in the supporting portion 52, and one end of the positioning shaft 222 is inserted in the groove 521.

In some embodiments, the rotor assembly 22 further includes a first bearing 251 and a second bearing 252, which are arranged along the axial direction of the rotor assembly 22. In the axial direction of the rotor assembly 22, the first bearing 251 is located between the connecting portion 232 of the isolation sleeve 23 and the magnetic assembly 223, and the second bearing 252 is located between the magnetic assembly 223 and the position-limiting assembly 50. Through the above arrangement, it is easy to realize the rotation of the magnetic element 223 in the rotor assembly 22 and the rotation of the impeller assembly 22.

As shown in FIG. 26, in some embodiments, the position-limiting assembly 50 includes a first gasket 53 and the pump cover 24, and the first gasket 53 is sandwiched between the second bearing 252 and the pump cover 24. The pump cover 24 includes a supporting portion 52 and at least two connecting ribs 51, and the first gasket 53 is sandwiched between the second bearing 252 and the supporting portion 52. Through the above arrangement, the wear between the pump cover 24 and the second bearing 252 may be reduced. In specific implementation, the positioning shaft 222 and the isolation sleeve 23 may be injection-molded into an integrated structure, and/or the magnetic assembly 223, the impeller assembly 221, the first bearing 251 and the second bearing 252 may be injection-molded into an integrated structure, so as to realize the stable connection between the structural components and facilitate the simplification of the assembly process of the fluid control apparatus.

Figure 22:
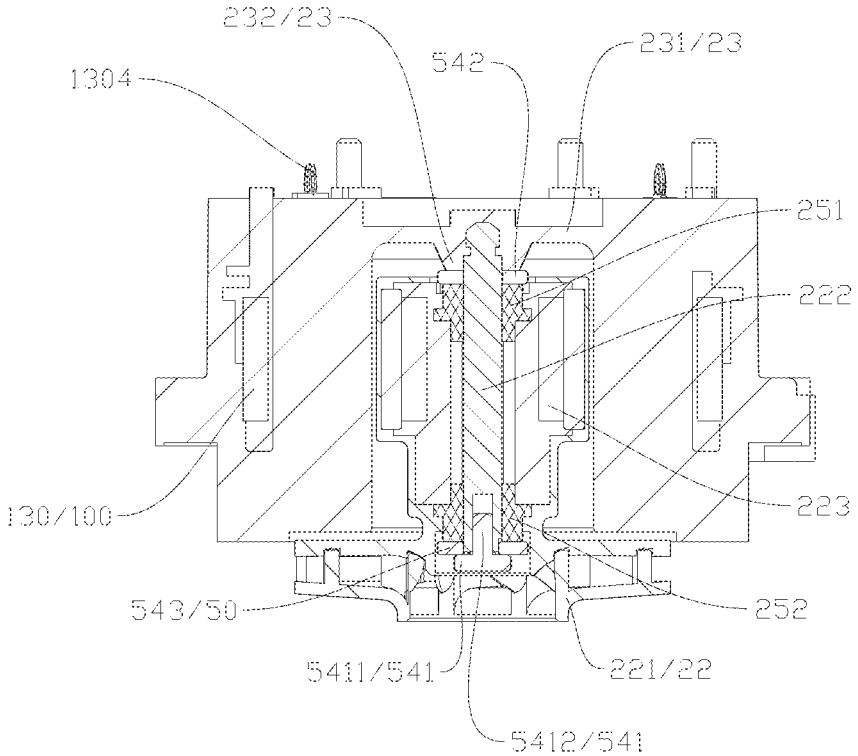
FIG. 22 is a partial schematic sectional structural view of a third assembled structure of a drive assembly and a fluid assembly of the present application.

In some other embodiments, as shown in FIG. 22, the position-limiting assembly 50 includes a first position-limiting member 541, a second gasket 542 and a third gasket 543. The first position-limiting member 541 is firmly connected with the positioning shaft 222, and the second gasket 542 is sandwiched between the first bearing 251 and the connecting portion 232 in the axial direction of the rotor assembly 22. The first position-limiting member 541 includes a first flange portion 5411 and a cylindrical portion 5412. In the axial direction of the first position-limiting member 541, at least part of the orthographic projection of the cylindrical portion 5412 is located inside the orthographic projection of the first flange portion 5411. The third gasket 543 is arranged between the first flange portion 5411 and the second bearing 252 in a position-limited manner. Through the above arrangement, when the electric pump device 20 is assembled with the main housing 40, the impeller assembly 22 of the electric pump device 20 may be arranged downward (up-down direction in the drawing). In this case, the impeller assembly 22 and other structures are limited by the position-limiting assembly 50, which is conducive to assemble the electric pump device 20 with the main housing 40. In this embodiment, the positioning shaft 222 and the isolation sleeve 23 may be injection-molded into an integrated structure, and/or the magnetic assembly 223, the impeller assembly 221, the first bearing 251 and the second bearing 252 may be injection-molded into an integrated structure, thus realizing a stable connection between the structural components and facilitating the simplification of the assembly process of the fluid control apparatus.

In order to realize the fixing connection between the first position-limiting member 541 and the positioning shaft 222, in some embodiments, the first position-limiting member 541 has a first threaded portion which is located on the cylindrical portion 5412, and the positioning shaft 222 has a second threaded portion, which is in threaded connection with the first threaded portion. Alternatively, the first position-limiting member 541 may be connected with the positioning shaft 222 by riveting.

In some other embodiments, as shown in FIG. 23, at least part of the first bearing 251 is arranged between the outer circumferential side of the positioning shaft 222 and the connecting portion 232 of the isolation sleeve 23, and the position-limiting assembly 50 is located between the magnetic assembly 223 and the impeller assembly 221 in the axial direction of the rotor assembly 22. The position-limiting assembly 50 includes a second position-limiting member 551 and a fourth gasket 552. The second position-limiting member 551 is connected with the isolation sleeve 23 in a position-limited and sealed manner. For example, the second position-limiting member 551 is welded with the isolation sleeve 23, and the second position-limiting member 551 is located at the side of the magnetic assembly 223 facing away from the connecting portion 232. The second bearing 252 is disposed between the outer circumferential side of the positioning shaft 222 and the second position-limiting member 551. In the axial direction of the rotor assembly 22, the fourth gasket 552 is arranged between the second bearing 252 and the magnetic assembly 223. The second position-limiting member 551 includes a second flange portion 5511 and a second cylindrical portion 5512. In the axial direction of the second position-limiting member 551, at least part of the orthographic projection of the second cylindrical portion 5512 is located inside the orthographic projection of the second flange portion 5511. The second flange portion 5511 is hermetically connected with the isolation sleeve 23. In specific implementation, in this embodiment, the positioning shaft 222 and the magnetic assembly 223 may be injection-molded into an integrated structure, and the isolation sleeve 23 and the first bearing 251 may be injection-molded into an integrated structure, and the impeller assembly 221 is assembled and connected with the positioning shaft 222. Through the above arrangement, the axial limiting of the rotor assembly 22 can be realized.

Further, as shown in FIGS. 27 to 44, a fluid control apparatus 1 provided according to another embodiment of the present application is shown, and is similar in structure to the fluid control apparatus shown in FIGS. 1 to 26, with the first housing 11, the stator assembly 130, the rotor assembly 22, the isolation sleeve 23, the positioning shaft 222 and the main housing 40 being all arranged in the same or similar manner as those shown in FIGS. 1 to 26. The fluid control apparatuses provided according to the two embodiments are at least different in that the number of the drive components 13 included in the drive assembly 100 is four, two of which include stator assemblies and the other two of which include motors, and the number of the fluid subassemblies LK provided according to the embodiment of the present application is four, two of which include the pump assembly 20 and the other two of which include the valve assembly 30.

For the drive assembly 100, reference may be made to FIGS. 18 to 26, 29 to 31, and 34 to 36. The drive assembly 100 further includes a first housing 11 and a second housing 12. The drive assembly 100 has a first accommodating cavity 101, and the first housing 11 and the second housing 12 form at least part of the wall portion of the first accommodating cavity 101. In this embodiment, the second housing 12 includes a top cover portion, which is arranged to be opposite to the bottom wall portion 111 in the height direction of the drive assembly 100. The first housing 11 and the second housing 12 are connected with each other to form a first accommodating cavity 101, and at least part of the at least two drive components 13 is located in the first accommodating cavity 101. As such, at least two drive components 13 are integrated into the same drive assembly 100, which not only reduces the number of lead wires, but also reduces the space occupied by the drive assembly 100, compared with an arrangement in which the multiple drive assemblies are arranged separately from each other. Optionally, all of the drive components 13 may be connected to the first housing 11 in the position-limiting manner, or part of the drive components 13 may be connected to the first housing 11 in the position-limiting manner, which is not limited in the present application.

In the drive assembly 100, the first housing 11 includes a bottom wall portion 111, a position-limiting portion 112 and a circumferential side wall 113. The circumferential side wall 113 and the bottom wall portion 111 are connected with the position-limiting portion 112. For example, the circumferential side wall 113, the bottom wall portion 111 and the position-limiting portion 112 may be fixedly injection-molded into an integrated structure, or fixedly connected by welding, or connected in a position-limiting manner by fasteners. At least part of the position-limiting portion 112 protrudes from the bottom wall portion 111 along the height direction of the drive assembly 100, and the bottom wall portion 111 and the circumferential side wall 113 form part of the wall portion of the first accommodating cavity 101. At least one of the drive components 13 includes a stator assembly 130. The drive component including the stator assembly 130 is defined as a first drive component, and at least part of the first drive component is connected in the position-limiting portion 112 in a position-limiting manner. At least part of the stator assembly 130 included in the first drive component is located in the position-limiting portion 112. Or, the first drive component may also include a pump housing, and at least part of the stator assembly 130 is located in the chamber of the pump housing. For example, the stator assembly 130, as an insert, may be injection-molded with the pump housing or assembled into the chamber of the pump housing. In this case, at least part of the pump housing or of the whole pump housing and stator assembly 130 is located in the position-limiting portion 112. At least two stator assemblies 130 may be conveniently integrated in the same drive assembly 100 by connecting at least part of the first drive component in the position-limiting portion 112 in the position-limiting manner. Compared with an arrangement in which multiple driving devices are provided, the fluid control apparatus provided according to an embodiment of the present application enables to reduce the space occupied by the drive assembly 100 and improve the integration level of the drive assembly 100.

In this embodiment, the number of the drive components 13 included in the drive assembly 100 is four, and there is a gap between the orthographic projections of the four drive components 13 in the height direction of the drive assembly 100. Among the four drive components 13, two of them include two stator assemblies 130 respectively, which may be connected to corresponding position-limiting portions 112 in the position-limiting manner and located in the corresponding position-limiting portions 112. Alternatively, in some other embodiments, one of the drive components 13 of the drive assembly 100 includes a stator assembly 130, and the other drive components may be motors and other drive components, thus realizing the integration of different types of drive components 13.

In order to facilitate the position-limiting of the stator assembly 130, in some embodiments, at least part of the position-limiting portion 112 extends from the bottom wall portion 111 in a direction away from the first accommodating cavity 101. In this case, at least part of the position-limiting portion 112 extends from the bottom wall portion 111 in a direction close to the fluid assembly, and at least part of the position-limiting portion 112 protrudes from the bottom wall portion 111 in a direction away from the second housing 12. Optionally, the stator assembly 130 may be fixedly injection-molded with the position-limiting portion 112. The expression "fixedly injection-molded with" herein means formation of an integrated structure by injection molding. The stator assembly 130 may be used as an insert and integrally injection-molded with the first housing 11, so that the stator assembly 130 and the position-limiting portion 112 may be injection-molded into an integrated structure. In this case, electric connection wires may be led out from the stator assembly 130 during injection molding, and the stator assembly 130 may be electrically connected to a control member through the electric connection wires. Alternatively, the position-limiting portion 112 includes a mounting cavity QS in which at least part of the stator assembly 130 is located, and the stator assembly 130 is connected to the first housing 11 in a position-limiting manner, for example, by fasteners. Through the above arrangement, it is easy to arrange the stator assembly 130 and the position-limiting portion 112 in a position-limited manner. When at least two drive components 13 include stator assemblies 130, all the stator assemblies 130 and the position-limiting portion 112 may be injection-molded into an integrated structure, or all the stator assemblies 130 may be assembled into the mounting cavity QS formed by the position-limiting portion 112. Alternatively, some of the stator assemblies 130 and the position-limiting portion 112 may be injection-molded into an integrated structure, and another part of the stator assemblies 130 and the position-limiting portion 112 may be injection-molded into an integrated structure.

Figure 29:
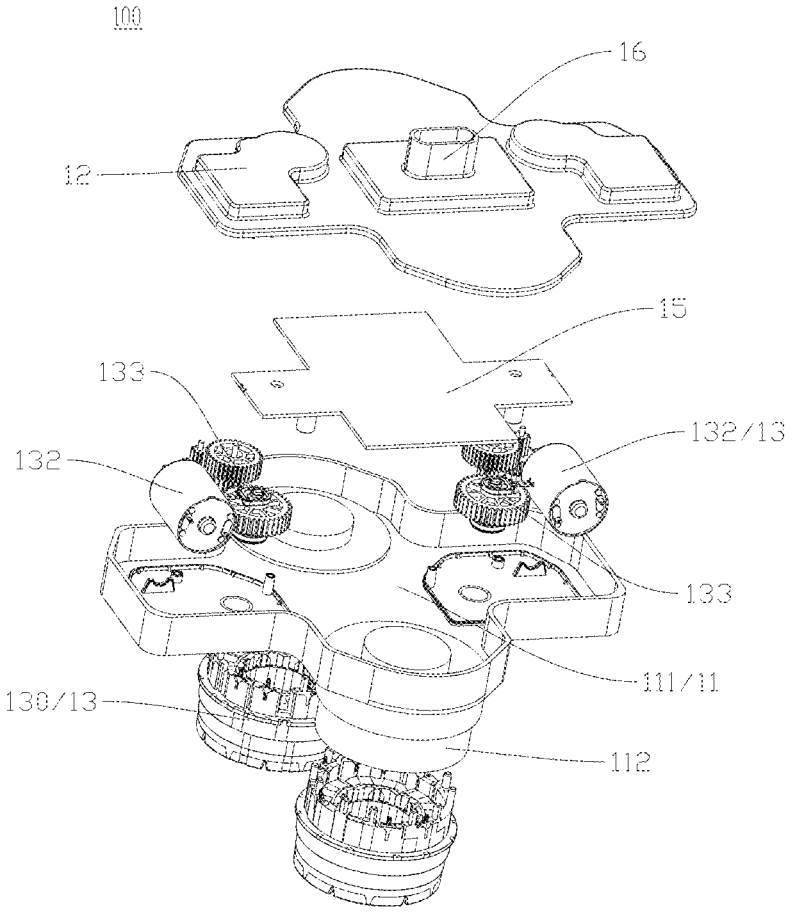
FIG. 29 is a schematic exploded structural view of a drive assembly shown in FIG. 27.
Figure 30:
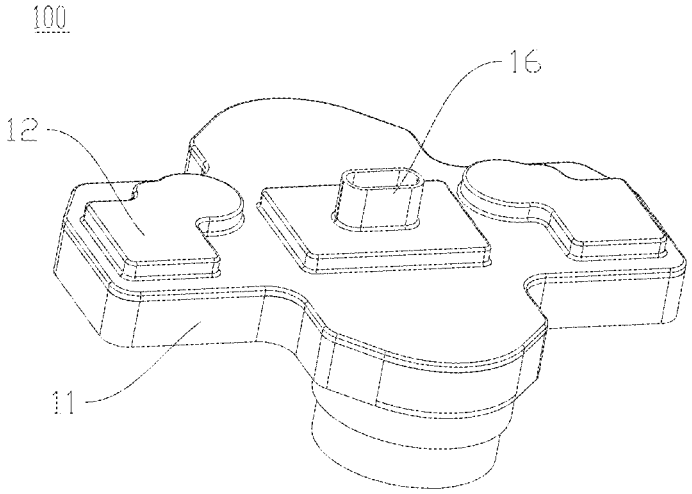
FIG. 30 is a schematic perspective structural view of the drive assembly shown in FIG. 29.
Figure 31:
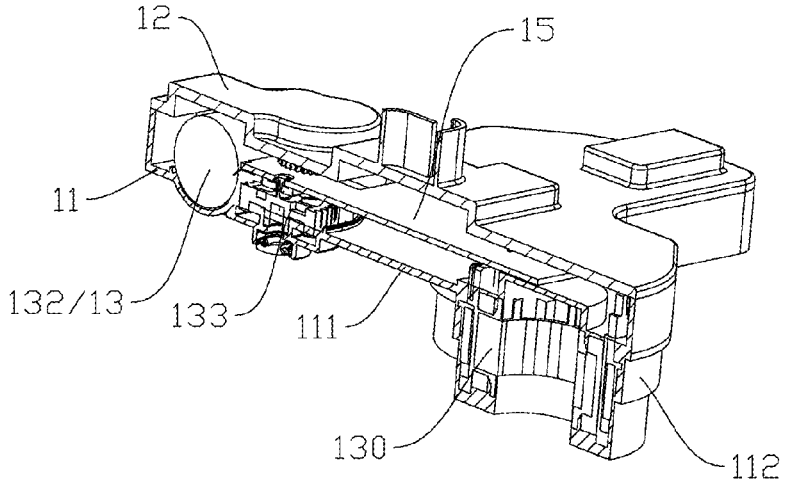
FIG. 31 is a schematic sectional structural view of a drive assembly shown in FIG. 29.
Figure 32:
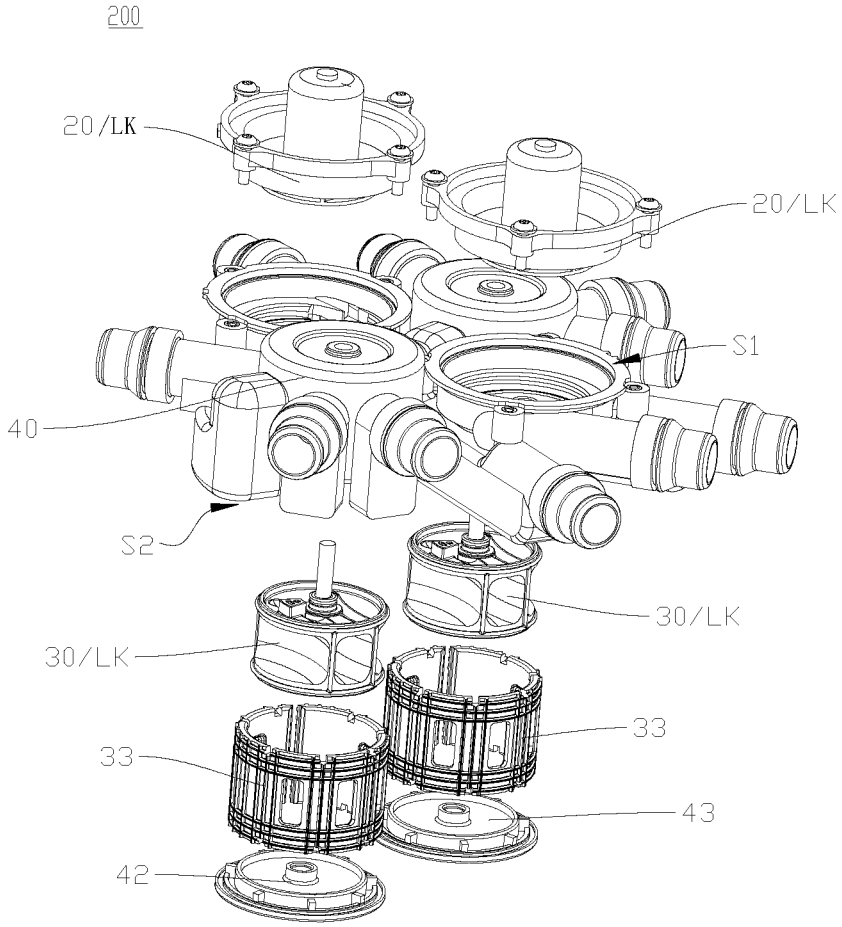
FIG. 32 is a schematic exploded structural view of a fluid assembly shown in FIG. 27.
Figure 33:
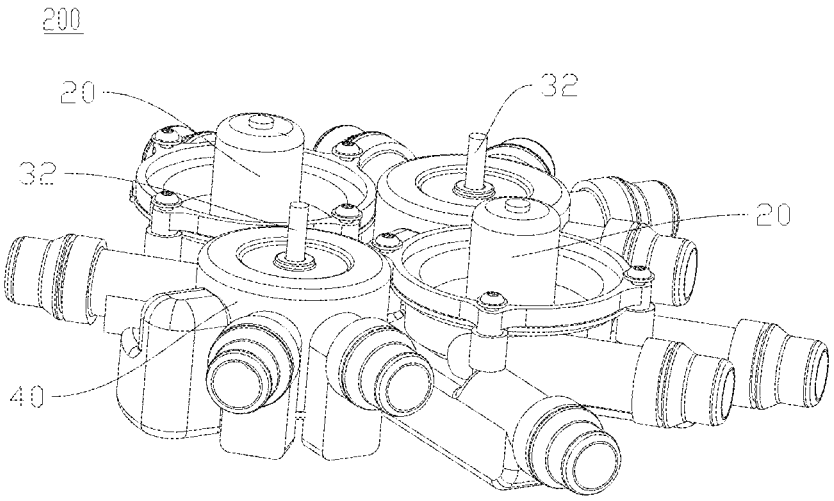
FIG. 33 is a schematic perspective structural view of the fluid assembly shown in FIG. 32.
Figure 34:
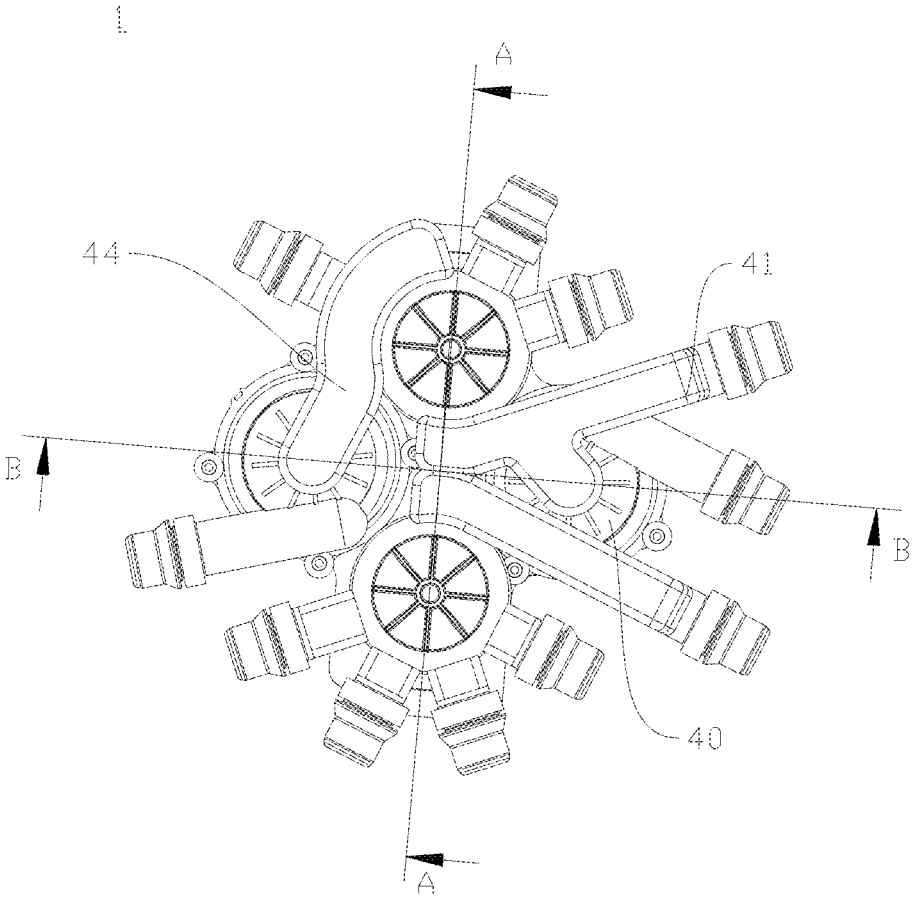
FIG. 34 is a schematic front structural view of the fluid control apparatus shown in FIG. 27.
Figure 35:
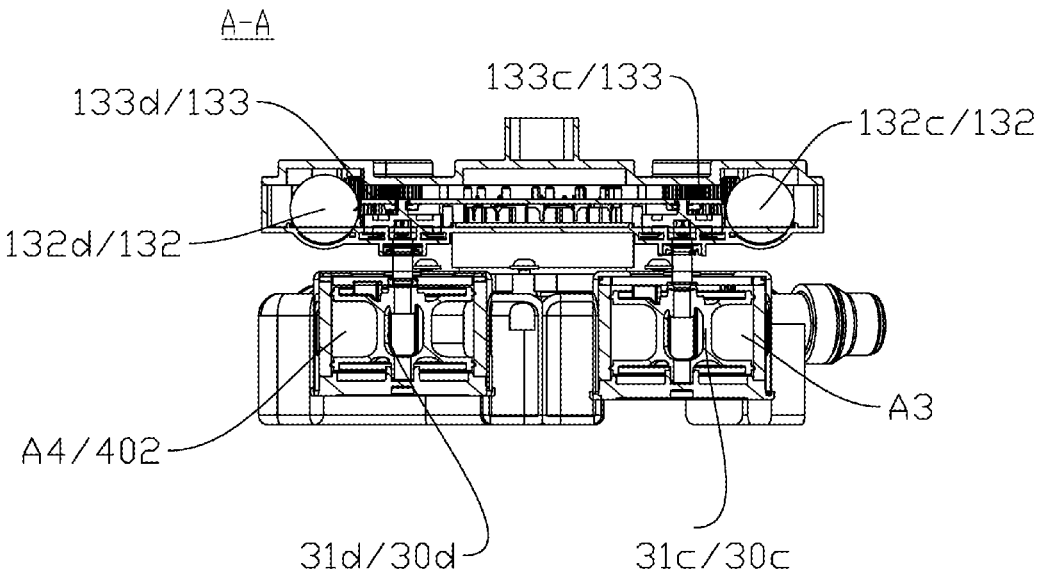
FIG. 35 is a schematic sectional structural view of the fluid control apparatus shown in FIG. 34 taken along line A-A.

Alternatively, as shown in FIG. 29, in order to realize the function of the drive component, the drive component according to the embodiment of the present application further includes a control member 15. The control member 15 may be a circuit board. The drive component including a stator assembly 130 is defined as a first drive component, which further includes a pump housing 135, a transition terminal 134 connected to the pump housing 135, and a connecting plate 136. The stator assembly 130 is separately arranged from the first housing 11. In this case, the stator assembly 130 is assembled into the mounting cavity QS formed by the position-limiting portion 112. At least part of the stator assembly 130 and the connecting plate 136 are located in the chamber of the pump housing 135, and the pump housing 135 is hermetically connected with the first housing 11. For example, the pump housing 135 may be hermetically connected with the first housing 11 by a sealing ring, or the pump housing 135 and the position-limiting portion 112 of the first housing 11 are injection-molded into an integrated structure. The stator assembly 130 includes a coil winding 1303, which is electrically connected to a pin in the transition terminal 134 through a conductive member in the connecting plate 136. Part of the transition terminal 134 passes through the bottom wall portion 111 and is located in the first accommodating cavity 101, and the transition terminal 134 is electrically connected to the control member 15. It should be noted that the drive component herein includes a stator assembly 130 or a motor 132, and the drive component may also include a lead structure or a terminal structure, which enables the control member 15 to be electrically connected to the stator assembly 130 or the motor 132.

In order to realize the electrical connection between the stator assembly 130 and the control member 15, a metal conductive structure may be arranged in the first housing 11, and the metal conductive structure may be injection-molded with the first housing 11 into an integrated structure, so that the metal conductive structure is pre-embedded in the first housing 11. The output terminal 1304 of the stator assembly 130 may use insulation displacement connectors (IDC). The output terminal 1304 may be electrically connected to the control member 15 through IDC pins.

Figure 36:
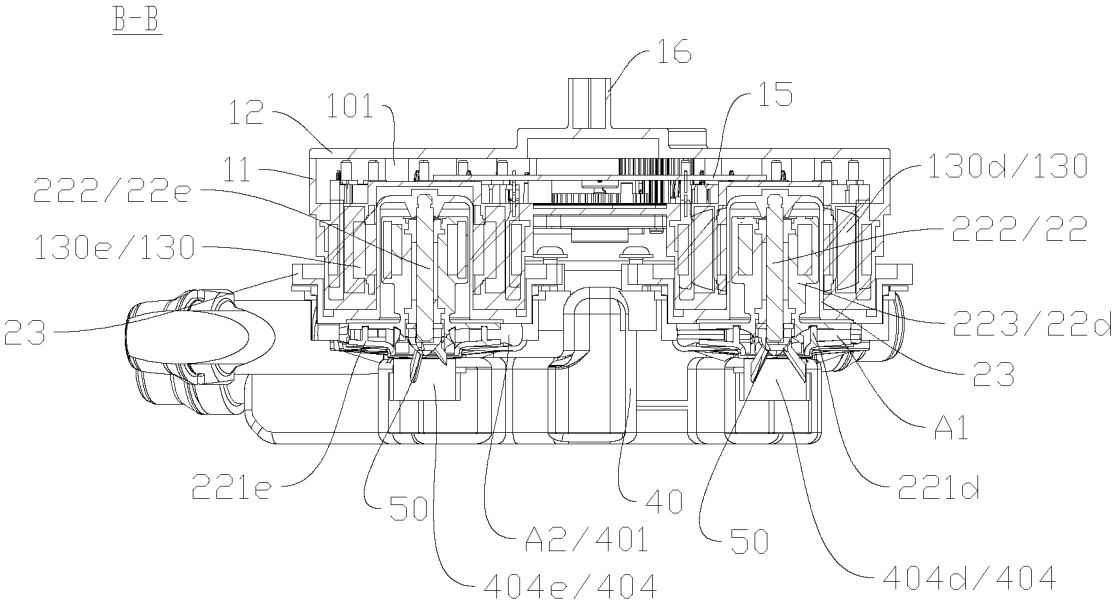
FIG. 36 is a schematic sectional structural view of the fluid control apparatus shown in FIG. 34 taken along line B-B.

In some embodiments, as shown in FIG. 36, the fluid control apparatus may further include an isolation sleeve 23, part of which is located at an inner circumferential side of the stator assembly 130. Optionally, the isolation sleeve 23 may be injection-molded with the first housing 11 into an integrated structure. The stator assembly 130 may be injection-molded with the position-limiting portion 112 into an integrated structure or the stator assembly 130 may be located in the mounting cavity QS of the position-limiting portion 112. Alternatively, as shown in FIGS. 19 to 24, the isolation sleeve 23 and the stator assembly 130 are injection-molded into an integrated structure or at least part of the stator assembly 130 is located in the cavity formed by the isolation sleeve 23. In this case, the isolation sleeve 23 and the stator assembly 130, as a whole, is separately formed from the first housing 11 and hermetically connected to the first housing 11. A sealing ring is arranged between the first housing 11 and the integrated structure formed by the isolation sleeve 23 and the stator assembly 130, and the sealing arrangement between the integrated structure and the first housing 11 is realized by clamping the sealing ring. Through the above arrangement, the position-limiting arrangement and sealing connection between the isolation sleeve 23 and the first housing 11 can be realized.

In specific implementation, when the stator assembly 130 and the position-limiting portion 112 are injection-molded into an integrated structure, the isolation sleeve 23 may be injection-molded with the first housing 11 into an integrated structure, or the isolation sleeve 23 may be separately formed from the first housing 11 and hermetically connected with the first housing 11. When the stator assembly 130 is assembled to the mounting cavity QS of the position-limiting portion 112, the isolation sleeve 23 may be injection-molded with the first housing 11 into an integrated structure; or the isolation sleeve 23 is separately formed from the first housing 11 and hermetically connected with the first housing 11; or the isolation sleeve 23 and the stator assembly 130 is injection-molded with the first housing 11 into an integrated structure, and the isolation sleeve 23 and the stator assembly 130, as a whole, are separately formed from the first housing 11 and hermetically connected with the first housing 11. When the number of the stator assemblies 130 is at least two, different stator assemblies 130 may be connected with the first housing 11 in the same or different position-limiting manners, and the ways of connecting the isolation sleeves 23 corresponding to different stator assemblies 130 to the first housing 11 can be the same or different.

Figure 13:
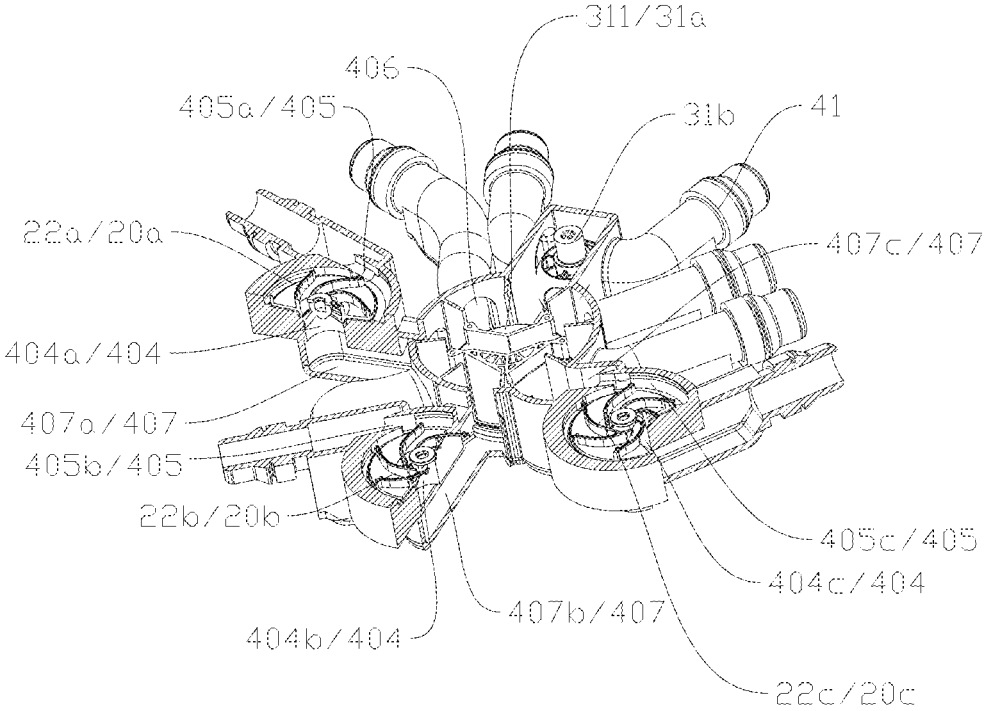
FIG. 13 is a partial schematic sectional structural view of a fluid assembly provided according to a second embodiment of the present application.
Figure 14:
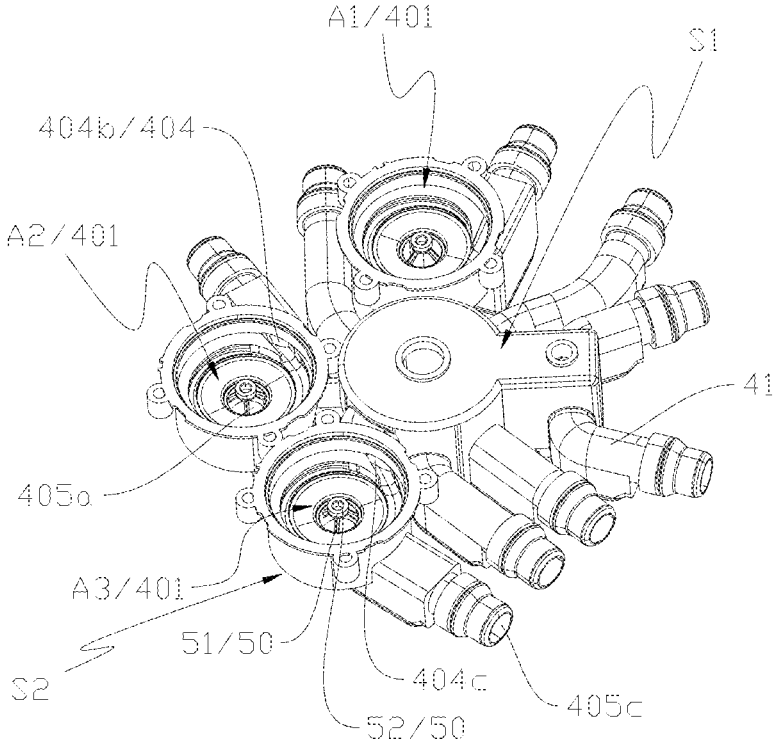
FIG. 14 is a schematic perspective structural view of a main housing provided according to an embodiment of the present application.

As shown in FIG. 25, the drive component including the stator assembly 130 is defined as the first drive component, which further includes a pump housing 135, a transition terminal 134 connected to the pump housing 135, and a connecting plate 136. The stator assembly 130 is separately formed from the first housing 11, and at least part of the stator assembly 130 and the connecting plate are located in the chamber of the pump housing 135. The pump housing 135 is hermetically connected with the first housing 11. For example, the pump housing 135 may be hermetically connected with the first housing 11 by a sealing ring as shown in FIG. 13, or the pump housing 135 and the position-limiting portion 112 of the first housing 11 may be injection-molded into an integrated structure as shown in FIG. 14. The stator assembly 130 includes a coil winding 1303, which is electrically connected to a pin in a transition terminal 134 via a conductive member in a connecting plate 136. Part of the transition terminal 134 passes through the bottom wall portion 111 and is located in the first accommodating cavity 101, and the transition terminal 134 is electrically connected with the control member 15. It should be noted that the drive component herein includes a stator assembly 130 or a motor 132, and may also include a lead wire structure or a terminal structure for electrically connecting the stator assembly 130 or the motor 132 to the control member 15.

The fluid assembly 200 includes a main housing 40. The main housing 40 includes cavity shells 45 and a flow channel plate 44 which may be connected between the two cavity shells 45. The main housing 40 has a first chamber 401, a second chamber 402, a first orifice 404, a second orifice 405, multiple flow channels 406 and a communication channel 407. Both the first orifice 404 and the second orifice 405 communicate with the first chamber 401. At least part of the pump assembly 20 is located in the first chamber 401, and at least part of the valve assembly 30 is located in the second chamber 402. The first orifice 404 corresponding to the pump assembly 20 communicates with one of the flow channels 406 located at the outer circumferential side of the valve assembly 30.

Figure 27:
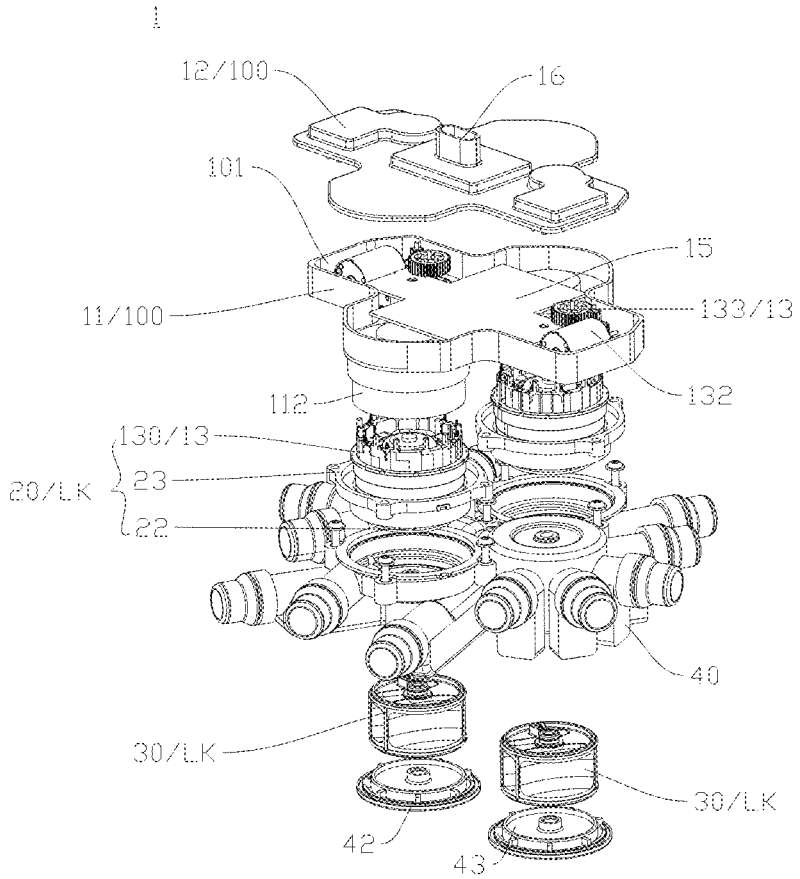
FIG. 27 is a schematic exploded structural view of a fluid control apparatus provided according to a second embodiment of the present application.
Figure 28:
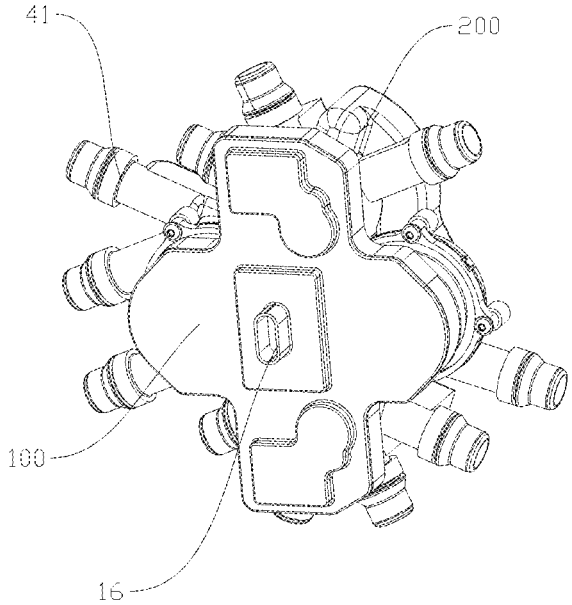
FIG. 28 is a schematic perspective structural view of the fluid control apparatus shown in FIG. 27.

In order to realize the fluid circulation in the fluid control apparatus 1, in some embodiments, at least part of the main housing 40 is located on a side of the first housing 11 facing away from the first accommodating cavity 101. As shown in FIG. 27, at least part of the main housing 40 is located at a side of the first housing 11 facing away from the second housing 12. The main housing 40 further includes connecting pipes 41, which may be arranged in the circumferential direction of the main housing 40 or integrated on at least one mounting surface.

In the embodiment of the present application, the pump assembly 20 includes a rotor assembly 22, and the isolation sleeve 23 of the fluid control apparatus is arranged outside the outer circumferential side of the rotor assembly 22. By providing the isolation sleeve 23, the stator assembly 130 and the corresponding rotor assembly 22 may be isolated from each other to prevent the working fluid from entering the space where the stator assembly 130 is located. The rotor assembly 22 includes an impeller assembly 221 and a magnetic assembly 223, and the pump assembly 20 further includes a positioning shaft 222. The impeller assembly 221 is arranged outside the outer circumferential side of the positioning shaft 222. At least part of the impeller assembly 221 may be located in the first chamber 401. At least part of the first orifice 404 and the impeller assembly are arranged in the height direction of the pump assembly 20, and the second orifice 405 corresponds to the position of the impeller assembly 221. Optionally, at least part of the wall portion of the first orifice 404 can be arranged coaxially with the rotating shaft of the impeller assembly 221, and an opening of the second orifice 405 is located at an edge of the impeller assembly 221 in the circumferential direction, so that the fluid can enter the impeller assembly 221 through the first orifice 404 and can be discharged through the second orifice 405 under a centrifugal force of the impeller assembly 221. In this case, the first orifice 404 can be an inlet orifice of the pump assembly 20, and the second orifice 405 may be an outlet orifice of the pump assembly 20.

In some embodiments, the main housing 40 has a flow channel plate 44 and a cavity shell 45, which are injection-molded into an integrated structure. The first chamber 401, the second chamber 402 and the flow channel 406 are located in the cavity shell 45, and the communication channel 407 is located in the flow channel plate 44. At least part of the flow channel plate 44 is connected between two fluid subassemblies LK, for example, the flow channel plate 44 may be connected between the pump assembly 20 and the valve assembly 30, or the flow channel plate 44 may be connected between the two valve assemblies 30. In the embodiment of the present application, by integrating the flow channel plate 44 with the cavity shells 45, it is conducive to reduce the pipeline connection between the cavity shells 45 and improve the integration level of the fluid control apparatus. Further, the multiple flow channels 406 are distributed at the outer circumferential side of the second chamber 402, and one of the flow channels 406 communicates with one of the first orifice 404 and the second orifice 405 through a communication channel 407. The valve core 30 includes a communication cavity 31, which may communicate at least two flow channels 406. An extending direction of the communication orifice 407, of the flow channel 406 and of the first or second orifice 404, 405, which communicated with each other, intersect with each other.

Optionally, the pump assembly 20 may further include a pump cover 24 which is hermetically connected with the isolation sleeve 23. The pump cover 24 may be welded with the isolation sleeve 23, and the rotor assembly 22 is located in a space formed between the pump cover 24 and the isolation sleeve 23. The pump cover 24 has a first port 241 and a second port 242, and the rotor assembly 22 may drive the fluid to circulate between the first port 241 and the second port 242. At least part of the pump cover 24 is located in the first chamber 401, and the pump cover 24 is hermetically connected with the main housing 40. The first port 241 communicates with the first orifice 404, and the second port 242 communicates with the second orifice 405. In specific implementation, the pump assembly 20 has a pump cavity 201, a first channel 202 and a second channel 203, and the pump cover 24 forms at least part of the wall portion of the pump cavity 201. The first channel 202 and the second channel 203 may also be located in the pump cover 24. The first port 241 is located in the first channel and the second port 242 is located in the second channel. At least part of the first channel 202 is located in the first orifice 404, and at least part of the second channel 203 is located in the second orifice 405.

In order to realize the sealed connection between the pump cover 24 and the main housing 40, in some embodiments, as shown in FIG. 26, a sealing ring may be sandwiched between the pump cover 24 and the main housing 40, or the pump cover 24 and the main housing 40 may be injection-molded into an integrated structure. Herein, the integrated structure formed by two structural members may be formed by injection molding process or made by other processes, which is not limited in this application.

In order to facilitate fluid circulation in the main housing 40, in some embodiments, the first chamber 401 includes a first sub-cavity A1 and a second sub-cavity A2, and the second chamber 402 includes a third sub-cavity A3 and a fourth sub-cavity A4. Two pump assemblies are defined as a first pump assembly 20*d* and a second pump assembly 20*e*, and two valve assemblies are defined as a first valve assembly 30*c* and a second valve assembly 30*e*. At least part of the first pump assembly 20*d* is located in the first sub-cavity A1; at least part of the second pump assembly 20*e* is located in the second sub-cavity A2; at least part of the first valve assembly 30*c* is located in the third sub-cavity A3; and at least part of the second valve assembly 30*d* is located in the fourth sub-cavity A4. The first sub-cavity A1 and the second sub-cavity A2 are both communicated with the third sub-cavity A3. Through the above arrangement, it is easy to realize the fluid circulation between the two pump assemblies and one of the valve assemblies in the main housing 40.

Both the first chamber 401 and the second chamber 402 have openings located on a surface of the main housing 40. In order to facilitate the assembly of the pump assembly 20 and the valve assembly 30, a first mounting port of the first chamber 401 and a second mounting port of the second chamber 402 are respectively located at different sides of the main housing 40. As shown in FIG. 27, the openings of the first chamber 401 and the second chamber 402 are located opposite to each other in the height direction of the main housing 40. In this case, the main housing 40 includes a cavity shell 45 and a bottom cover. The bottom cover may be connected with the cavity shell 45 in a sealed manner by welding and other processes.

In some embodiments, the cavity shell 45 includes a cavity shell side wall and a cavity shell top wall. Part of the cavity shell side wall and the cavity shell top wall form at least part of the wall portion of the first chamber 401. The cavity shell side wall and the cavity shell top wall are in an integrated structure, and the cavity shell top wall and the first mounting port are located at the same side of the main housing 40. Through the above arrangement, it is easy to reduce the assembly error between the valve assembly 30 and the corresponding drive component 13, and to improve the strength of the cavity shell 45, and to make the corresponding drive components of the valve assembly 30 and the pump assembly 20 located at the same side of the main housing 40.

In specific implementation, the main housing 40 includes a first end S1 and a second end S2, which are oppositely arranged in the height direction of the main housing 40. The first mounting port of the first chamber 401 is located at the first end S1, and the second mounting port of the second chamber 402 is located at the second end S2. The drive assembly 100 is located at the side of the first end S1 facing away from the second end S2. Through the above arrangement, the pump assembly 20 may be assembled with the main housing 40 at one side of the main housing 40, and the valve assembly 30 may be assembled with the main housing 40 at the other side of the main housing 40, so that it is convenient to realize that the drive component for driving the pump assembly 20 and the drive component for driving the valve assembly 30 are arranged at the same side, and it is convenient to realize the integration of multiple drive components. When the number of the valve assemblies 30 is at least two, all of the valve assemblies 30 may be mounted at the same side of the main housing 40, which is easy to unify the assembly reference. Then, all of the pump assemblies 20 may be mounted at the other side of the main housing 40, which is easy to reduce the assembly error and better realize the coaxiality of at least two valve assemblies 30 and the corresponding drive components 13. It can be understood that the first mounting port of the first chamber 401 and the second mounting port of the second chamber 402 may also be arranged on the same side of the main housing 40, so that both the pump assembly 20 and the valve assembly 30 are assembled at the same side of the main housing, which is not limited in the present application.

The valve cores in the two valve assemblies 30 provided in the embodiment of the present application are similar in structure, including a first valve assembly 30*c* and a second valve assembly 30*d*. One of the two valve cores is defined as a first valve core 31*c*, and the other is defined as a second valve core 31*d*. The number of flow channels 406 on the outer circumferential side of the first valve core 31*c* may be at least five, and the number of flow channels 406 on the outer circumferential side of the second valve core 31*d* may be at least five. Further, one of the pump assemblies 20 is defined as the first pump assembly 20*d* and the other is defined as the second pump assembly 20*e*. A first orifice 404*d* corresponding to the first pump assembly 20*d* and a first orifice 404*e* corresponding to the second pump assembly 20*e* are all communicated with the third sub-cavity A3 through the communication channel 407. The flow channel 406 located at the outer circumferential side of the first valve core 31*c* is defined as the first flow channel 4061, which is located at the side wall portion of the third sub-cavity A3. The flow channel 406 located at the outer circumferential side of the second valve core 31*d* is a second flow channel 4062, which is located at the side wall portion of the fourth sub-cavity A4. In this embodiment, the number of the first flow channels 4061 is five, and the number of the second flow channels 4062 is five. Of course, the number of the first flow channels 4061 and the second flow channels 4062 may also be determined based on the needs of users, for example, it may be three, four, six, seven or more, and the number of the first flow channels 4061 and the second flow channels 4062 may be the same or different. Through the above arrangement, a pump assembly 20 and a valve assembly 30 may cooperate to realize fluid control.

In order to facilitate the integration of the drive components of the pump assembly and valve assembly, in some embodiments, in the height direction of the fluid control apparatus, the side of the first pump assembly 20*d* and the second pump assembly 20*e* facing away from the main housing 40 is located at the same height, so as to facilitate the assembly and mounting with their corresponding stator assemblies, and the part of the valve assembly 30 is located at the same height as the part of the pump assembly 20, so as to facilitate the reduction of the axial height of the fluid control apparatus. Specifically, the part of the first valve assembly 30*c* may be located at the same height as the part of the first pump assembly 20*d* and the part of the second pump assembly 20*e*.

Further, in some embodiments, the main housing 40 further includes a first communication channel 407*d* and a second communication channel 407*e*. The first communication channel 407*d* communicates the first sub-cavity A1 and the third sub-cavity A3, and the second communication channel 407*e* communicates the second sub-cavity A2 and the third sub-cavity A3. At least part of the first communication channel 407*d* and at least part of the second communication channel 407*e* are spaced from each other in the circumferential direction of the wall portion of the third sub-cavity A3.

Figure 37:
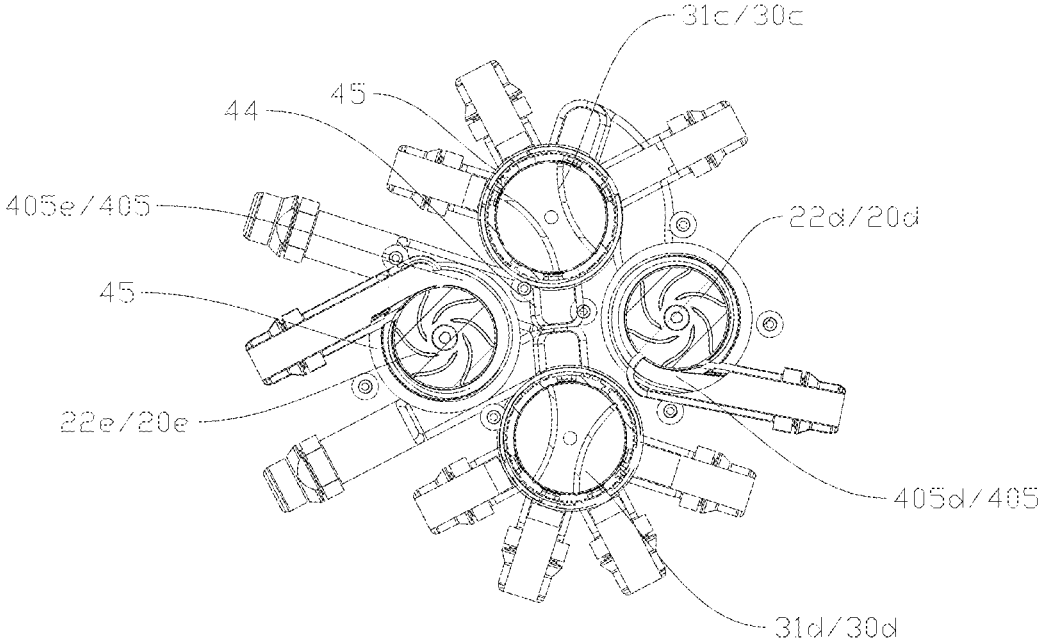
FIG. 37 is a schematic sectional structural view of the fluid assembly shown in FIG. 33 at one of the positions.
Figure 38:
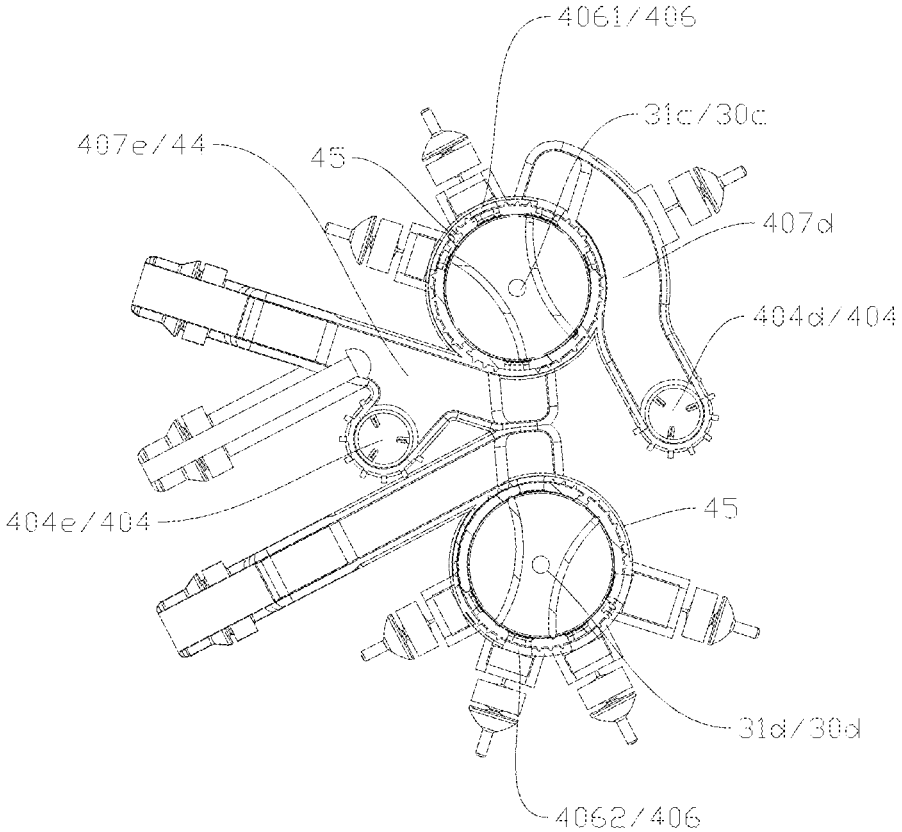
FIG. 38 is a schematic sectional structural view of the fluid assembly shown in FIG. 33 at another position.
Figure 39:
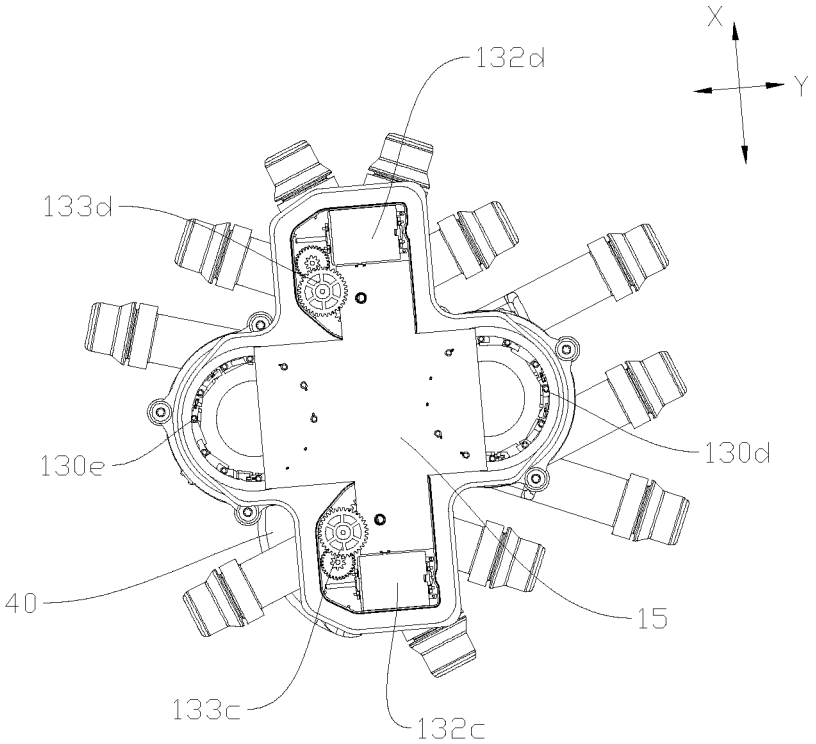
FIG. 39 is a partial schematic structural view of the fluid control apparatus shown in FIG. 27.
Figure 40:
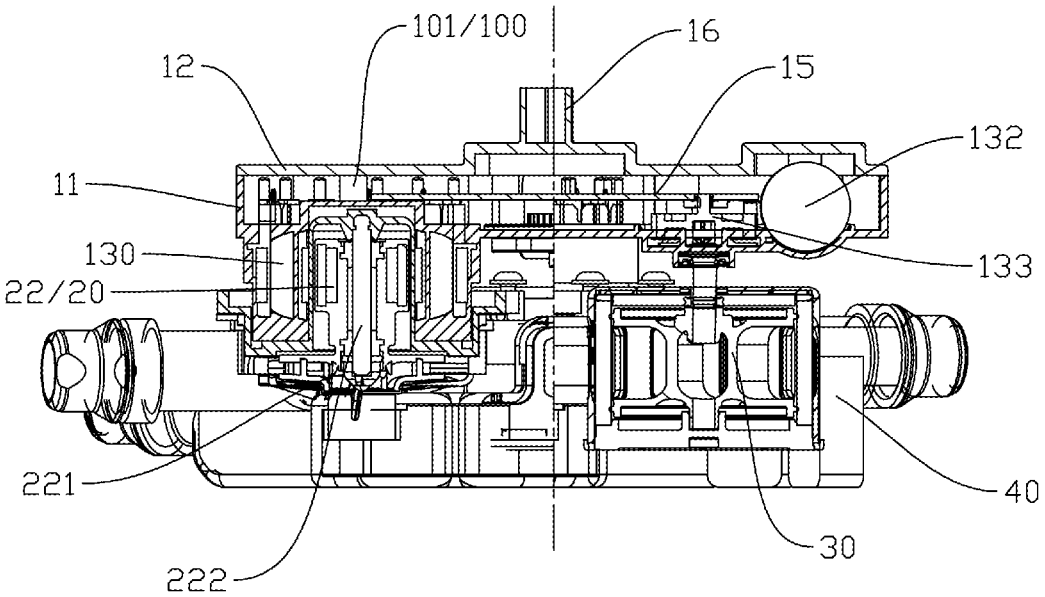
FIG. 40 is a schematic sectional structural view of the fluid control apparatus shown in FIG. 27 at yet another position.

As shown in FIGS. 36 and 37, in order to better realize the fluid circulation between the pump assembly 20 and the valve assembly 30, the main housing 40 includes a first orifice 404 and a second orifice 405. The first orifice 404 may be an inlet channel of the pump assembly 20, and the second orifice 405 may be an outlet channel of the pump assembly 20. In this embodiment, the first orifice 404 includes a first sub-orifice 404*d* and a second sub-orifice 404*e*, and the second orifice 405 includes a third sub-orifice 405*d* and a fourth sub-orifice 405*e*. Both of the first sub-orifice 404*d* and the third sub-orifice 405*d* communicate with the first sub-cavity A1, and both of the second sub-orifice 404*e* and the fourth sub-orifice 405*e* communicate with the second sub-cavity A2. The first pump assembly 20*d* includes a first impeller assembly 221*d*, and the second pump assembly 20*e* includes a second impeller assembly 221*e*. At least part of the wall portion of the first sub-orifice 404*d* is coaxially arranged with the rotating shaft of the first impeller assembly 221*d*, and at least part of the opening of the third sub-orifice 405*d* is located at an edge of the first impeller assembly 221*d* in the circumferential direction. At least part of the wall portion of the second sub-orifice 404*e* is coaxially arranged with the rotating shaft of the second impeller assembly 221*e*, and at least part of the opening of the fourth sub-orifice 405*e* is located at an edge of the second impeller assembly 221*e* in the circumferential direction. The first sub-orifice 404*d* communicates with the third sub-cavity A3 through the first communication channel 407*d*, and the second sub-orifice 404*e* communicates with the third sub-cavity A3 through the second communication channel 407*e*.

As shown in FIGS. 27 to 44, the first valve core 31*c* includes at least three communication cavities. The communication cavities of the first valve core 31*c* may communicate at least two first flow channels 4061 and isolate at least one first flow channel 4061. The communication cavity of the second valve core 31*d* may communicate at least two second flow channels 4062 and isolate at least one second flow channel 4062. Through the above arrangement, various operating modes of the fluid control apparatus can be realized. Herein, the channel isolation means that the flow channel does not communicate with any other flow channel after passing through the corresponding valve core.

The operating mode of the first valve assembly 30*c* will be described below. The first flow channels corresponding to the first valve assembly 30*c* are defined as a first flow sub-channel P1, a second flow sub-channel P2, a third flow sub-channel P3, a fourth flow sub-channel P4 and a fifth flow sub-channel P5, respectively. The second flow sub-channel P2 communicates with the orifice corresponding to the first pump assembly 20*d*, and the fourth flow sub-channel P4 communicates with the orifice corresponding to the second pump assembly 20*e*. By adjusting the positions of the multiple first flow channels at the wall portion of the corresponding third sub-cavity A3 and the opening angles between the three communication chambers of the first valve core 31*c*, the first valve assembly 30*c* according to the embodiment of the present application has at least one of the following operating modes.

Figure 41:
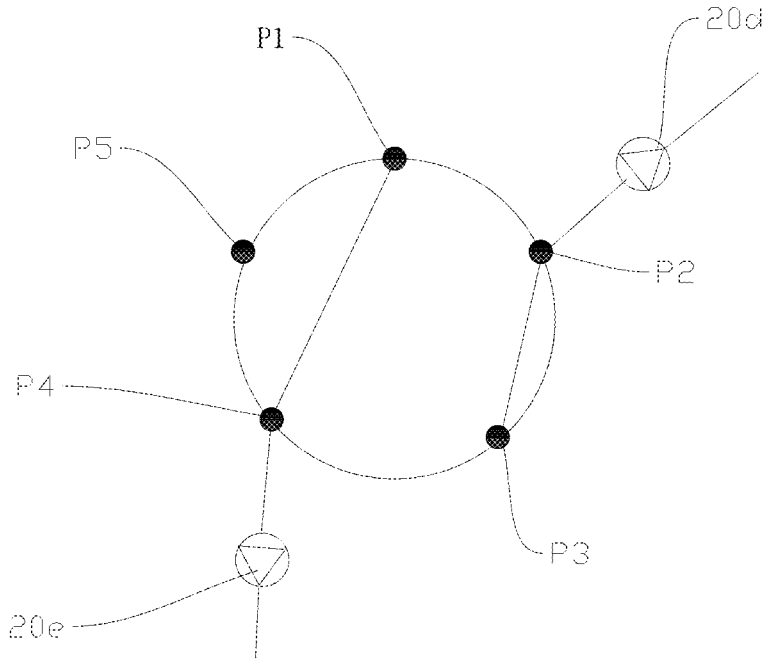
FIG. 41 is a schematic block diagram showing connection of a first valve assembly, a first pump assembly and a second pump assembly in a first operating mode shown in FIG. 27.

In a first operating mode, as shown in FIG. 41, the first valve core 31*c* is at a first position, where one of the communication cavities of the first valve core 31*c* communicates the first flow sub-channel P1 with the fourth flow sub-channel P4; another one communicates the second flow sub-channel P2 with the third flow sub-channel P3; and yet another one isolates the fifth flow sub-channel P5.

Figure 42:
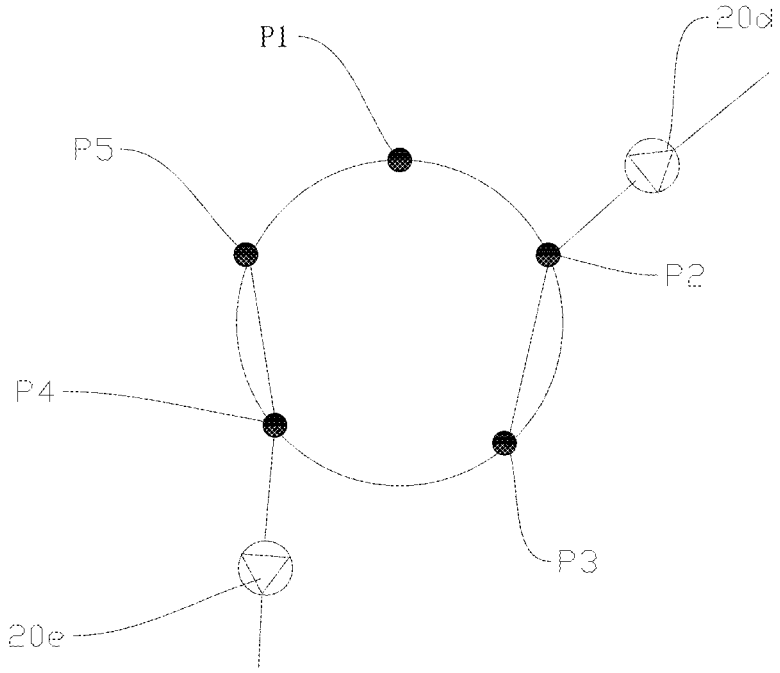
FIG. 42 is a schematic block diagram showing connection of the first valve assembly, the first pump assembly and the second pump assembly in a second operating mode shown in FIG. 27.

In the second operating mode, as shown in FIG. 42, the first valve core 31*c* is at a second position, where one of the communication cavities of the first valve core 31*c* communicates the fifth flow sub-channel P5 with the fourth flow sub-channel P4; another one communicates the second flow sub-channel P2 with the third flow sub-channel P3; and yet another one isolates the first flow sub-channel P1.

Figure 43:
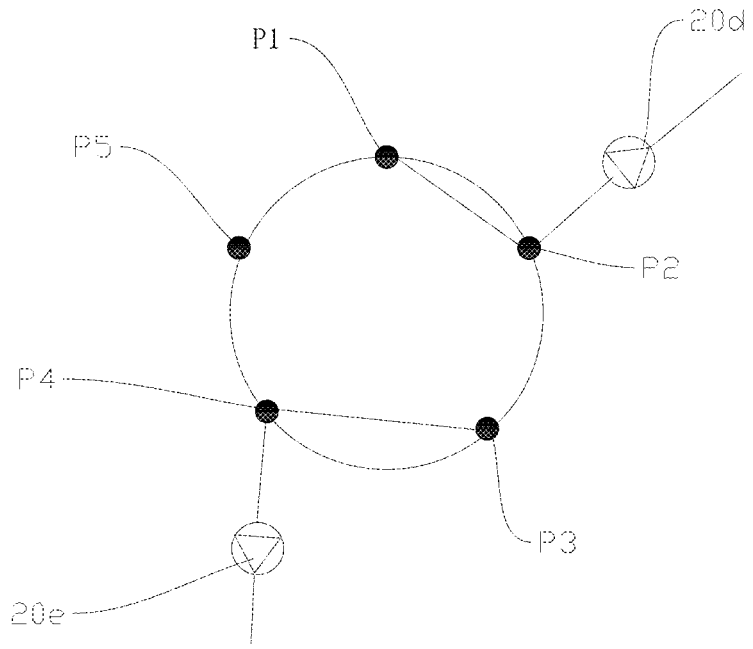
FIG. 43 is a schematic block diagram showing connection of the first valve assembly, the first pump assembly and the second pump assembly in a third operating mode shown in FIG. 27.

In the third operating mode, as shown in FIG. 43, the first valve core 31*c* is at a third position, where one of the communication cavities of the first valve core 31*c* communicates the third flow sub-channel P3 with the fourth flow sub-channel P4; another one communicates the second flow sub-channel P2 with the first flow sub-channel P1; and yet another one isolates the fifth flow sub-channel P5.

Figure 44:
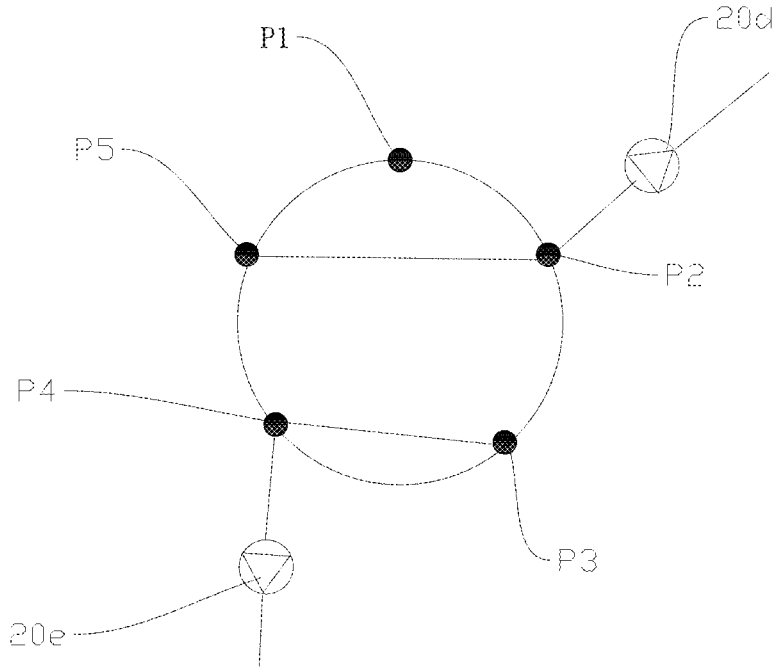
FIG. 44 is a schematic block diagram showing connection of the first valve assembly, the first pump assembly and the second pump assembly in a fourth operating mode shown in FIG. 27.
Figure 45:
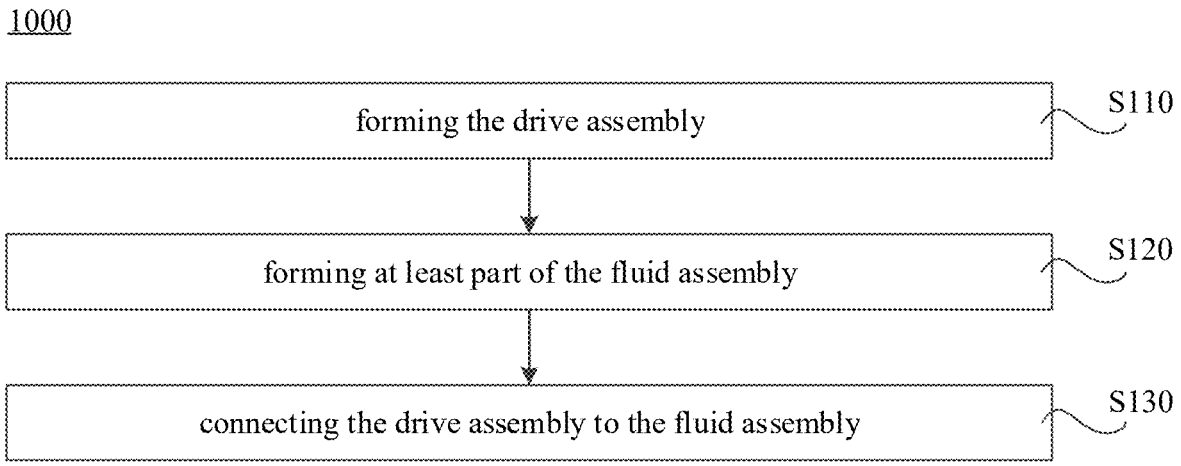
FIG. 45 is a schematic flowchart of a method for manufacturing a fluid control apparatus provided according to an embodiment of the present application.

In the fourth operating mode, as shown in FIG. 44, the first valve core 31*c* is at a fourth position, where one of the communication cavities of the first valve core 31*c* communicates the third flow sub-channel P3 with the fourth flow sub-channel P4; another one communicates the second flow sub-channel P2 with the fifth flow sub-channel P5; and yet another one isolates the first flow sub-channel P1.

The operating mode of communicating the second flow channel corresponding to the second valve assembly 30*d* provided according to the embodiment of the present application may be the same as the operating mode of the first valve assembly 30*c*, which is not repeated here. The corresponding flow channels of the two valve assemblies may be communicated through an external pipe, or a flow channel arranged on the main housing 40, which is not described in detail in the present application.

Further, the drive assembly 100 of the fluid control apparatus 1 includes a first housing 11, a first stator assembly 130*d*, a second stator assembly 130*e*, a first motor 132*c* and a second motor 132*d*. The first pump assembly 20*d* includes a first rotor assembly 22*d*, and the second pump assembly 20*e* includes a second rotor assembly 22*e*. The first rotor assembly 22*d* may be located in the magnetic field range of the first stator assembly 130*d*, and the second rotor assembly 22*e* may be located in the magnetic field range of the second stator assembly 130*e*. The first valve core 31*c* of the first valve assembly 30*c* is in transmission connection with the first motor 132*c*, and the second valve core 31*d* of the second valve assembly 30*d* is in transmission connection with the second motor 132*d*. The drive assembly 100 has a first accommodating cavity 101, and the first housing 11 forms at least part of the wall portion of the first accommodating cavity 101. At least part of the first stator assembly 130*d*, at least part of the second stator assembly 130*e*, at least part of the first motor 132*c* and at least part of the second motor 132*d* are all located in the first accommodating cavity 101.

Further, the drive assembly 100 may further include a control member 15 located in the first accommodating cavity 101 and electrically connected to the first stator assembly 130*d*, the second stator assembly 130*e*, the first motor 132*c* and the second motor 132*d*. In order to reduce an area of the control member 15, as shown in FIG. 26, the first pump assembly 20*d*, the first valve assembly 30*c*, the second pump assembly 20*e* and the second valve assembly 30*d* are arranged at intervals in the outer circumferential direction of the fluid control apparatus. The drive assembly 100 further includes a first gear assembly 133*c* and a second gear assembly 133*d*. The first motor 132*c* is in transmission connection with the first valve core 31*c* through the first gear assembly 133*c*, and the second motor 132*d* is in transmission connection with the second valve core 31*d* through the second gear assembly 133*d*. The first motor 132*c* and the second motor 132*d* are arranged in a first direction X, and the first stator assembly 130*d* and the second stator assembly 130*e* are arranged in a second direction Y which intersects with the first direction X. Part of the first gear assembly 133*c* and part of the second gear assembly 133*d* are located between the first motor 132*c* and the second motor 132*d*, which is convenient for centralized arrangement of the control parts of the first motor 132*c* and the second motor 133*d*. The output terminals of the first stator assembly 130*d* and of the second stator assembly 130*e* are close to each other and located in middle of the drive assembly 100. In this case, the control part of the pump assembly 20 and the control part of the valve assembly 30 may be arranged compactly, which is convenient to reduce the area of the control member 15.

Further, as shown in FIG. 36, in some embodiments, the fluid control apparatus 1 further includes a position-limiting assembly 50, which may be located in the fluid assembly 200. The pump assembly 20 includes a rotor assembly 22, a positioning shaft 222 and an isolation sleeve 23. At least part of the rotor assembly 22 is arranged in or on the stator assembly 130. The isolation sleeve 23 is arranged outside the part of the outer circumferential side of the rotor assembly 22, and at least part of the isolation sleeve 23 is located between the stator assembly 130 and the rotor assembly 22. The positioning shaft 222 is arranged inside the rotor assembly 22. A first side of the positioning shaft 222 in the axial direction and the isolation sleeve 23 are arranged in a position-limited manner. The position-limiting assembly 50 is arranged adjacent to a second side of the positioning shaft 222 in the axial direction, and the position-limiting assembly 50 and the rotor assembly 22 are arranged in a position-limited manner, for example, the position-limiting assembly 50 abuts against the rotor assembly 22. In this embodiment, the axial direction of the positioning shaft 222 is parallel to or coincident with the height direction of the fluid control apparatus. Through the above arrangement, both sides of the positioning shaft 222 in the axial direction can be limited, thus decreasing the axial movement of the positioning shaft 222, further decreasing the axial movement of the rotor assembly 22 and reducing the noise of the pump assembly 20.

In some embodiments, the pump assembly 20 further includes a pump cover 24, at least part of which is located at the outer circumferential side of the impeller assembly 221, and at least part of which is located in the first chamber 401. At least part of the position-limiting assembly 50 is located on the pump cover 24. The position-limiting assembly 50 has a groove 521, and an end of the second side of the positioning shaft 222 is located in the groove 521 and abuts against the bottom wall portion of the groove 521. Through the above arrangement, the isolation sleeve 23 cooperates with the pump cover 24 to realize the axial limit of the rotor assembly 22. Optionally, the pump cover 24 may be injection-molded with the main housing 40 into an integrated structure, or the pump cover 24 may be separately formed from the main housing 40 and connected to the main housing 40 in a position-limited manner, with a sealing ring being arranged between the pump cover 24 and the main housing 40 to seal them.

In some embodiments, the rotor assembly 22 further includes a first bearing 251 and a second bearing 252, which are arranged in the axial direction of the rotor assembly 22. In the axial direction of the rotor assembly 22, the first bearing 251 is located between the connecting portion 232 of the isolation sleeve 23 and the magnetic assembly 223, and the second bearing 252 is located between the magnetic assembly 223 and the position-limiting assembly 50. Through the above arrangement, it is easy to realize the rotation of the magnetic element 223 in the rotor assembly 22 and the rotation of the impeller assembly 22.

As shown in FIG. 26, in some embodiments, the position-limiting assembly 50 includes a first gasket 53 and the pump cover 24, and the first gasket 53 is arranged between the second bearing 252 and the pump cover 24. In an embodiment, the pump cover 24 includes a supporting portion 52 and at least two connecting ribs 51, and the first gasket 53 is arranged between the second bearing 252 and the supporting portion 52. Through the above arrangement, the wear between the pump cover 24 and the second bearing 252 can be reduced. In specific implementation, the positioning shaft 222 and the isolation sleeve 23 may be injection-molded into an integrated structure, and/or the magnetic assembly 223, the impeller assembly 221, the first bearing 251 and the second bearing 252 may be injection-molded into an integrated structure, so as to realize the stable connection between the structural components and facilitate the simplification of the assembly process of the fluid control apparatus.

In other embodiments, as shown in FIG. 22, the position-limiting assembly 50 includes a first position-limiting member 541, a second gasket 542 and a third gasket 543. The first position-limiting member 541 is firmly connected with the positioning shaft 222, and the second gasket 542 is arranged between the first bearing 251 and the connecting portion 232 in the axial direction of the rotor assembly 22. The first position-limiting member 541 includes a first flange portion 5411 and a cylindrical portion 5412. In the axial direction of the first position-limiting member 541, at least part of the orthographic projection of the cylindrical portion 5412 is located inside the orthographic projection of the first flange portion 5411, and the third gasket 543 is arranged between the first flange portion 5411 and the second bearing 252 in a position-limited manner. Through the above arrangement, when the electric pump device 20 is assembled with the main housing 40, the impeller assembly 22 of the electric pump device 20 may be arranged downward (up-down direction in the drawing), and in this case, the impeller assembly 22 and other structures are limited by the position-limiting assembly 50, which is easy to assemble the electric pump device 20 with the main housing 40. In this embodiment, the positioning shaft 222 and the isolation sleeve 23 may be injection-molded into an integrated structure, and/or the magnetic assembly 223, the impeller assembly 221, the first bearing 251 and the second bearing 252 may be injection-molded into an integrated structure, thus realizing a stable connection between the structural components and facilitating the simplification of the assembly process of the fluid control apparatus.

In order to realize the fixing connection between the first position-limiting member 541 and the positioning shaft 222, in some embodiments, the first position-limiting member 541 has a first threaded portion which is located on the cylindrical portion 5412, and the positioning shaft 222 has a second threaded portion which is in threaded connection with the first threaded portion. Alternatively, the first position-limiting member 541 may be connected with the positioning shaft 222 by riveting.

In some other embodiments, as shown in FIG. 23, at least part of the first bearing 251 is arranged between the outer circumferential side of the positioning shaft 222 and the connecting portion 232 of the isolation sleeve 23, and the position-limiting assembly 50 is located between the magnetic assembly 223 and the impeller assembly 221 in the axial direction of the rotor assembly 22. The position-limiting assembly 50 includes a second position-limiting member 551 and a fourth gasket 552. The second position-limiting member 551 is connected to the isolation sleeve 23 in a position-limited and sealed manner. For example, the second position-limiting member 551 is welded with the isolation sleeve 23. The second position-limiting member 551 is located at the side of the magnetic assembly 223 facing away from the connecting portion 232. The second bearing 252 is arranged between the outer circumferential side of the positioning shaft 222 and the second position-limiting member 551. In the axial direction of the rotor assembly 22, the fourth gasket 552 is arranged between the second bearing 252 and the magnetic assembly 223. In an embodiment, the second position-limiting member 551 includes a second flange portion 5511 and a second cylindrical portion 5512. In the axial direction of the second position-limiting member 551, at least part of the orthographic projection of the second cylindrical portion 5512 is located inside the orthographic projection of the second flange portion 5511. The second flange portion 5511 is hermetically connected with the isolation sleeve 23. In specific implementation, in this embodiment, the positioning shaft 222 and the magnetic assembly 223 may be injection-molded into an integrated structure, and the isolation sleeve 23 and the first bearing 251 may be injection-molded into an integrated structure, and the impeller assembly 221 is assembled and connected with the positioning shaft 222.

Through the above arrangement, the axial position-limiting of the rotor assembly 22 can be realized.

In summary, the fluid control apparatus 1 provided according to the embodiment of the present application includes a drive assembly 100 and at least two fluid subassemblies LK The drive assembly 100 includes at least two drive components 13. At least one of the drive components 13 includes a stator assembly 130, and at least part of the stator assembly 130 is connected in a position-limiting portion 112 of the first housing 11 in a position-limiting manner. At least one fluid subassembly LK includes a pump assembly 20, and the pump assembly 20 includes a rotor assembly 22. By arranging the rotor assembly 22 in the magnetic field range of the corresponding stator assembly 130, and the drive component 13 can drive the corresponding fluid subassembly LK to work. As such, the drive assembly 100 includes the drive component 13 that drives at least two fluid subassemblies LK to work. Compared with arranging a separate driving device for each fluid subassembly LK, the fluid control apparatus 1 provided according to the embodiment of the present application may reduce the space occupied by the drive assembly 100 and increase the integration level of the drive assembly 100. Further, at least two fluid subassemblies LK may also be integrated into one main housing 40, thus improving the integration level of the fluid control device 1 and reducing the space occupied by the fluid control apparatus 1. Moreover, by arranging the position-limiting assembly 50, the positioning shaft 222 may be axially limited, so that the rotor assembly 22 and other structures may be better axially limited.

In another aspect, an electric pump device is further provided according to the embodiment of the present application, which includes a stator assembly 130, a pump assembly 20 and a position-limiting assembly 50. The pump assembly 20 includes a rotor assembly 22, a positioning shaft 222, an isolation sleeve 23 and a pump cover 24. At least part of the rotor assembly 22 is arranged in or on the stator assembly 130. Optionally, at least part of the rotor assembly 22 is located at an inner side of the stator assembly 130, and the isolation sleeve 23 is arranged outside part of the rotor assembly 22, and at least part of the isolation sleeve 23 is located between the stator assembly 130 and the rotor assembly 22. The positioning shaft 222 is arranged inside the rotor assembly 22, and a first side of the positioning shaft 222 in the axial direction and the isolation sleeve 23 are arranged in a position-limited manner. The position-limiting assembly 50 is arranged adjacent to a second side of the positioning shaft 222 in the axial direction, and the position-limiting assembly 50 abuts against the rotor assembly 22. Through the above arrangement, it is convenient to realize the axial limit of the rotor assembly 22 and the positioning shaft 222. In the embodiment of the present application, the stator assembly 130, the pump assembly 20 and the position-limiting assembly 50 have the same or similar structures as those of the stator assembly 130, the pump assembly 20 and the position-limiting assembly 50 provided in any embodiment shown in FIGS. 1 to 27, and will not described in detail.

In some embodiments, the rotor assembly 22 includes a magnetic assembly 223 and an impeller assembly 221. At least part of the impeller assembly 221 and the magnetic assembly 223 are arranged in the axial direction of the rotor assembly 22, and at least part of the magnetic assembly 223 is arranged at an inner surface side of the stator assembly 130. The isolation sleeve 23 includes an end wall portion 231 and a connecting portion 232, and an extending direction of the end wall portion 231 intersects with an axial direction of the rotor assembly 22. The rotor assembly 22 includes a first bearing 251 and a second bearing 252, which are arranged in the axial direction of the rotor assembly 22. The first bearing 251 is located between the connecting portion 232 and the magnetic assembly 223, and the second bearing 252 is located between the magnetic assembly 223 and the position-limiting assembly 50. Through the above arrangement, it is convenient to realize the stable rotation of the rotor assembly 22 and to axially limit the rotor assembly 22.

As shown in FIG. 22, in some embodiments, the position-limiting assembly 50 includes a first position-limiting member 541, a second gasket 542 and a third gasket 543. The first position-limiting member 541 is firmly connected with the positioning shaft 222, and the second gasket 542 is arranged between the first bearing 251 and the connecting portion 232 in the axial direction of the rotor assembly 22. The first position-limiting member 541 includes a first flange portion 5411 and a cylindrical portion 5412. In the axial direction of the first position-limiting member 541, at least part of the orthographic projection of the cylindrical portion 5412 is located inside the orthographic projection of the first flange portion 5411, and the third gasket 543 is arranged between the first flange portion 5411 and the second bearing 252 in a position-limited manner.

Alternatively, as shown in FIG. 23, in some embodiments, the position-limiting assembly 50 is located between the magnetic assembly 223 and the impeller assembly 221. The position-limiting assembly 50 includes a second position-limiting member 551 and a fourth gasket 552. The second position-limiting member 551 is connected with the isolation sleeve 23 in a position-limited and sealed manner, and the second position-limiting member 551 is located at a side of the magnetic assembly 223 facing away from the connecting portion 232. The second bearing 252 is arranged between the outer circumferential side of the positioning shaft 222 and the second position-limiting member 551, and the fourth gasket 552 is arranged between the second bearing 252 and the magnetic assembly 222 in the axial direction of the rotor assembly 22.

The electric pump device may include a pump housing, which is arranged outside the stator assembly, and at least part of which is located at a side of the stator assembly facing away from the rotor assembly. The position-limiting manner of the pump housing and the stator assembly is similar to that of the first housing 11 and the stator assembly 130 mentioned in any of the above embodiments, for example, the stator assembly 130 may be integrally injection-molded with the pump housing or the stator assembly 130 may be fitted in the cavity of the pump housing. In specific implementation, when the stator assembly 130 and the pump housing are injection-molded into an integrated structure, the isolation sleeve 23 may be injection-molded with the pump housing into an integrated structure, or the isolation sleeve 23 and the pump housing are separately formed and hermetically connected. When the stator assembly 130 is assembled into the mounting cavity QS of the pump housing, the isolation sleeve 23 may be injection-molded with the pump housing into an integrated structure; or the isolation sleeve 23 and the pump housing are separately arranged and hermetically connected; or the isolation sleeve 23 and the stator assembly 130 are injection-molded into an integrated structure, and the isolation sleeve 23 and the stator assembly 130, as a whole, are separately arranged from the pump housing and hermetically connected with the pump housing. When the number of the stator assemblies 130 is at least two, different stator assemblies 130 may be connected to the first housing 11 in the same or different position-limiting ways, and the manners of connecting the isolation sleeves 23 corresponding to different stator assemblies 130 to the first housing 11 may be the same or different.

In another aspect, as shown FIGS. 1 to 45, a method 1000 for manufacturing a fluid control apparatus is further provided according to an embodiment of the present application, and the method 1000 for manufacturing the fluid control apparatus includes the following steps.

Step S110: forming the drive assembly 100.

In some embodiments, forming the drive assembly 100 in step S110 includes providing a first housing 11 and at least two drive components 13, and connecting at least part of the stator assembly 130 in the position-limiting portion 112 in the position-limiting manner. The first housing 11 has a first accommodating cavity 101, and the first housing 11 includes a bottom wall portion 111 and a position-limiting portion 112. The bottom wall portion 111 forms a part of the wall portion of the first accommodating cavity 101, and at least part of the position-limiting portion 112 protrudes from the bottom wall portion 111. At least one of the drive components 13 includes a stator assembly 130. The position-limiting portion 112 protrudes from the bottom wall portion 111 along the height direction of the drive assembly 100. The position-limiting portion 112 may extend away from the first accommodating cavity 101.

In some embodiments, connecting at least part of the stator assembly 130 in the position-limiting portion 112 in the position-limiting manner includes: taking the stator assembly 130 as an insert in an injection molding process, and forming at least part of the stator assembly 130 and the position-limiting portion 112 into an one-piece structure by the injection molding process; or mounting at least part of the stator assembly 130 in a mounting cavity QS, which is formed in the position-limiting portion 112 of the first housing 11, in the position-limiting manner. In this case, at least part of the output terminal 1304 in the stator assembly 130 is located in the first accommodating cavity 101, so that it is convenient to electrically connect the output terminal 1304 to the control member 15 in the drive assembly 100 or an external control member.

In some other embodiments, the fluid control apparatus may further include an isolation sleeve 23. In this case, after the step of connecting at least part of the stator assembly 130 in the position-limiting portion 112 in the position-limiting manner, it is possible to injection-molded the isolation sleeve 23 and the first housing 11 into an one-piece structure, so that part of the isolation sleeve 23 is located inside the stator assembly 130, and the isolation sleeve 23 is hermetically connected to the first housing 11 to isolate the stator assembly 130 from the outside and thus prevent the external water vapor from affecting the stator assembly 130.

Step S120, forming at least part of the fluid assembly 200.

In this embodiment, forming the fluid assembly 200 in step S120 includes providing at least two fluid subassemblies LK and providing the main housing 40.

In this embodiment, at least one of the fluid subassemblies LK includes a pump assembly 20. As shown in FIGS. 1 to 26, the number of fluid subassemblies LK in this embodiment of the present application is five, three of which each include a pump assembly 20 and the other two of which each include a valve assembly 30. In some other embodiments, the number of the fluid subassemblies LK may be two, and each of the fluid subassemblies LK may include the pump assembly 20, or one of the fluid subassemblies LK may include the pump assembly 20 and the other of the fluid subassemblies LK may include the valve assembly 30. The number of fluid subassemblies LK can be determined based on the needs of users, and the number of pump assemblies 20 and valve assemblies 30 included in the fluid subassemblies LK can also be determined based on the needs of users.

The main housing 40 has a first chamber 401, a first orifice 404 and a second orifice 405, which are spaced from each other. Both the first orifice 404 and the second orifice 405 communicate with the first chamber 401. In this case, forming at least part of the fluid assembly 200 in step S120 may further include assembling the pump assembly 20 with the main housing 40 in such a way that at least part of the pump assembly 20 is located in the first chamber 401, thus enabling the rotation of the rotor assembly 22 to drive the fluid to circulate through the first orifice 404 and the second orifice 405. Through the above arrangement, the pump assembly 20 may be arranged in the first chamber 401.

In specific implementation, when at least two fluid subassemblies LK each include a pump assembly 20, the multiple pump assemblies 20 may be assembled with the main housing to form at least part of the fluid assembly 200. In an embodiment, the pump assembly 20 may include the isolation sleeve 23 and the rotor assembly 22. In this case, before the step of assembling the pump assembly 20 with the main housing 40, the method may include a step of forming the pump assembly 20. For example, it is possible to dispose the rotor assembly 22 inside the isolation sleeve 23 firstly, so that the isolation sleeve 23 and the rotor assembly 22 are assembled into a whole structure to form the pump assembly 20, and then assemble the whole structure with the main housing 40. Alternatively, when the pump assembly 20 further includes the pump cover 40, it is possible to assemble the isolation sleeve 23, the rotor assembly 22 and the pump cover 24 into a whole structure firstly. Alternatively, the step of assembling the pump assembly 20 with the main housing 40 may include assembling the isolation sleeve 23 and the rotor assembly 22 with the main housing 40 respectively, and then hermetically connecting the isolation sleeve 23 to the main housing 40. Alternatively, when the pump assembly 20 further includes the position-limiting assembly 50, it is possible to engage the position-limiting assembly 50 with the positioning shaft 222 in a position-limited manner to form a whole structure, and then assemble the whole structure with the main housing 40. Alternatively, when the position-limiting assembly 50 is located in the main housing 40, it is possible to assemble the pump assembly 20 with the main housing 40 to realize axial limiting of the components such as the positioning shaft 222 and the rotor assembly 22, which is not limited in this application.

In some embodiments, when at least one of the fluid subassemblies LK includes a pump assembly 20, and at least one of the fluid subassemblies LK includes a valve assembly 30. The valve assembly 30 includes a valve core 31 and a valve core shaft 32. At least one drive component 13 includes a motor 132, and the main housing 40 further includes a bottom cover and a cavity shell 45. In this case, forming at least part of the fluid assembly 200 in step S120 includes the following steps.

Step 1: providing a main housing 40. The main housing 40 has a first chamber 401, a second chamber 402, a first orifice 404, a second orifice 405 and multiple flow channels 406. The first chamber 401 and the second chamber 402 are spaced from each other, and both the first orifice 404 and the second orifice 405 communicate with the first chamber 401.

Step 2: assembling the pump assembly 20 with the main housing 40 in such a way that at least part of the pump assembly 20 is located in the first chamber 401, thus enabling the rotation of the rotor assembly 22 to drive the fluid to circulate through the first orifice 404 and the second orifice 405. In this way, the function of the pump assembly 20 driving the fluid may be easily realized.

Step 3: assembling at least part of the valve assembly 30 into the corresponding chamber of the main housing 40, that is, assembling at least part of the valve assembly 30 into the second chamber 402 of the main housing 40, connecting the valve assembly 30 to the main housing 40 in a position-limited manner such that the communication cavity 31 of the valve core 31 enables at least two flow channels 406 to communicate. In an embodiment, the valve core 31 and the valve core shaft 32 may be assembled into the second chamber 402, and at least part of the valve core shaft 32 passes through the second chamber 402 to be in transmission connection with the output shaft of the motor 132. Or, when the drive assembly 100 further includes the gear assembly 133, the gear assembly 133 is in transmission connection with the drive assembly 100, and at least part of the valve core shaft 32 passes through the second chamber 402 to be in transmission connection with the gear assembly 133.

Step 4: connecting the bottom cover to the main housing 40 in a sealed manner.

For example, the bottom cover and the main housing may be sealed by welding process, so as to realize the position-limiting connection between the valve assembly 30 and the main housing 40. In specific implementation, the valve assembly 30 may include a first valve assembly 30*a* and a second valve assembly 30*b*, and the main housing 40 includes a cavity shell 45, a first bottom cover 42 and a second bottom cover 43. It can be understood that the step 2 and the step 3 may be performed simultaneously; or one of the step 2 and the step 3 may be performed firstly, and then the other of the step 2 and the step 3 may be performed.

Step S130, connecting the drive assembly 100 and the fluid assembly 200 in a sealed manner.

In specific implementation, the drive assembly 100 may be engaged with the pump assembly 20. For example, at least part of the rotor assembly 22 of the pump assembly 20 may be positioned inside the corresponding stator assembly 130, and part of the isolation sleeve 23 may be positioned between the stator assembly 130 and the corresponding rotor assembly 22. The rotor assembly 22 can be located within the magnetic field range of the corresponding stator assembly 130. When the coil winding in the stator assembly 130 is energized, a magnetic field may be generated, thus realizing the rotation of the rotor assembly 22 driven by the stator assembly 130. In order to realize the sealed connection between the drive assembly 100 and the fluid assembly 200, a sealing ring may be arranged between the drive assembly 100 and the fluid assembly 200. For example, the drive assembly 100 and the fluid assembly 200 may be connected by fasteners such as screws, and the sealing ring may be compressed, so as to realize the sealed connection between the drive assembly 100 and the fluid assembly 200.

In some embodiments, the fluid subassembly LK further includes the valve assembly 30; the main housing 40 further includes multiple flow channels 406; the first chamber 401 has a first mounting port K1; and the second chamber 402 has a second mounting port K2. The first mounting port K1 is located at a first side of the cavity shell 45 and the second mounting port K2 is located at a second side of the cavity shell 45, the first side and the second side being two sides in a height direction of the cavity shell. The multiple flow channels 406 are distributed on the outer circumferential side of the second chamber 402, and the first mounting port K1 of the first chamber 401 and the second mounting port K2 of the second chamber 402 are respectively arranged on different surfaces of the main housing 40. For example, as shown in FIGS. 1 to 25, the first mounting port K1 of the first chamber 401 and the second mounting port K2 of the second chamber 402 are respectively arranged at the two opposite sides of the main housing 40 in its own height direction.

Forming at least part of the fluid assembly 200 in step S120 includes: assembling the pump assembly 20 with the main housing 40 through the first mounting port K1 from one side of the main housing 40, so that at least part of the pump assembly 20 is located in the first chamber 401; assembling at least part of the valve assembly 30 into a second chamber 402 of the main housing 40 through the second mounting port K2 from the other side of the main housing 40, so that at least part of the valve assembly 30 is located in the second chamber 402. In specific implementation, when the valve assembly 30 includes a valve core 31 and a valve core shaft 32, the valve core 31 and the valve core shaft 32 may pass through the second mounting port K2, so that the valve core 31 is located in the second chamber 402, and at least part of the valve core shaft 32 is located outside the main housing 40, which is convenient for the valve core shaft 32 to be in transmission connection with the transmission assembly such as the motor 132. When the number of the pump assemblies 20 is at least two and the number of the valve assemblies 30 is at least two, it is possible to assemble all the pump assemblies 20 with the main housing 40 from one side of the main housing 40 through the first mounting port K1, and assemble all the valve assemblies 30 with the main housing 40 from the other side of the main housing 40 through the second mounting port K2. Then, the bottom cover may be hermetically connected to the cavity shell 45 of the main housing 40.

Alternatively, at least part of the pump assembly 20 may be firstly assembled into the first chamber 401 of the main housing 40, and then the drive assembly 100 may be hermetically connected to the main housing 40 in which the pump assembly 20 has been mounted. In this case, after the drive assembly 100 is hermetically connected to the fluid assembly 200 in step S130, the method may further include assembling at least part of the valve assembly 30 into the corresponding second chamber 402 of the main housing 40, and then connecting the valve assembly 30 to the main housing 40 in a position-limiting manner. In some embodiments, the main housing 40 further includes a bottom cover, which may be hermetically connected with the cavity of the main housing 40 after at least part of the valve assembly 30 is assembled into the corresponding cavity of the main housing 40. For example, the seal between the bottom cover and the main housing may be realized by welding process, so as to realize the position-limited connection between the valve assembly 30 and the main housing 40 and seal the second mounting port K2.

In summary, with the method for manufacturing the fluid control apparatus provided according to the embodiment of the present application, it is convenient to integrate at least two drive components 13 into a single drive assembly. Compared with providing a separate driving device for each fluid subassembly LK, the fluid control apparatus 1 provided in the embodiment of the application can reduce the occupied space of the drive assembly 100 and improve the integration level of the drive assembly 100. Further, at least two fluid subassemblies LK may also be integrated into a single main housing 40, which is convenient to improve the integration level of the fluid control apparatus 1 and reduce the space occupied by the fluid control apparatus 1. Moreover, by providing the position-limiting assembly 50, the positioning shaft 222 can be axially limited, so that the rotor assembly 22 and other structures may be better axially limited. The structure of the fluid control apparatus, which is manufactured by the method for manufacturing a fluid control apparatus described above, is shown in FIGS. 1 to 44, and will not be described again.

It should be noted that the above embodiments are only used to illustrate the present application and not limit the technical solutions described in the present application, for example, the definition of directions such as "front", "rear", "left", "right", "upper", "lower". Although the present application has been described in detail in the specification with reference to the above embodiments, those skilled in the art should understand that modifications, combinations or equivalent replacements can be made to the present application by those skilled in the art, and all technical solutions and improvements thereof without deviating from the spirit and scope of the present application shall fall within the scope of the claims of the present application.

The invention claimed is:

1. A fluid assembly, comprising a main housing, a pump assembly and a valve assembly, wherein the main housing has a first chamber and a second chamber, which are spaced from each other;

at least part of the pump assembly is arranged in the first chamber in a sealed manner, the valve assembly comprises a valve core, and at least part of the valve core is arranged in the second chamber in a sealed manner;

the pump assembly comprises a rotor assembly and a pump cover, the fluid assembly further comprises an isolation sleeve, wherein the isolation sleeve is located on at least part of an outer circumferential side of the rotor assembly and is connected to the main housing in a sealed manner and to the pump cover in a sealed manner, and the rotor assembly is located in a space formed between the pump cover and the isolation sleeve; and the pump cover has a first port and a second port, the rotor assembly is configured to drive fluid to circulate between the first port and the second port, at least part of the pump cover is located in the first chamber, and the main housing further comprises a first orifice and a second orifice, the first orifice and the second orifice are communicated with the first chamber, and the first port is communicated with the first orifice, and the second port is communicated with the second orifice.

2. The fluid assembly according to claim 1, wherein the first chamber has a first mounting port, the second chamber has a second mounting port, and the first mounting port and the second mounting port are arranged at different sides of the main housing respectively; and the main housing further comprises a communication channel, and the first chamber is in communication with at least the second chamber through the communication channel.

3. The fluid assembly according to claim 2, wherein the main housing further comprises a plurality of flow channels, and wherein the first orifice and the second orifice each is in communication with the first chamber, the plurality of flow channels are arranged at an outer circumferential side of a wall portion of the second chamber, one of the first orifice and the second orifice is in communication with any or some of the flow channels through the communication channel, and the valve core is configured to open and/or close the flow channels.

4. The fluid assembly according to claim 1, wherein the main housing comprises a first end and a second end which are oppositely arranged in a height direction of the main housing, a first mounting port of the first chamber is located at the first end, and a second mounting port of the second chamber is located at the second end.

5. The fluid assembly according to claim 1, wherein the rotor assembly comprises an impeller assembly and a positioning shaft, an end of the positioning shaft is connected to the main housing, the impeller assembly is arranged outside the positioning shaft, and at least part of the impeller assembly is located in the first chamber.

6. The fluid assembly according to claim 1, wherein the main housing further comprises a plurality of flow channels; the pump assembly comprises a first pump assembly, a second pump assembly and a third pump assembly; the communication channel of the main housing comprise a first communication channel, a second communication channel and a third communication channel; the first chamber comprises a first sub-cavity, a second sub-cavity and a third sub-cavity; the first orifice comprises a first sub-orifice, a second sub-orifice and a third sub-orifice; the second orifice comprises a fourth sub-orifice, a fifth sub-orifice and a sixth sub-orifice; both of the first sub-orifice and the fourth sub-orifice are communicated with the first sub-cavity, both of the second sub-orifice and the fifth sub-orifice are communicated with the second sub-cavity, and both of the third sub-orifice and the sixth sub-orifice are communicated with the third sub-cavity; and the first communication channel communicate the first sub-orifice with one of the flow channels, the second communication channel communicate the second sub-orifice with another of the flow channels, and the third communication channel communicates the sixth sub-orifice with yet other of the flow channels.

7. The fluid assembly according to claim 1, wherein the pump assembly comprises a first pump assembly and a second pump assembly;

the valve assembly comprises a first valve assembly and a second valve assembly;

the main housing has a first sub-cavity, a second sub-cavity, a third sub-cavity and a fourth sub-cavity which are spaced from each other;

at least part of the first pump assembly is located in the first sub-cavity, at least part of the second pump assembly is located in the second sub-cavity, at least part of the first valve assembly is located in the third sub-cavity, and at least part of the second valve assembly is located in the fourth sub-cavity; and at least one of the first sub-cavity and the second sub-cavity is communicated with the third sub-cavity in the main housing.

8. The fluid assembly according to claim 1, wherein the pump assembly comprises a first pump assembly, a second pump assembly and a third pump assembly;

the valve assembly comprises a first valve assembly and a second valve assembly;

the main housing has a first sub-cavity, a second sub-cavity, a third sub-cavity, a fourth sub-cavity and a fifth sub-cavity which are spaced from each other;

at least part of the first pump assembly is located in the first sub-cavity, at least part of the second pump assembly is located in the second sub-cavity, at least part of the third pump assembly is located in the third sub-cavity, at least part of the first valve assembly is located in the fourth sub-cavity, and at least part of the second valve assembly is located in the fifth sub-cavity spaced from the fourth sub-cavity; and at least one of the first sub-cavity, the second sub-cavity, the third sub-cavity, and the fifth sub-cavity is communicated with the fourth sub-cavity in the main housing.

9. A drive assembly for cooperating and being connected with a fluid assembly, wherein the fluid assembly comprises a pump assembly and a valve assembly, wherein the drive assembly comprises a first housing, a stator assembly, a motor, and a first accommodating cavity, wherein both of the stator assembly and the motor are connected to the first housing, the stator assembly is configured to cooperate with a rotor assembly of the pump assembly, the motor is configured to be in transmission connection with a valve core of the valve assembly, at least part of the motor is located in the first accommodating cavity, the first housing comprises a bottom wall portion and a position-limiting portion, the bottom wall portion forms part of a wall portion of the first accommodating cavity, at least part of the stator assembly is connected in the position-limiting portion, and the motor comprises an output shaft configured to be in transmission connection with the valve core.

10. The drive assembly according to claim 9, wherein the first housing comprises at least two position-limiting portions, and the number of the stator assemblies is at least two; and the stator assembly is fixed to the position-limiting portion by injection molding, or at least part of the stator assembly is located in a mounting cavity formed in the position-limiting portion.

11. A fluid control apparatus, comprising a fluid assembly and a drive assembly cooperating and connected with the fluid assembly, wherein the fluid assembly comprises a main housing, a pump assembly and a valve assembly, wherein the main housing has a first chamber and a second chamber, which are spaced from each other; at least part of the pump assembly is arranged in the first chamber in a sealed manner, the valve assembly comprises a valve core, and at least part of the valve core is arranged in the second chamber in a sealed manner; the pump assembly comprises a rotor assembly and a pump cover, the fluid assembly further comprises an isolation sleeve, wherein the isolation sleeve is located on at least part of an outer circumferential side of the rotor assembly and is connected to the main housing in a sealed manner and to the pump cover in a sealed manner, and the rotor assembly is located in a space formed between the pump cover and the isolation sleeve, the pump cover has a first port and a second port, the rotor assembly is configured to drive fluid to circulate between the first port and the second port, at least part of the pump cover is located in the first chamber, and the main housing further comprises a first orifice and a second orifice, the first orifice and the second orifice are communicated with the first chamber, and the first port is communicated with the first orifice, and the second port is communicated with the second orifice; and/or the drive assembly comprises a first housing, a stator assembly, a motor, and a first accommodating cavity, both of the stator assembly and the motor are connected to the first housing, the stator assembly is configured to cooperate with a rotor assembly of a pump assembly of the fluid assembly, the motor is configured to be in transmission connection with a valve core of a valve assembly of the fluid assembly, at least part of the motor is located in the first accommodating cavity, the first housing comprises a bottom wall portion and a position-limiting portion, the bottom wall portion forms part of a wall portion of the first accommodating cavity, at least part of the stator assembly is connected in the position-limiting portion, at least part of the motor is located in the first accommodating cavity, and the motor comprises an output shaft configured to be in transmission connection with the valve core.

* * * * *